US006269166B1

(12) United States Patent
Matsuo et al.

(10) Patent No.: US 6,269,166 B1
(45) Date of Patent: Jul. 31, 2001

(54) THREE-DIMENSIONAL ACOUSTIC PROCESSOR WHICH USES LINEAR PREDICTIVE COEFFICIENTS

(75) Inventors: Naoshi Matsuo; Kaori Suzuki, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/330,017

(22) Filed: Jun. 11, 1999

Related U.S. Application Data

(62) Division of application No. 08/697,247, filed on Aug. 21, 1996.

(30) Foreign Application Priority Data

Sep. 8, 1995 (JP) ..... 7-231705
Mar. 4, 1996 (JP) ..... 8-46105

(51) Int. Cl.[7] ..... H04R 5/02

(52) U.S. Cl. ..... 381/310

(58) Field of Search ..... 381/17, 18, 300, 381/309, 310, 1

(56) References Cited

U.S. PATENT DOCUMENTS 5,715,317 2/1998 Nakazawa .

OTHER PUBLICATIONS

Kawaura et al., "Discussion on Factors of Sound Image Localization Control for Reception and Reproduction by Headphone," *Acoustical Society of Japan (ASJ) Speech Collection No. 2–3–7*, Mar. 1986, pp. 247–248.

Hayashi, S., "Reproduction of Sound Field by Headphone and Subjective Assessment Thereof," *ASJ Speech Collection No. 1–8–17*, Mar. 1989, pp. 253–354.

Takabayashi et al., "Control of Two Reception Points in Room by Real–Time Convolution System," *ASJ Speech Collection No. 2–7–17*, Mar. 1990, pp. 445–446.

Shimodaira et al., "Fundamental Discussion on New OSS Reproduction Method Using Ear Speaker," *ASJ Speech Collection No. 1–7–2*, Mar. 1991, pp. 373–374.

Haneda et al., "Common Poles and Modeling of Head–Related Transfer Functions Independent of Direction of Propagation of Sound," *ASJ Speech Collection No. 1–8–5*, Oct. 1991, pp. 483–484.

Yoshida et al., "New OSS Reproduction Method Using Ear Speakers," *ASJ Speech Collection No. 1–8–7*, Oct. 1991, pp. 487–488.

Okada et al., "Implementation of Transaural Network in Live Room Using Real–Time Convolution System," *ASJ Speech Collection No. 1–2–17*, Oct. 1991, pp. 757–758.

(List continued on next page.)

*Primary Examiner*—Minsun Oh Harvey
(74) *Attorney, Agent, or Firm*—Staas & Halsey LLP

(57) ABSTRACT

To provide a three-dimensional acoustic effect to a listener in a reproduction field, via a headphone in particular, a three-dimensional acoustic apparatus is formed by a linear synthesis filter having filter coefficients that are the linear predictive coefficients obtained by performing a linear predictive analysis on an impulse response which represents the acoustic characteristics to be added to the original signal to achieve this effect. By passing the signal through this acoustic characteristics adding filter, the desired acoustic characteristics are added to the original signal, and by dividing the power spectrum of the impulse response of these acoustic characteristics into critical bandwidths and performing this linear predictive analysis based on impulse signal determined based from power spectrum signals representing the signal sound of each of these critical bandwidths, the filter coefficients of the linear synthesis filter are determined.

9 Claims, 56 Drawing Sheets

OTHER PUBLICATIONS

Koizumi, N., "Realization of Shared Acoustic Environment in Communication System," *ASJ Speech Collection No. 2–5–11*, Mar. 1992, pp. 477–478.

Majima et al., "Three–Dimensional Stereophonic Recording Method (RSS) Using Two Channels," *ASJ Speech Collection No. 2–5–13*, Mar. 1992, pp. 481–482.

Yoshida et al., "Discussion on New OSS Reproduction System Using Ear Speakers," *ASJ Speech Collection No. 2–5–14*, Mar. 1992, pp. 483–484.

Shimada et al., "Method of Stereophonic Sound Reproduction with Localization of Sound Image Outside Head Using Inner Earphones," *ASJ Speech Collection No. 2–5–15*, Mar. 1992, pp. 485–486.

Shimada et al., "Study on Clustering of Transfer Function Permitting Localization of Sound Outside Head," *ASJ Speech Collection No. 1–9–7*, Mar. 1993, pp. 379–380.

Iida et al., "Method of Symmetrical Sound Image Localization Using Shuffler Filter," *ASJ Speech Collection No. 1–5–19*, Oct. 1993, pp. 485–486.

Takahashi et al., "Study of Model of Head Related Transfer Functions," *ASJ Speech Collection No. 1–9–25*, Mar. 1994, pp. 471–472.

a1, a2, ···, an: LINEAR PREDICTIVE COEFFICIENTS

Fig.54

LEFT SIDE ← | → RIGHT SIDE

| | 0 | | n/2-1 | n/2 | | n-1 |
|---|---|---|---|---|---|---|
| A ↑ ℓ<br>(A) ↑ (ℓ) | $A_0 \rightarrow \ell$ | ⋮ | $A_{n/2-1} \rightarrow \ell$ | $(A_{n/2-1}) \rightarrow (\ell)$ | ⋮ | $(A_0) \rightarrow (\ell)$ |
| A ↑ r<br>(A) ↑ (r) | $A_0 \rightarrow r$ | ⋮ | $A_{n/2-1} \rightarrow r$ | $(A_{n/2-1}) \rightarrow (r)$ | ⋮ | $(A_0) \rightarrow (r)$ |
| B ↑ ℓ<br>(B) ↑ (ℓ) | $B_0 \rightarrow \ell$ | ⋮ | $B_{n/2-1} \rightarrow \ell$ | $(B_{n/2-1}) \rightarrow (\ell)$ | ⋮ | $(B_0) \rightarrow (\ell)$ |
| B ↑ r<br>(B) ↑ (r) | $B_0 \rightarrow r$ | ⋮ | $B_{n/2-1} \rightarrow r$ | $(B_{n/2-1}) \rightarrow (r)$ | ⋮ | $(B_0) \rightarrow (r)$ |

THREE-DIMENSIONAL ACOUSTIC PROCESSOR WHICH USES LINEAR PREDICTIVE COEFFICIENTS

This application is a division of application Ser. No. 08/697,247, filed Aug. 21, 1996, now pending.

BACKGROUND OF THE INVENTION

1. Field of the Invention

The present invention relates to acoustic processing technology, and more particularly to a three-dimensional acoustic processor which provides a three-dimensional acoustic effect to a listener in a reproducing sound field via a headphone or the like.

2. Description of Related Art

In general, to achieve accurate reproduction or location of a sound image, it is necessary to obtain the acoustic characteristics of the original sound field up to the listener and the acoustic characteristics of the reproducing sound field from the acoustic output device, such as a speaker or a headphone, to the listener. In an actual reproducing sound field, the former acoustic characteristics are added to the sound source and the latter characteristics are removed from the sound source, so that even using a speaker or a headphone it is possible to reproduce to the listener the sound image of the original sound image of the original sound field, or so that it is possible to accurately localize the position of the original sound image.

In the past, in order to add the acoustic characteristics from the sound source to the listener of the original sound field and remove the acoustic characteristics of the reproducing sound field from the acoustic output device such as a speaker or a headphone up to the listener, a FIR (finite impulse response, non-recursive) filter having coefficients that are the impulse responses of each of the acoustic spatial paths was used as a filter to emulate the transfer characteristics of the acoustic spatial path and the reverse of the acoustic characteristics of the reproducing sound field up to the listener.

However, when measuring the impulse response in a normal room for the purpose of obtaining the coefficients of an FIR filter in the past, the number of taps of the FIR which represent those characteristics when using an audio-signal sampling frequency of 44.1 kHz is several thousand or even greater. Even in the case of the inverse of the transfer characteristics of a headphone, the number of taps required is several hundred or even greater.

Therefore, when using FIR filters, there is a huge number of taps and computation required, causing the problems that in an actual circuit implementation it is necessary to have a plurality of parallel DSPs or convolution processors, this hindering a reduction in cost and the achievement of a physically compact circuit.

In addition, in the case of localizing the sound image, it is necessary to perform parallel processing of a plurality of channel filters for each of the sound image positions, making it even more difficult to solve the above-noted problems.

Additionally, in an image-processing apparatus which processes images which have accompanying sound images, such as in real-time computer graphics, the amount of image processing is extremely great, so that if the capacity of the image-processing apparatus is small or many images must be processed simultaneously, the insufficient processing capacity produces cases in which it is not possible to display a continuous image, and the image appears as a jump-frame image. In such cases, there is the problem that the movement of the sound image, which is synchronized to the movement of the visual image, becomes discontinuous. In addition, in cases in which the environment is different from the expected visual/auditory environment of, for example, the user's position, there is the problem of the apparent movement of the visual image being different from the movement of the sound image.

SUMMARY OF THE INVENTION

In consideration of the above-noted drawbacks of the prior art, an object of the present invention is to perform linear predictive analysis of the impulse response which represents the acoustic characteristics to be added to the original signal for the purpose of adding characteristics to the acoustic characteristics, the linear predictive coefficients being used to form a synthesis filter, thereby greatly reducing the number of filter taps, so as to achieve such effects as reduction in size and cost of the related hardware, and an increase in the processing speed achieved thereby. In the case of performing the above-noted linear predictive analysis and using a filter of lower order than the original number of impulse response samples to approximate the frequency characteristics, a three-dimensional acoustic processor is provided in which in particular in the case of high complexity in which the sharp peaks and valleys existing in the original impulse response frequency characteristics, in order to prevent a loss of approximation accuracy, before the linear predictive analysis is performed, to eliminate any auditory change the frequency characteristics of the original impulse responses are smoothed and compensated in the frequency domain, thereby approaching the original impulse response frequency characteristics and enabling a reduction of the number of filters without causing a change in the overall acoustic characteristics.

Another object of the present invention is to provide a three-dimensional acoustic processor in which the acoustic characteristics from a plurality of positions from which a sound image is to be localized are divided into characteristics common to each position and individual characteristics for each position, the filters which add these being disposed in series to control the position of the sound image, thereby reducing the amount of processing performed. In the case in which the sound image is caused to move, by localizing a single sound image at a plurality of locations and controlling the difference in acoustic output level between the different locations, the sound image is smoothed therebetween, interpolation being performed between the positions of the visual image which moves discontinuously, thereby achieving moving of the sound image which matches the thus interpolated positions. In addition, a three-dimensional acoustic processor is provided wherein, in the case in which a reproducing sound image is reproduced using a DSP (digital signal processor) or like, to avoid complexity of registers and like, and to perform the desired sound image localization, localization processing is performed for only the required virtual sound source.

According to the present invention, a three-dimensional acoustic processor is provided which localize a sound image using a virtual sound source, wherein the acoustic characteristics to be added to the sound signal are formed by a linear synthesis filter having filter coefficients that are the linear predictive coefficients obtained by linear predictive analysis of the impulse response which represents those acoustic characteristics, the desired acoustic characteristics being added to the above-noted original signal via the above-noted linear synthesis filter.

The above-noted linear synthesis filter includes a short-term synthesis filter having an IIR filter configuration and which uses the above-noted linear predictive coefficients which adds the desired frequency characteristics to the above-noted original signal, and a pitch synthesis filter having an IIR filter configuration and which uses the above-noted linear predictive coefficient which adds the desired frequency characteristics to the above-noted original signal. The above-noted pitch synthesis filter is formed by a pitch synthesis section with regard to direct sounds with a large attenuation factor, a pitch synthesis section with regard to reflected sounds with a small attenuation factor, and a delay section which applies a delay time thereto. Furthermore, the inverse acoustic characteristics of an acoustic output device such as a headphone or a speaker are formed by means of a linear predictive filter having filter coefficients which are the linear predictive coefficients obtained by linear predictive analysis of the impulse response which represents the acoustic characteristics thereof, the acoustic characteristics of the above-noted acoustic output device being eliminated via this filter. The above-noted linear predictive filter is formed as an FIR filter which uses the above-noted linear predictive coefficients.

According to the present invention, a three-dimensional acoustic processor which uses linear prediction is provided, wherein the desired acoustic characteristics to be added to the original signal are formed by a linear synthesis filter having filter coefficients that are the linear predictive coefficients obtained by means of linear predictive analysis of the impulse response which represents those acoustic characteristics, these desired acoustic characteristics being added to the above-noted original signal via this filter, the power spectrum of the desired impulse response representing the above-noted acoustic characteristics being divided into a plurality of critical frequency bands, the above-noted linear predictive analysis being performed based on impulse signals determined from the power spectrum which is used to represent the signal sounds within each of the critical bands, thereby determining the filter coefficients of the above-noted linear synthesis filter.

The spectral signals which represents the signal sounds within each critical band are taken as the accumulated sums, maximum values, or average values of the power spectrum within each critical band. Interpolation is performed between the power spectrum signals which represent the signal sounds within each of the above-noted critical bands, and the filter coefficients of the above-noted linear synthesis filter are determined by performing the above-noted linear predictive analysis based on the impulse signal determined from the above-noted output interpolated signal. For the above-noted interpolation, first order linear interpolation or high-order Taylor series interpolation are used. In addition, an impulse response which indicates the acoustic characteristics for the case of a series linking of the propagation path in the original sound field and the propagation path having the inverse acoustic characteristics of the reproducing sound field is used as the impulse response indicating the above-noted sound field, a filter to which is added the acoustic characteristics of the original sound field and a filter which eliminates the acoustic characteristics in the reproducing sound field being linked as one filter and used as the above-noted linear synthesis filter for determination of the linear predictive coefficients based on the above-noted linked impulse response. A compensation filter is used to reduced the error between the impulse response of the linear synthesis filter which uses the above-noted linear predictive coefficients and the impulse response which indicates the above-noted acoustic characteristics.

A three-dimensional acoustic processor according to the present invention which localizes a sound image using a virtual sound source has a first acoustic characteristics adding filter which is formed by a linear synthesis filter which has filter coefficients that are the linear predictive coefficients obtained by linear predictive analysis of the impulse response which represents each of the acoustic characteristics of one or each of a plurality of propagation paths to the left ear to be added to the original signal, a first acoustic characteristics elimination filter which is connected in series with the above-noted first acoustic characteristics adding filter, and which is formed by a linear predictive filter having filter coefficients which represent the inverse of acoustic characteristics for the purpose of eliminating the acoustic characteristics of an acoustic output device to the left ear, these filter coefficients being obtained by a linear predictive analysis of the impulse response representing the acoustic characteristics of the above-noted acoustic output device, a second acoustic characteristics adding filter which is formed by a linear synthesis filter which has filter coefficients that are the linear predictive coefficients obtained by a linear predictive analysis of the impulse response which represents each of the acoustic characteristics of one or each of a plurality of propagation paths to the right ear to be added to the original signal, a second acoustic characteristics elimination filter which is connected in series with the above-noted second acoustic characteristics adding filter, and which is formed by a linear predictive filter having filter coefficients which represent the inverse of acoustic characteristics for the purpose of eliminating the acoustic characteristics of an acoustic output device to the right ear, these filter coefficients being obtained by a linear predictive analysis of the impulse response representing the acoustic characteristics of the above-noted acoustic output device, and a selection setting section which selectively sets the parameters for the above-noted first acoustic characteristics adding filter and above-noted second acoustic characteristics adding filter responsive to position information of the sound image.

The above-noted first and second acoustic characteristics adding filters are configured from a common section which adds characteristics which are common to each of the acoustic characteristics of the acoustic path, and an individual characteristic section which adds characteristics individual to each of the acoustic characteristics of each acoustic path. In addition, there is a storage medium into which is stored the calculation results for the above-noted common section of the desired sound source, and a readout/indication section which reads out the above-noted stored calculation results, the readout/indication section directly to the above-noted individual characteristic section the read out calculation results, by means of the readout it performs. In addition to storing the above-noted calculation results of the common section for the desired sound source, the storage medium can also store the calculation results of the corresponding first or second acoustic characteristics elimination filter.

The above-noted first acoustic characteristics adding filter and second acoustic characteristics adding filter further have a delay section which imparts a delay time between the two ears, so that by making the delay time of the delay section of either the first or the second acoustic characteristics adding filter the reference (zero delay time), it is possible to eliminate the delay section which has this delay of zero. The above-noted first acoustic characteristics adding filter and second acoustic characteristics adding filter each further have an amplification section which enables variable setting of the output signal level thereof, the above-noted selection setting section relatively varying the output signal levels of the first and the second acoustic characteristics adding filters by setting the gain of these amplification sections in response to position information of the sound image, thereby enabling movement of the localized position of the sound image. The above-noted first and second acoustic characteristics adding filters can be left-to-right symmetrical about the center of the front of the listener, in which case, the parameters for the above-noted delay sections and amplification sections are shared in common between positions which correspond in this left-to-right symmetry.

In accordance with the present invention, the above-noted three-dimensional acoustic processor has a position information interpolation section which interpolates intermediate position information from past and future sound image position information, interpolated position information from this position information interpolation section being given to the selection setting section as position information. In the same manner, there is a position information prediction section which performs predictive interpolation of future position information from past and current sound image position information, the future position information from this position information prediction section being given to the selection setting section as position information.

The above-noted position information prediction section further includes a regularity judgment section which performs a judgment with regard to the existence of regularity with regard to the movement direction, based on past and current sound image position information, and in the case in which the regularity judgment section judges that regularity exists, the above-noted position information prediction section provides the above-noted future position information. It is possible to use the visual image position information from image display information for a visual image which generates a sound image in place of the above-noted sound image position information. So that the above-noted selection setting section can further provide and maintain a good audible environment for the listener, it can move the above-noted environment in response to position information given with regard to the listener.

In accordance with the present invention, a three-dimensional acoustic processor is provided which localizes a sound image by level control from a plurality of virtual sound sources, this processor having an acoustic characteristics adding filter which adds the impulse response which indicates the acoustic characteristics of each of the above-noted virtual sound sources to the listener and which is given with respect to two adjacent virtual sound sources between which is localized a sound image, this acoustic characteristics adding filter storing filter calculation parameters for the two adjacent virtual sound sources, and when one of the two adjacent virtual sound sources are moved to an adjacent region, without changing the acoustic characteristics filter calculation parameter corresponding to that virtual sound source, the acoustic characteristics filter calculation parameters of the other virtual sound source are updated to the virtual sound source which exists in the adjacent region.

According to the present invention, a linear synthesis filter is formed which has linear predictive coefficients that are obtained by linear predictive analysis of the impulse response which represents the desired acoustic characteristics to be added to the original signal. Then compensation is performed of the linear predictive coefficients so that the time-domain envelope (time characteristics) and the spectrum (frequency characteristics) of this linear synthesis filter are the same as or close to the original impulse response. Using this compensated linear synthesis filter, the acoustic characteristics are added to the original sound. Because the time-domain envelope and spectrum are the same as or close to the original impulse response, by using this linear synthesis filter it is possible to add acoustic characteristics which are the same as or close to the desired characteristics. In this case, by making the linear synthesis filter a pitch filter and a short-term filter which are IIR filters (recursive filters), it is possible to form the linear synthesis filters with a great reduction in the number of filter taps as compared with the past. In this case, the above-noted pitch synthesis filter is used to control the time-domain envelope and the short-term synthesis filter is mainly used to control the spectrum.

According to the present invention, the acoustic characteristics are changed with consideration given to the critical bandwidths in the frequency domain of the impulse response indicating the acoustic characteristics. From these results, the auto-correlation is determined. In the case of making the change with consideration given to the above-noted critical bandwidth, because the human auditory response is not sensitive to a shift in phase, it is not necessary to consider the phase spectrum. By smoothing the original impulse response so that there is no auditory perceived change, consideration being given to the critical bandwidth, it is possible to achieve a highly accurate approximation of frequency characteristics using linear predictive coefficients of low order.

According to the present invention, filters are configured by dividing the acoustic characteristics to be added to the input signal into characteristics which are common to each position at which the sound image is to be localized and individual characteristics. In the case of adding acoustic characteristics, these filters are connected in series. By doing this, it is possible to reduce the overall amount of calculations performed. In this case, the larger the number of individual characteristics, the larger will be the effect of the above-noted reduction in the amount of calculations. By storing the results of the processing for the above-noted common parts beforehand onto a storage medium such as a hard disk, for applications such as games, in which the sounds to be used are pre-established, it is possible to perform real-time processing of input of the individual acoustic characteristics to the filters for each position by merely reading out the signal directly from the storage medium. For this reason, there is not only a reduction in the amount of calculations, but also there is a reduction in the amount of storage capacity required, compared to the case of simply storing all information in the storage medium.

In addition, in addition to storing the output signal of the filter to add the common characteristics to each position, it is possible to store into the storage medium the output signals obtained by input to filters for eliminating acoustic characteristics. In this case, there is no need to perform processing of the acoustic characteritics elimination filter in real time. Thus, it is possible to use a storage medium to move a sound image with a small amount of processing.

Further, according to the present invention, it is possible to move a sound image continuously by moving the sound image in accordance with the interpolated positions of a visual image which is moving discontinuously. Also, by inputting the user's auditory and visual environment into an image controller and a sound image controller it is possible to achieve apparent agreement between the movement of the visual image and the movement of the sound image, by using this information to control the movement of the visual image and sound image.

According to the present invention, by compensating for the waveform of the synthesis filter impulse response in the time domain, it is easy to control the difference in level between the two ears. By doing this, it is possible to reduce the number of filters without changing the overall acoustic characteristics, making a DSP implementation easier, and further it is possible to reduce the amount of required memory capacity by only performing localization processing for the required virtual sound sources for the purpose of localizing the desired sound image.

BRIEF DESCRIPTION OF THE DRAWINGS

The present invention will be more clearly understood from the description as set forth below, with reference being made to the accompanying drawings, wherein:

FIG. 54 is a drawing which shows an example of the left-to-right symmetrical acoustic characteristics of FIG. 53;

DESCRIPTION OF PREFERRED EMBODIMENTS

Before describing the present invention, the technology related to the present invention will be described, with reference made to the accompanying drawings FIG. 1 through FIG. 10B.

Figure 1:
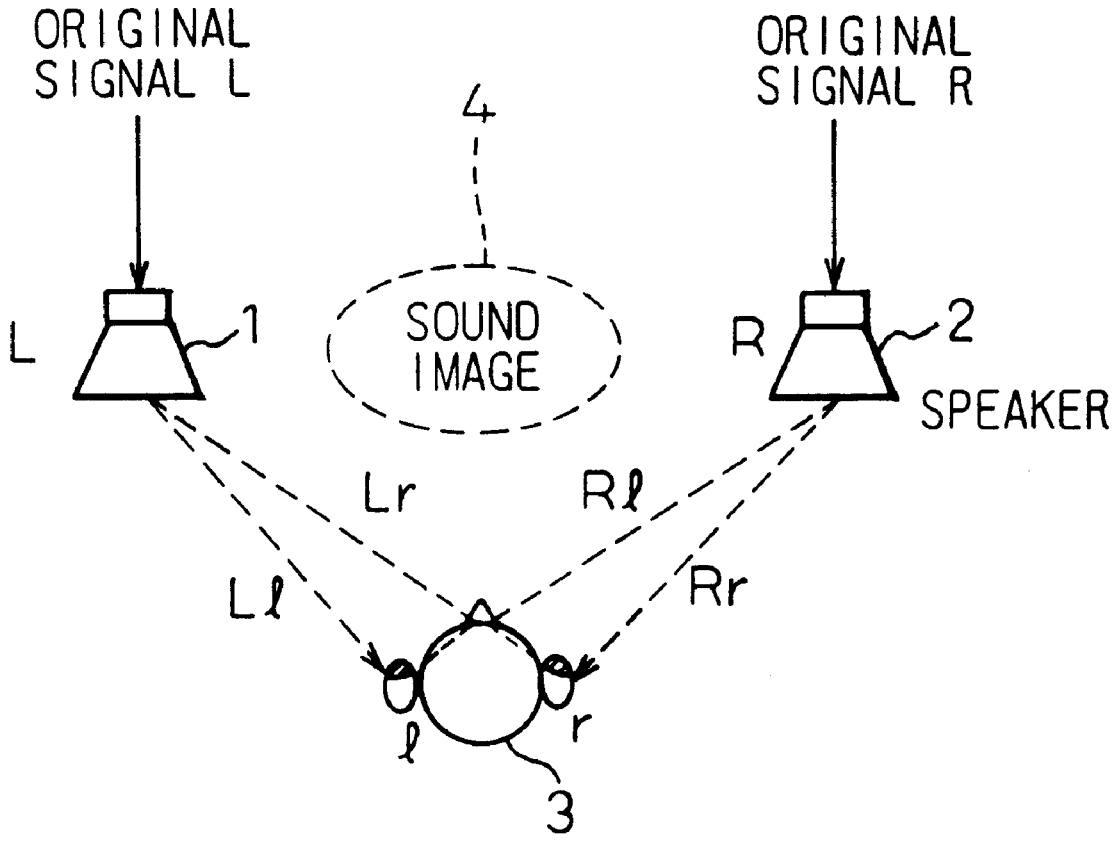
FIG. 1 is a drawing which shows an example of a three-dimensional sound image received from a two-channel stereo apparatus.

FIG. 1 shows the case of listening to a sound image from a two-channel stereo apparatus in the past.

Figure 2:
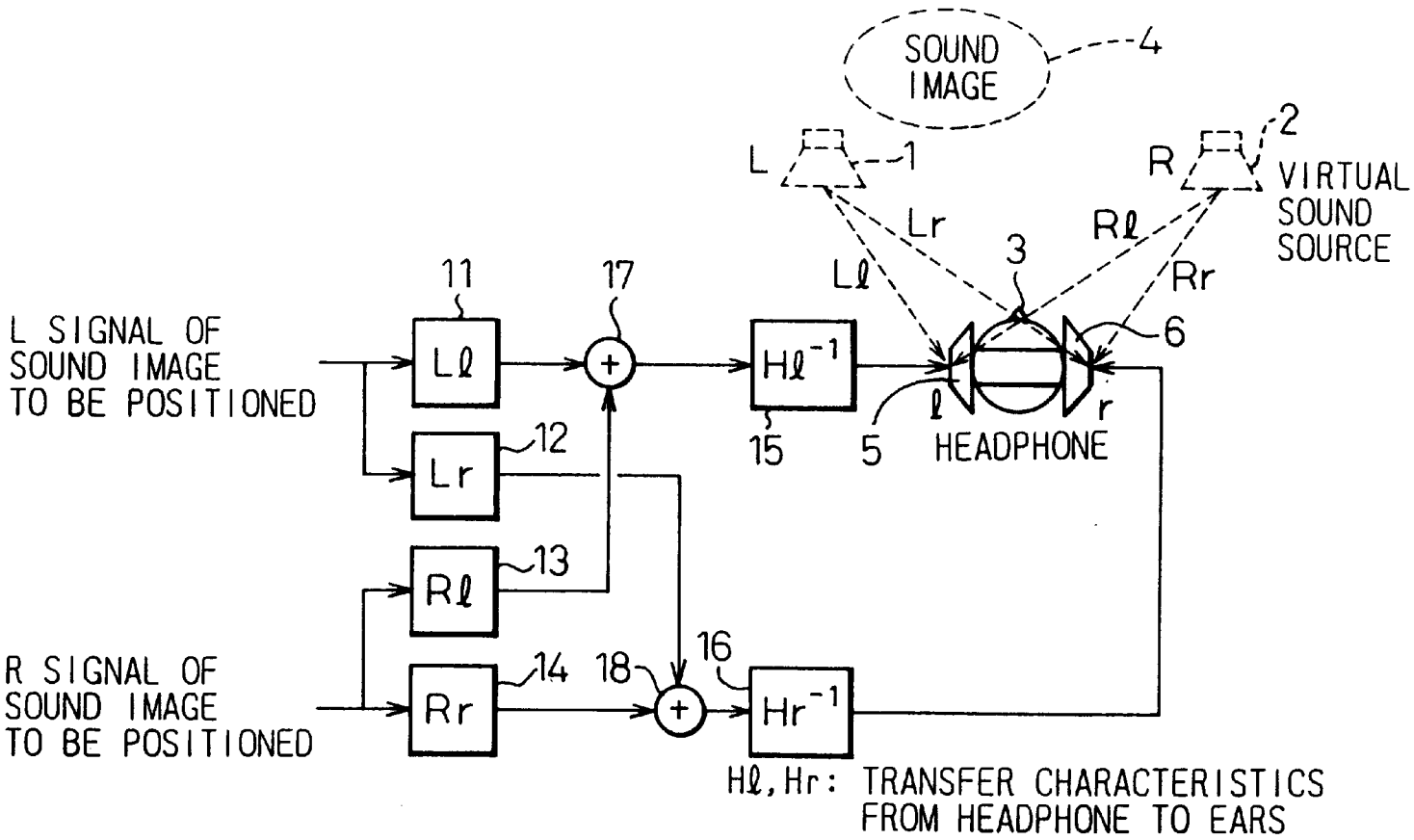
FIG. 2 is a drawing which shows an example of the configuration of an equivalent acoustic space in which the headphone of FIG. 1 are used.

FIG. 2 shows the basic block diagram circuit configuration which achieves an acoustic space that is equivalent to that created by the headphone in FIG. 1.

In FIG. 1, the transfer characteristics for each of the acoustic space paths from the left and right speakers (L, R) 1 and 2 to the left and right ears (l, r) of the listener 3 are expressed as Ll, Lr, Rr, and Rl. In FIG. 2, in addition to the transfer characteristics 11 through 14 of each of the acoustic space paths, the inverse characteristic ($Hl^{-1}$ and $Hr^{-1}$) 15 and 16 of each of the characteristics from the left and right earphones of headphone (HL and HR) 5 and 6 to the left and right ears are added.

As shown in FIG. 2, by adding the above-noted transfer characteristics 11 through 16 to the original signals (L signal and R signal), it is possible to accurately reproduce the signals output from the speakers 1 and 2 by the output from the earphones of headphone 5 and 6, so that it is possible to present the listener with the effect that would be had by listening to the signals from the speakers 1 and 2.

Figure 3:
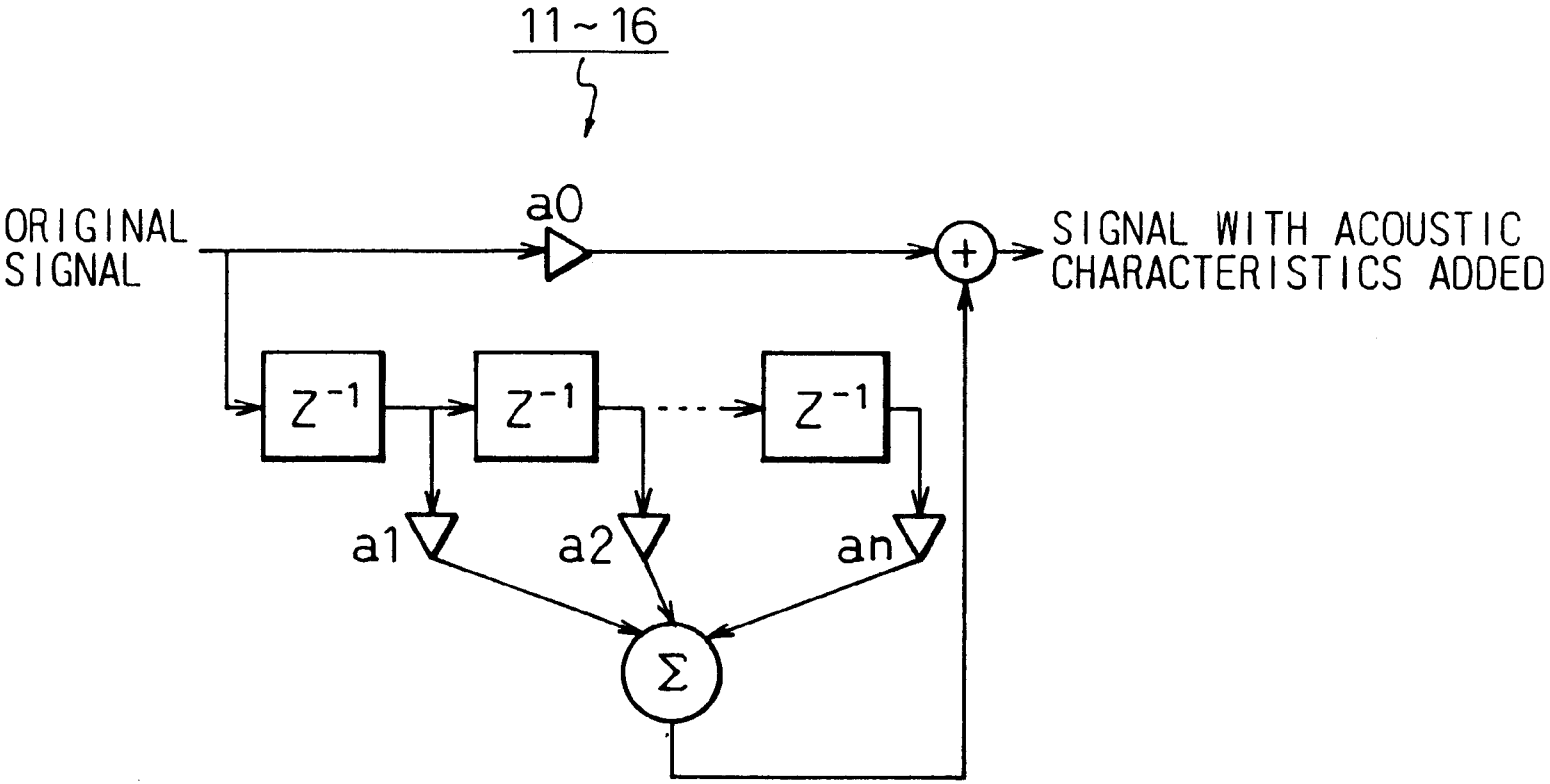
FIG. 3 is a drawing which shows an example of an FIR filter of the past.

FIG. 3 shows an example of configuration of a circuit of an FIR filter (non-recursive filter) of the past for the purpose of achieving the above-noted transfer characteristics.

In general, to achieve a filter which emulates the transfer characteristics 11 through 14 of each of the acoustic space paths and the inverse transfer characteristics 15 and 16 from the earphones of headphone to the ears as shown in FIG. 2, an FIR filter (non-cursive filter) having coefficients that represent the impulse response of each of the acoustic space paths is used, this being expressed by Equation (1).

$$\frac{Y(Z)}{X(Z)} = a0 + a1Z^{-1} + \ldots + anZ^{-n} \tag{1}$$

The filter coefficients obtained from the impulse response obtained from, for example, an acoustic measurement or an acoustic simulation for each path are used as the filter coefficients (a0, a1, a2, . . . , an) which represent the transfer characteristics 11 to 14 of each of the acoustic space paths. To add the desired acoustic characteristics to the original signal, the impulse response which represents the characteristics of each of the paths are convoluted via these filters.

The filter coefficients (a0, a1, a2, . . . , an) of the inverse characteristics ($Hl^{-1}$ and $Hr^{-1}$) 15 and 16 of the headphone, shown in FIG. 2, are determined in the frequency domain. First, the frequency characteristics of the headphone are measured and the inverse characteristics thereof determined, after which these results are restored to the time domain to obtain the impulse response which is used as the filter coefficients.

Figure 4:
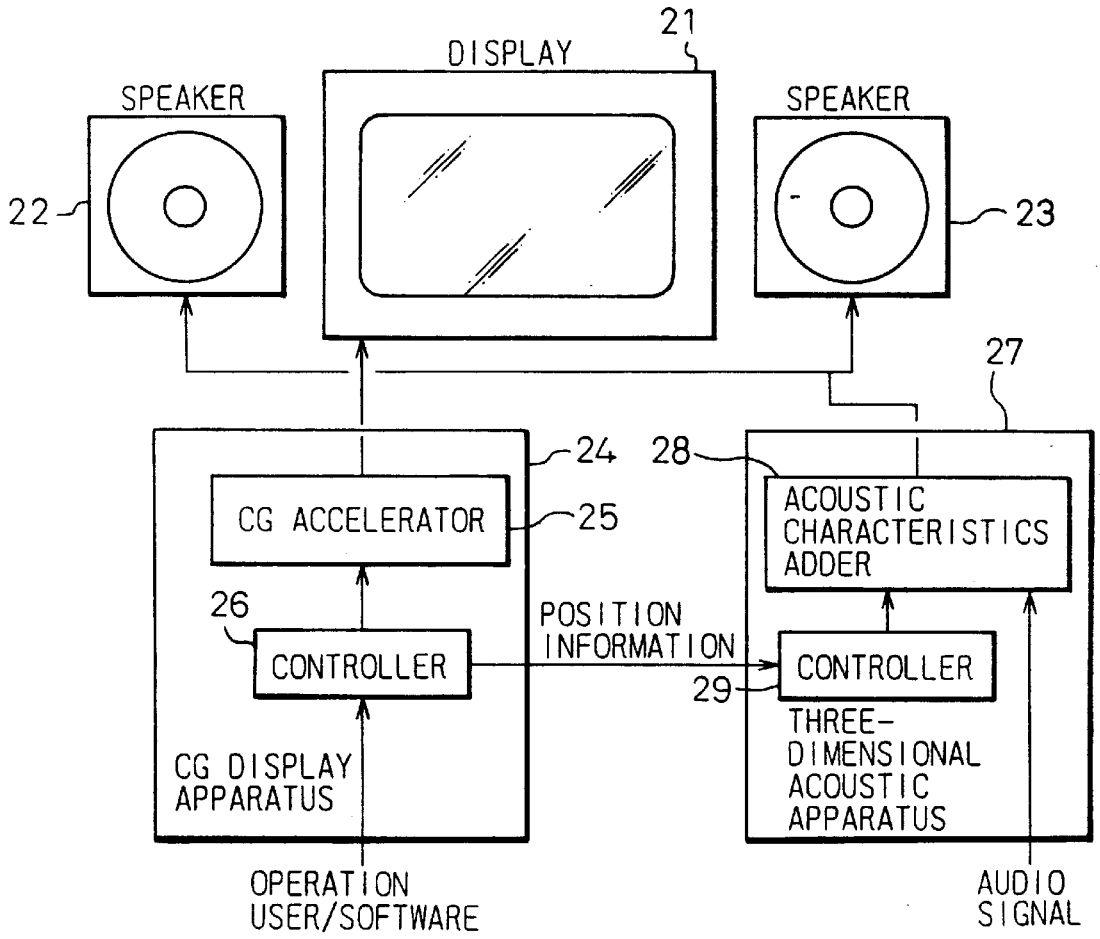
FIG. 4 is a drawing which shows an example of the configuration of a computer graphics apparatus and a three-dimensional acoustic apparatus.

FIG. 4 shows an example of the basic system configuration for the case of moving a sound image to match a visual image on a computer graphics (CG) display.

In FIG. 4, by means of user actions and software, the controller 26 of the CG display apparatus 24 drives a CG accelerator 25, which performs image display, and also provides to a controller 29 of the three-dimensional acoustic apparatus 27 position information of the sound image which is synchronized with the image. Based on the above-noted position information, an acoustic characteristics adder 28 controls the audio output signal level from each of the channel speakers 22 and 23 (or headphone) by means of control from the controller 29, so that the sound image is localized at a visual image position within the display screen of the display 21 or so that it is localized at a virtual position outside the display screen of the display 21.

Figure 5:
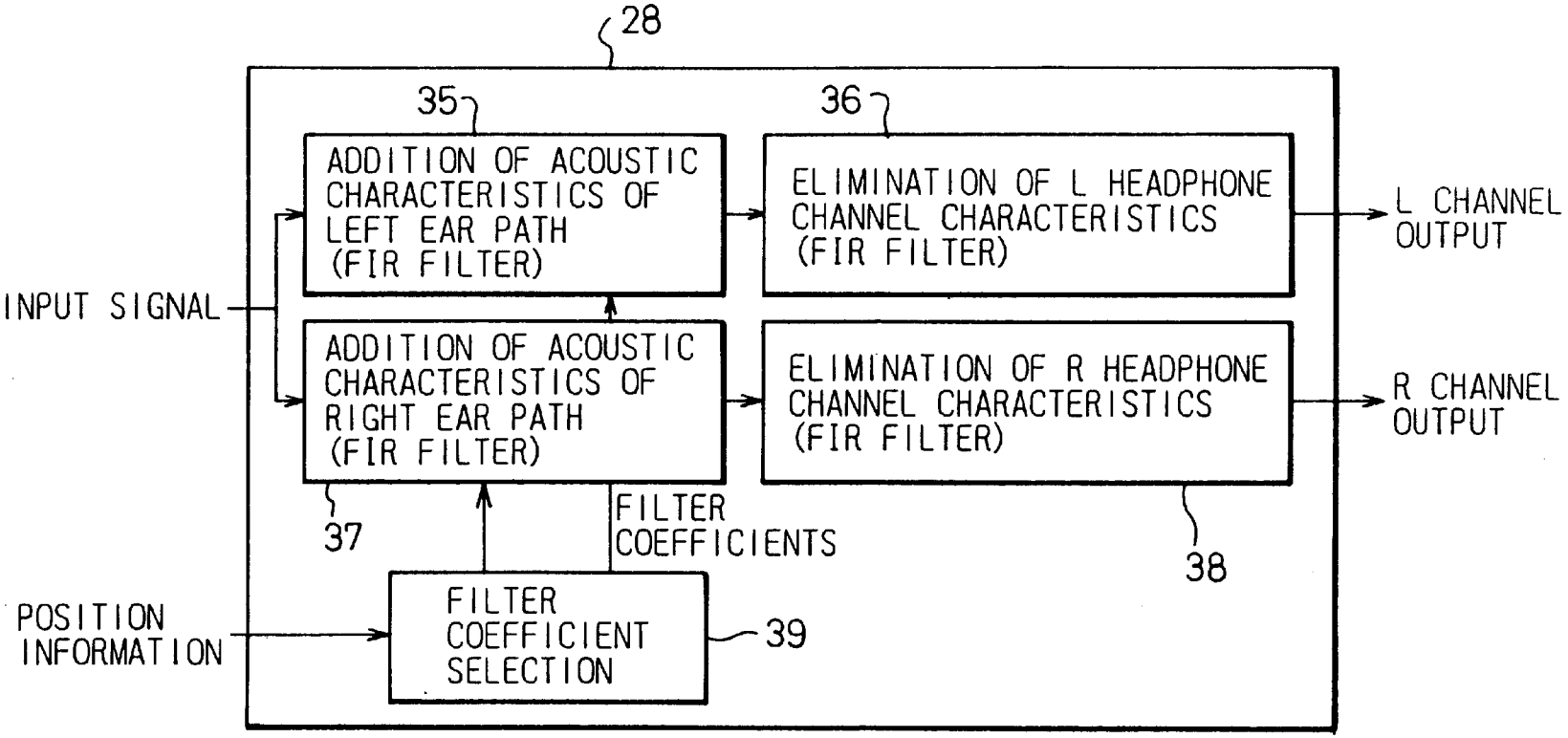
FIG. 5 is a drawing which shows an example of the basic configuration of the acoustic characteristics adder of FIG. 4.

FIG. 5 shows the basic configuration of the acoustic characteristics adder 28 which is shown in FIG. 4. The acoustic characteristics adder 28 comprises acoustic characteristics adding filters 35 and 37 which use the FIR filter of FIG. 3 and which give the transfer characteristics Sl and Sr of each of the acoustic space path from the sound source to the ears, acoustic characteristics elimination filters 36 and 38 for headphone channels L and R, and a filter coefficients selection section 39, which selectively gives the filter coefficients of each of the acoustic characteristics adding filters 35 and 37, based on the above-noted position information.

FIGS. 6 through 8B illustrate the sound image localization technology of the past, which used the acoustic characteristics adder 28.

Figure 6:
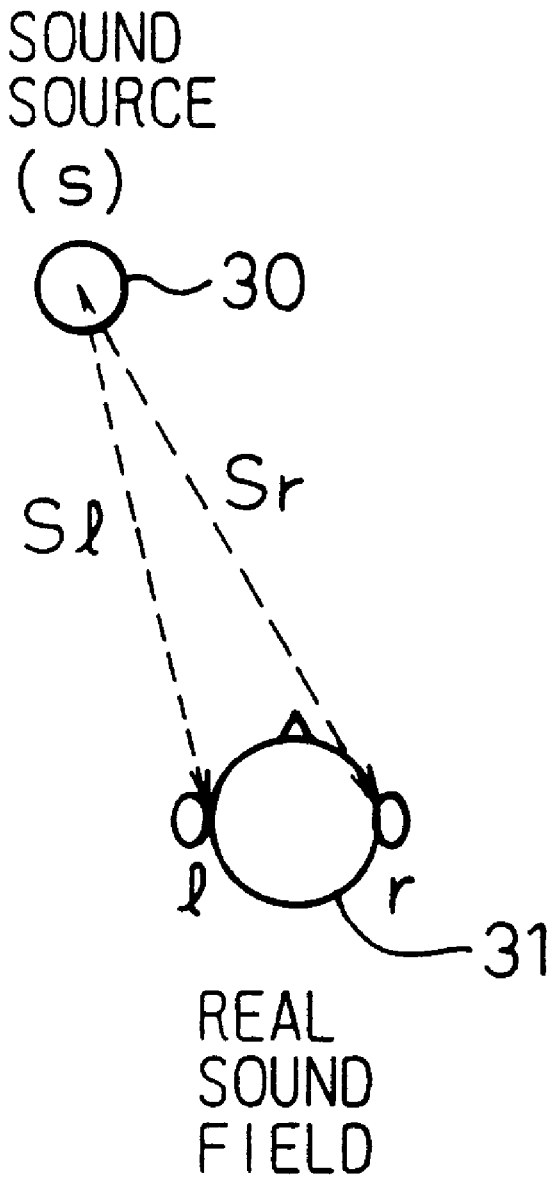
FIG. 6 is a drawing which illustrates sound image localization technology in the past (part 1)

FIG. 6 shows the general relationship between a sound source and a listener. The transfer characteristics Sl and Sr between the sound source 30 and the listener 31 are similar to those described above in relation to FIG. 1.

Figure 7A:
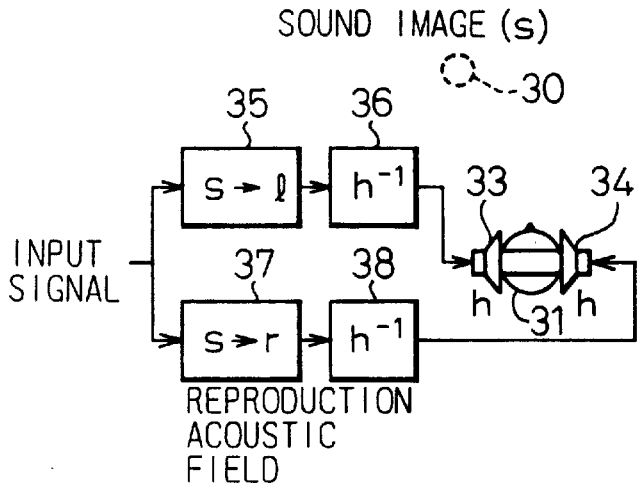
FIG. 7A is a drawing which illustrates sound image localization technology in the past (part 2)
Figure 7B:
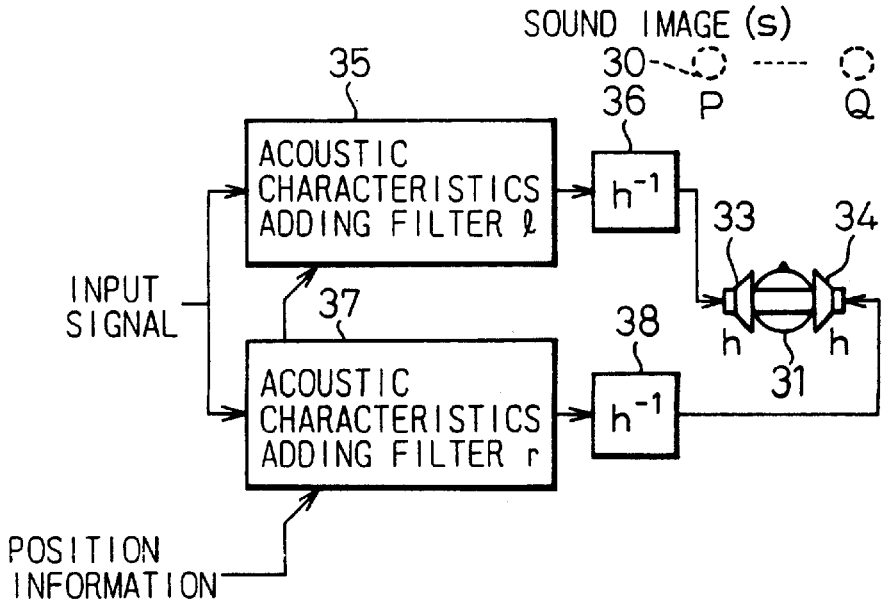
FIG. 7B is a drawing which illustrates sound image localization technology in the past (part 3)

FIG. 7A shows an example of acoustic characteristics adding filters (S→l) 35 and (S→r) 37 between the sound source (S) 30 and the listener 31 and the inverse transfer characteristics ($h^{-1}$) 36 and 38 of the earphones of headphone 33 and 34 for the case of localizing one sound source. FIG. 7B shows the configuration of the acoustic characteristics adding filters 35 and 37 for the case in which the sound source 30 is further localized at a plurality of sound image positions P through Q.

Figure 8A:
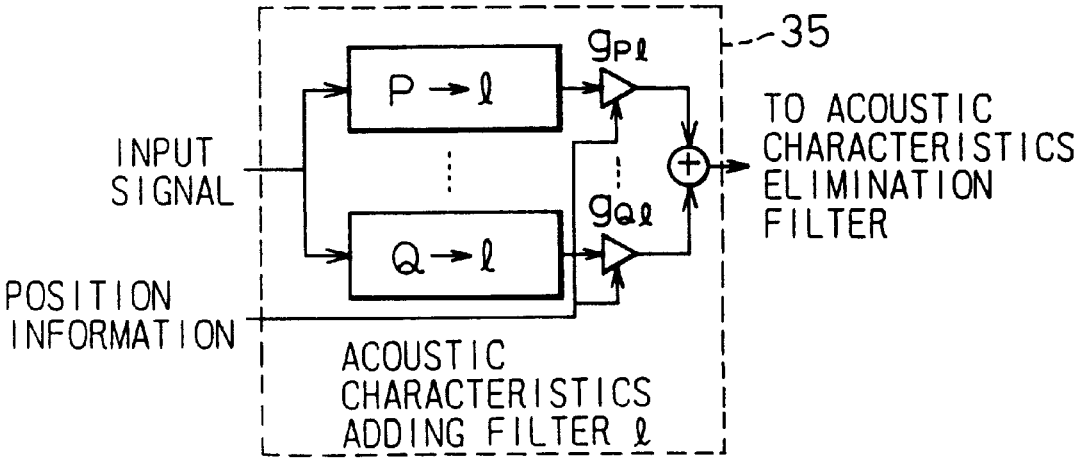
FIG. 8A is a drawing which illustrates sound image localization technology in the past (part 4)
Figure 8B:
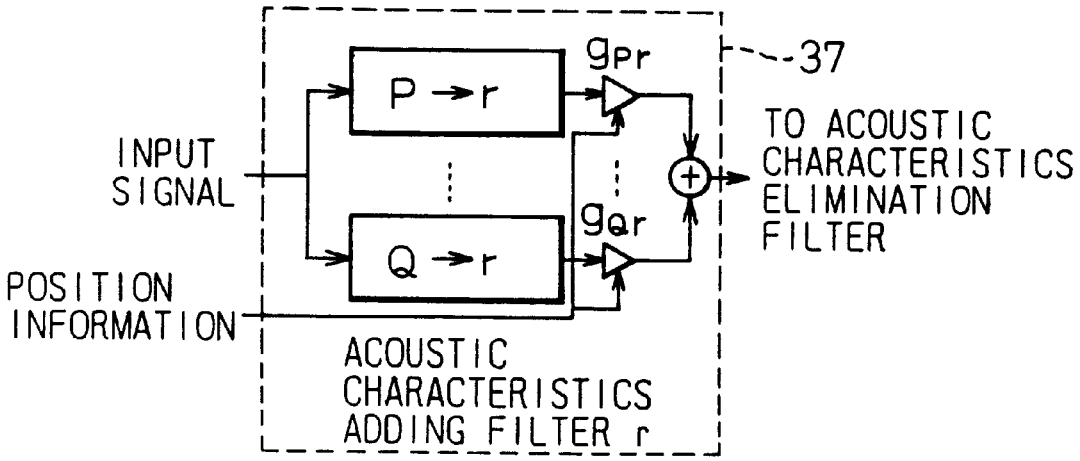
FIG. 8B is a drawing which illustrates sound image localization technology in the past (part 5)

FIG. 8A and FIG. 8B show a specific circuit block diagram of the acoustic characteristics adding filters 35 and 37 of FIG. 7B.

FIG. 8A shows the configuration of the acoustic characteristics adding filter 35 for the left ear of the listener 31, this comprising the filters (P→l), . . . , (Q→) which represent acoustic characteristics of each acoustic space path between the plurality of sound image positions P through Q shown in FIG. 7B, a plurality of amplifiers $g_{Pl}$m . . . , $q_{Ql}$ which control the individual output gain of each of the above-noted filters, and an adder which adds the outputs of each of the above-noted amplifiers.

With exception of the fact that it shows the configuration of acoustic characteristics adding filter 37, which is for the right ear of the listener 31, FIG. 8B is the same as FIG. 8A. The gains of each of the acoustic characteristics adding filters 35 and 37 are controlled in response to the position information provided by one for one of the sound image positions P through Q, thereby localizing the sound image 30 at one of the sound image positions P through Q.

Figure 9A:
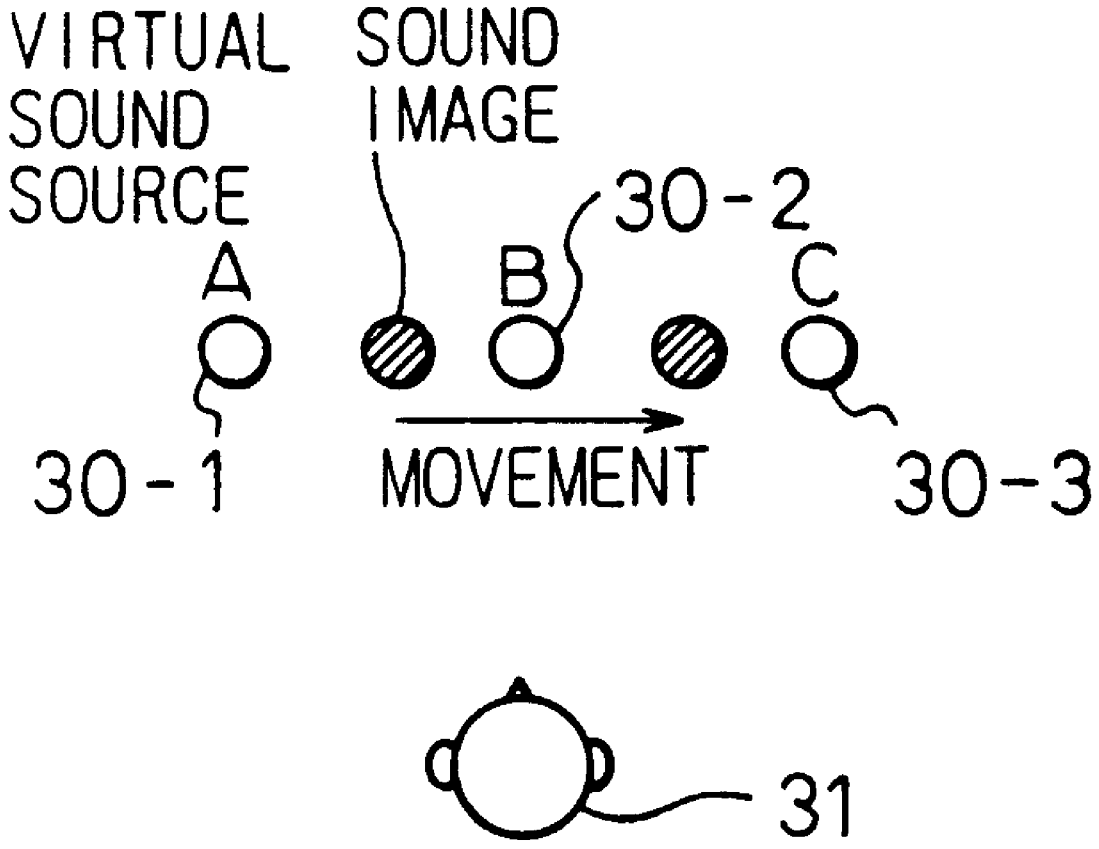
FIG. 9A is a drawing which illustrates sound image localization technology in the past (part 6)
Figure 9B:
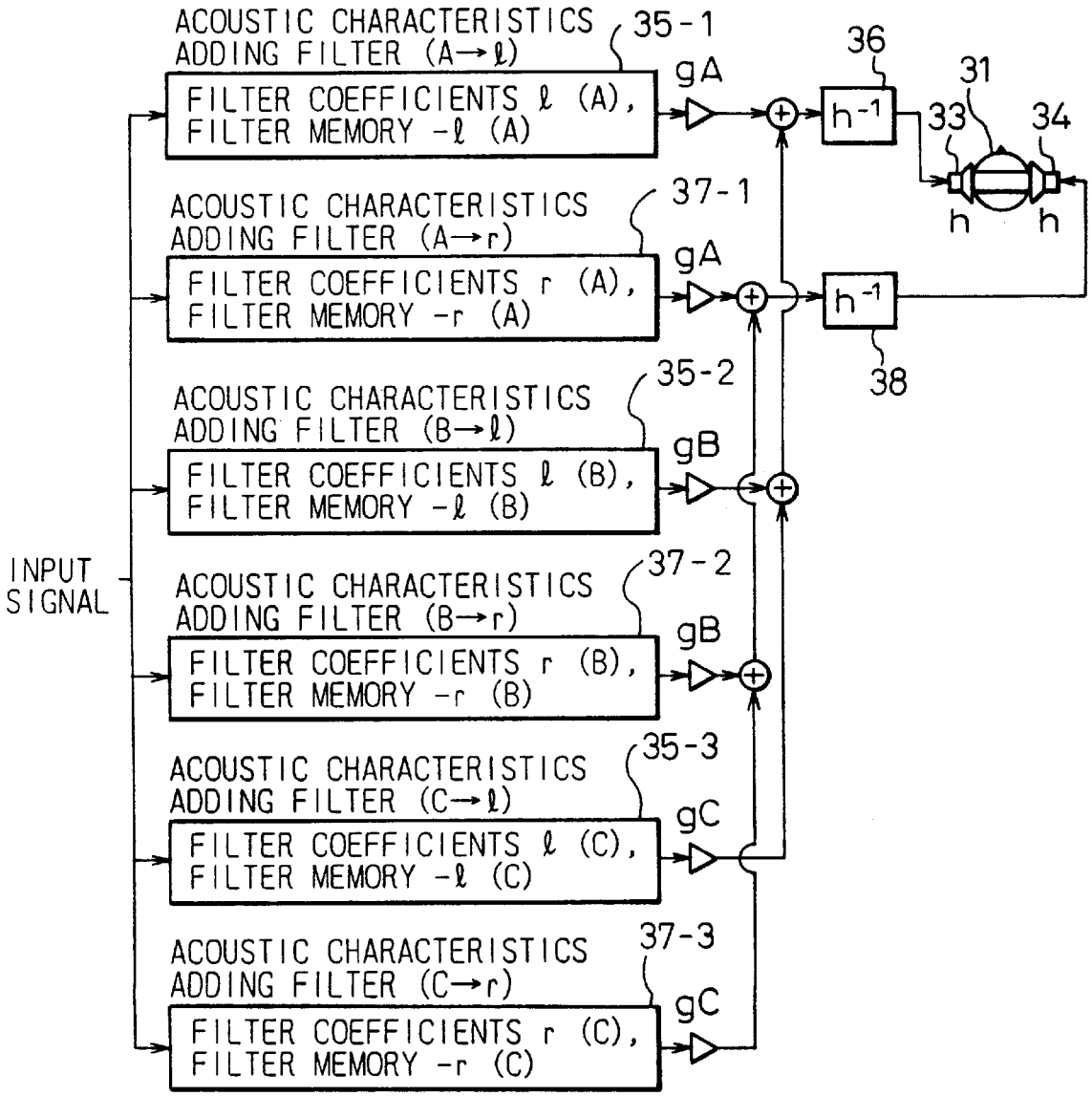
FIG. 9B is a drawing which illustrates sound image localization technology in the past (part 7)

FIG. 9A and FIG. 9B shows an example of moving a sound image by means of output interpolation between a plurality of virtual sound sources.

FIG. 9A shows an example of a circuit configuration for the purpose of localization a sound image among three virtual sound sources (A through C) 30-1 through 30-3. In FIG. 9B, three types of acoustic characteristics adding filters, 35-1 and 37-1, 35-2 and 37-2, and 35-3 and 37-3 are provided in accordance with the transfer characteristics of each of the acoustic space paths leading to the left and right ears of the listener 31, these corresponding to each of the virtual sound sources 30-1, 30-2, and 30-3. Each of these acoustic characteristics adding filters have filter coefficients and a filter memory which holds past input signals, the above-noted filter calculation output results being input to the subsequent stages of variable amplifiers (gA through gC). These amplified outputs are added by adders which correspond to the left and right ears of the listener 31, and become the outputs of the acoustic characteristics adding filters 35 and 37 shown in FIG. 7B. It is possible in this case to perform output interpolation, changing the gain of each of the above-noted variable amplifiers (gA and gB), enabling smooth movement of a sound image between the virtual sound sources 30-1 and 30-3, as shown in FIG. 9A.

Figure 10:
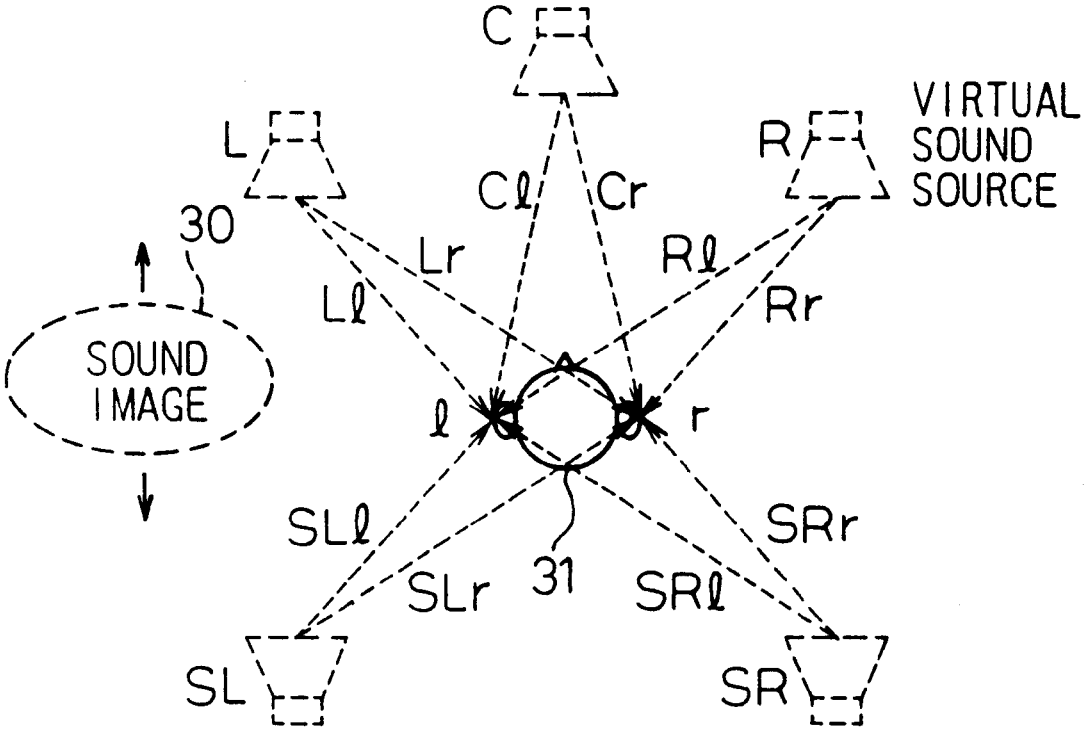
FIG. 10 is a drawing which shows an example of surround-type sound image localization.

FIG. 10 shows an example of a surround-type sound image localization.

In FIG. 10, the example shown is that of a surround system in which five speakers (L, C, R, SR, and SL) surround the listener 31. In this example, the output levels from the five sound sources are controlled in relation to one another, enabling the localization of a sound image in the region surrounding the listener 31. For example, by changing the relative output level from the speakers L and SL shown in FIG. 10, it is possible to localize the sound image therebetween. Thus it can be seen that the above-described type of prior art can be applied as is to this type of sound image localization as well.

However, in the above-described configurations, as described above a variety of problems arise. The present invention, which solves these problems, will be described in detail below.

Figure 11:
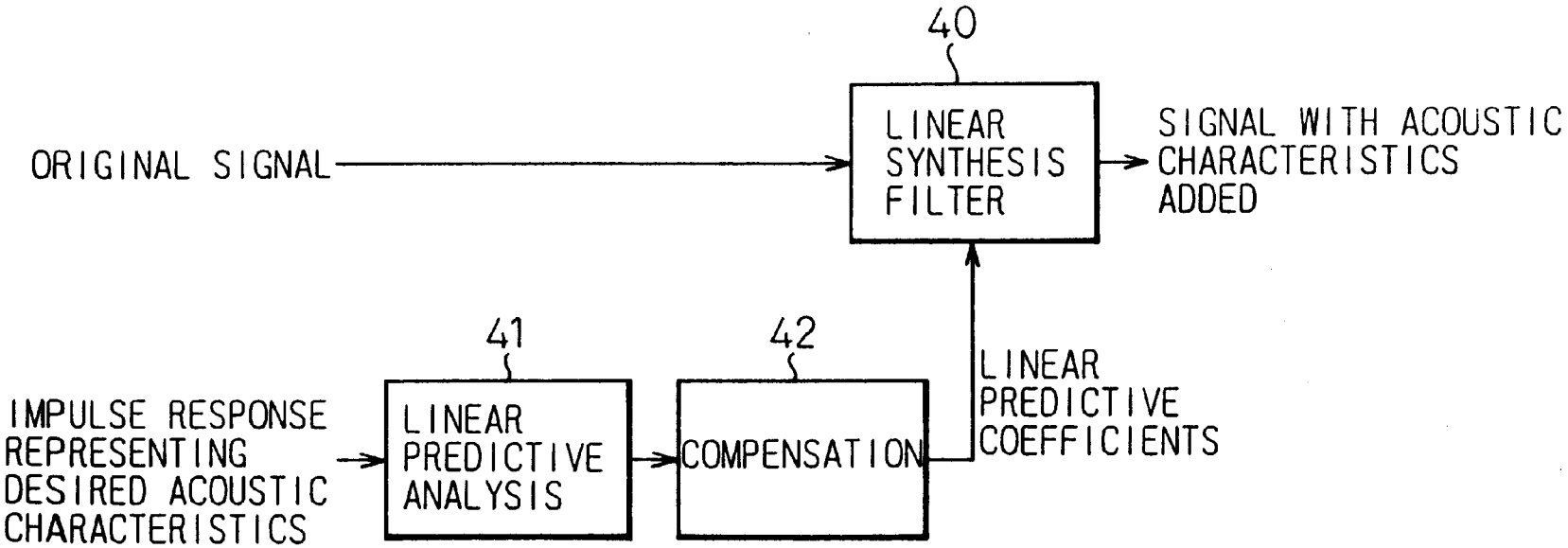
FIG. 11 is a drawing which shows the conceptual configuration for the purpose of determining a linear synthesis filter for adding acoustic characteristics according to the present invention.

FIG. 11 shows the conceptual configuration for the purpose of determining, according to the present invention, a linear synthesis filter for the purpose of adding acoustic characteristics. For this purpose, an anechoic chamber, which is free of reflected sound and residual sound, is used to measure the impulse responses of each of the acoustic space paths which represent the above-noted acoustic characteristics, these being used as the basis for performing linear predictive analysis processing 41 to determine the linear predictive coefficients of the impulse responses. The above-noted linear predictive coefficients are further subjected to compensation processing 42, the resulting coefficients being set as the filter coefficients of a linear synthesis filter 40 which is configured as an IIR filter, according to the present invention. Thus, an original signal which is passed through the above-noted linear synthesis filter 40 has added to it the frequency characteristics of the acoustic characteristics of the above-noted acoustic space path.

Figure 12:
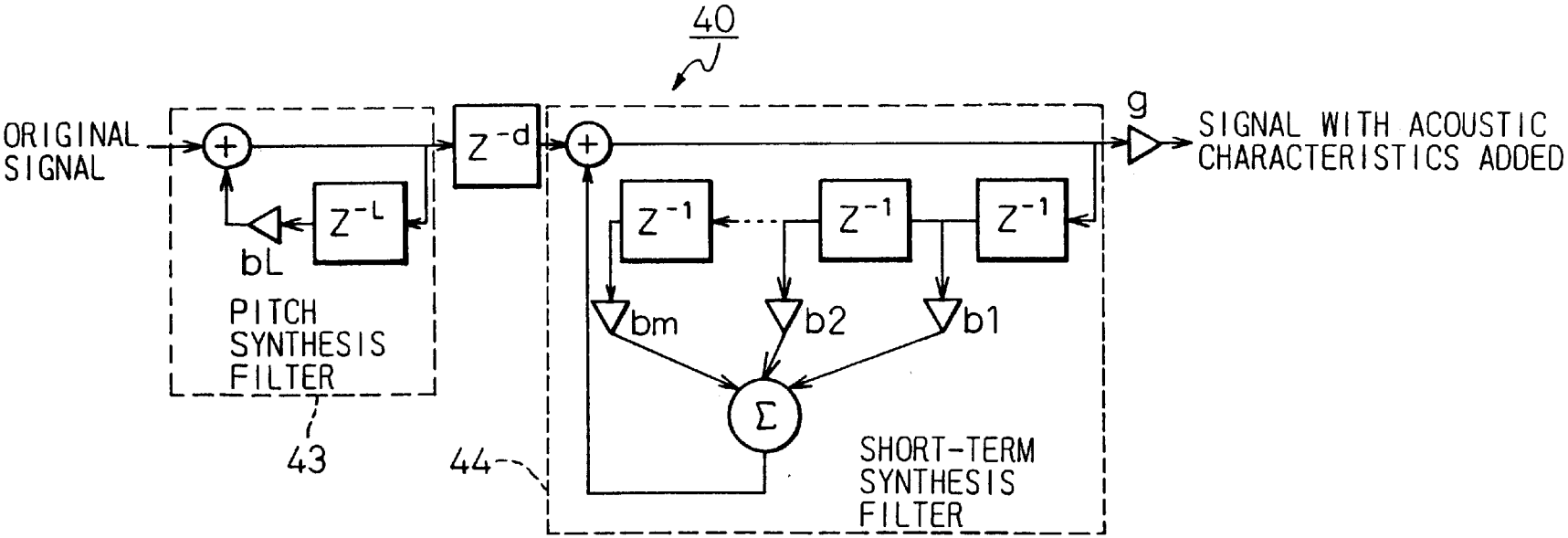
FIG. 12 is a drawing which shows the basic configuration of a linear synthesis filter for adding acoustic characteristics according to the present invention.

FIG. 12 shows an example of the configuration of a linear synthesis filter for the purpose of adding acoustic characteristics according to the present invention.

In FIG. 12, the linear synthesis filter 40 comprises a short-term synthesis filter 44 and a pitch synthesis filter 43, these being represented, respectively, by the following Equation (2) and Equation (3).

$$\frac{Y(Z)}{X(Z)} = \frac{1}{1-(b1Z^{-1}+b2Z^{-2}+\ldots+bmZ^{-m})} \tag{2}$$

-continued $$\frac{Y(Z)}{X(Z)} = \frac{1}{1-(bLZ^{-L})} \tag{3}$$

The short-term synthesis filter 44 (Equation (2)) is configured as an IIR filter having linear predictive coefficients which are obtained from a linear predictive analysis of the impulse response which represents each of the transfer characteristics, this providing a sense of directivity to the listener. The pitch synthesis filter 43 (Equation (3)) further provides the sound source with initial reflected sound and reverberation.

Figure 13:
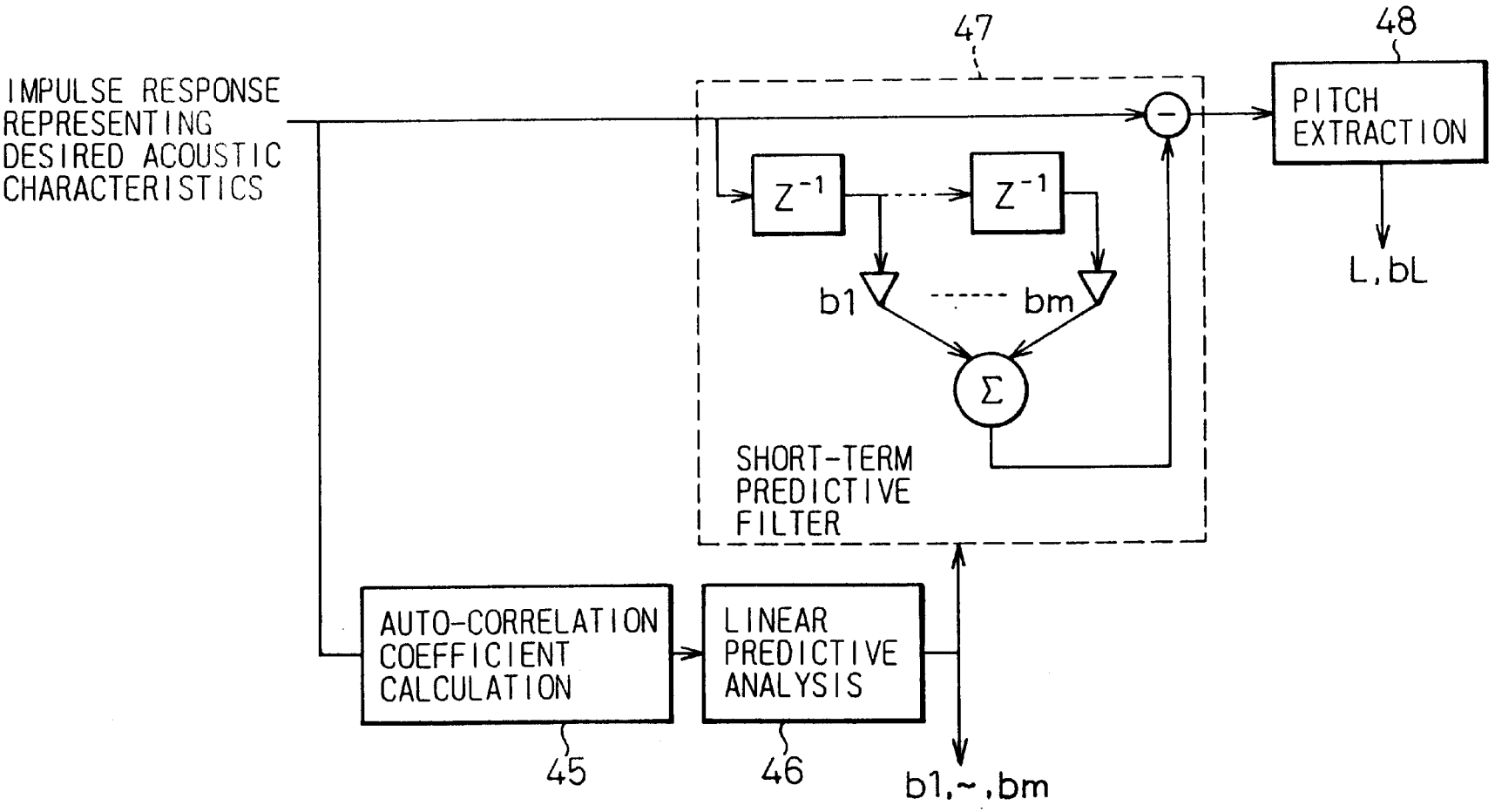
FIG. 13 is a drawing which shows an example of the method of determining linear predictive coefficients and pitch coefficients.

FIG. 13 shows the method of determining the linear predictive coefficients (b1, b2, . . . , bm) of the short-term synthesis filter 44 and the pitch coefficients L and bL of the pitch synthesis filter 43. First, by performing an auto-correlation processing 45 of the impulse response which was measured in an anechoic chamber, the auto-correlation coefficients are determined, after which the linear predictive analysis processing 46 is performed. The linear predictive coefficients (b1, b2, . . . , bm) which result from the above-noted processing are used to configure the short-term synthesis filter 44 (IIR filter) of FIG. 12. By configuring an IIR filter using linear predictive coefficients, it is possible to add the frequency characteristics, which are transfer characteristics, using a number of filter taps which is much reduced from the number of samples of the impulse response. For example, in the case of 256 taps, it is possible to reduce the number of taps to approximately 10.

The other transfer characteristics, which are the delays, which represent the difference in time in reaching each ear of the listener via each of the paths, and the gains are added as the delay $Z^{-d}$ and the gain g which are shown in FIG. 12. In FIG. 13 the linear predictive coefficients (b1, b2, . . . , bm) which are determined by linear predictive analysis processing 46 are used as the coefficients of the short-term prediction filter 47 (FIR filter), which is represented below by Equation (4).

$$\frac{Y(Z)}{X(Z)} = 1-(b1Z^{-1}+b2Z^{-2}+\ldots+bmZ^{-m}) \tag{4}$$

As can be seen from Equation (2) and Equation (4), by passing through the above-noted short-term predictive filter 47, it is possible to eliminate the frequency characteristics component that is equivalent to that added by the short-term synthesis filter 44. As a result, it is possible, by the pitch extraction processing 48 performed at the next stage, to determine the above-noted delay ($Z^{-L}$) and gain (bL) from the remaining time component.

From the above, it can be seen that it is possible to represent the acoustic characteristics having particular frequency characteristics and time characteristics using the circuit configuration shown in FIG. 12.

Figure 14:
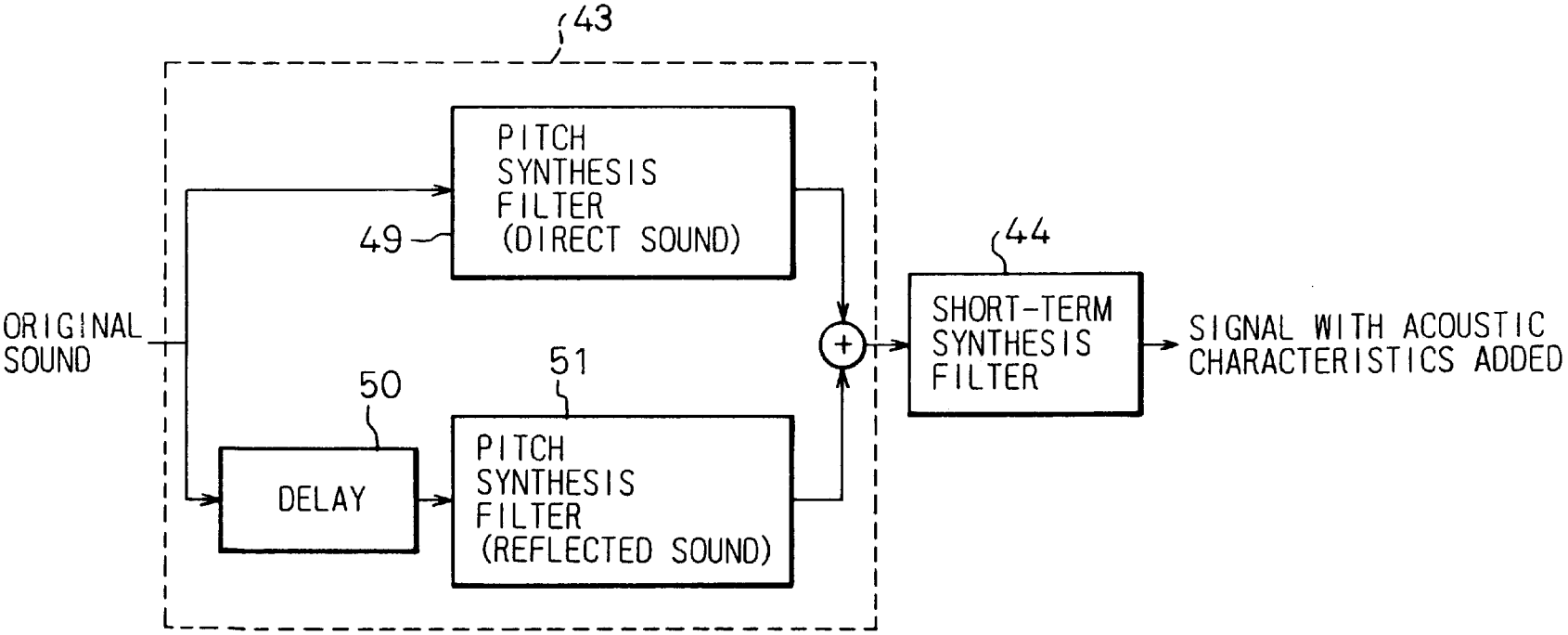
FIG. 14 is a drawing which shows an example of the configuration of a pitch synthesis filter.

FIG. 14 shows the block diagram configuration of the pitch synthesis filter 43, in which separate pitch synthesis filters are used for so-called direct sound and reflected sound. The impulse response which is obtained by measuring a sound field generally starts with a part that has a large attenuation factor (direct sound), this being followed by a part that has a small attenuation factor (reflected sound). For this reason, the pitch synthesis filter 43 can be configured, as shown in FIG. 14, by a pitch synthesis filter 49 related to the direct sound, a pitch synthesis filter 51 related to the reflected sound, and a delay section 50 which provides the delay time therebetween. It is also possible to configure the direct sound part using an FIR filter and to make the configuration so that there is overlap between the direct sound and reflected sound parts.

Figure 15:
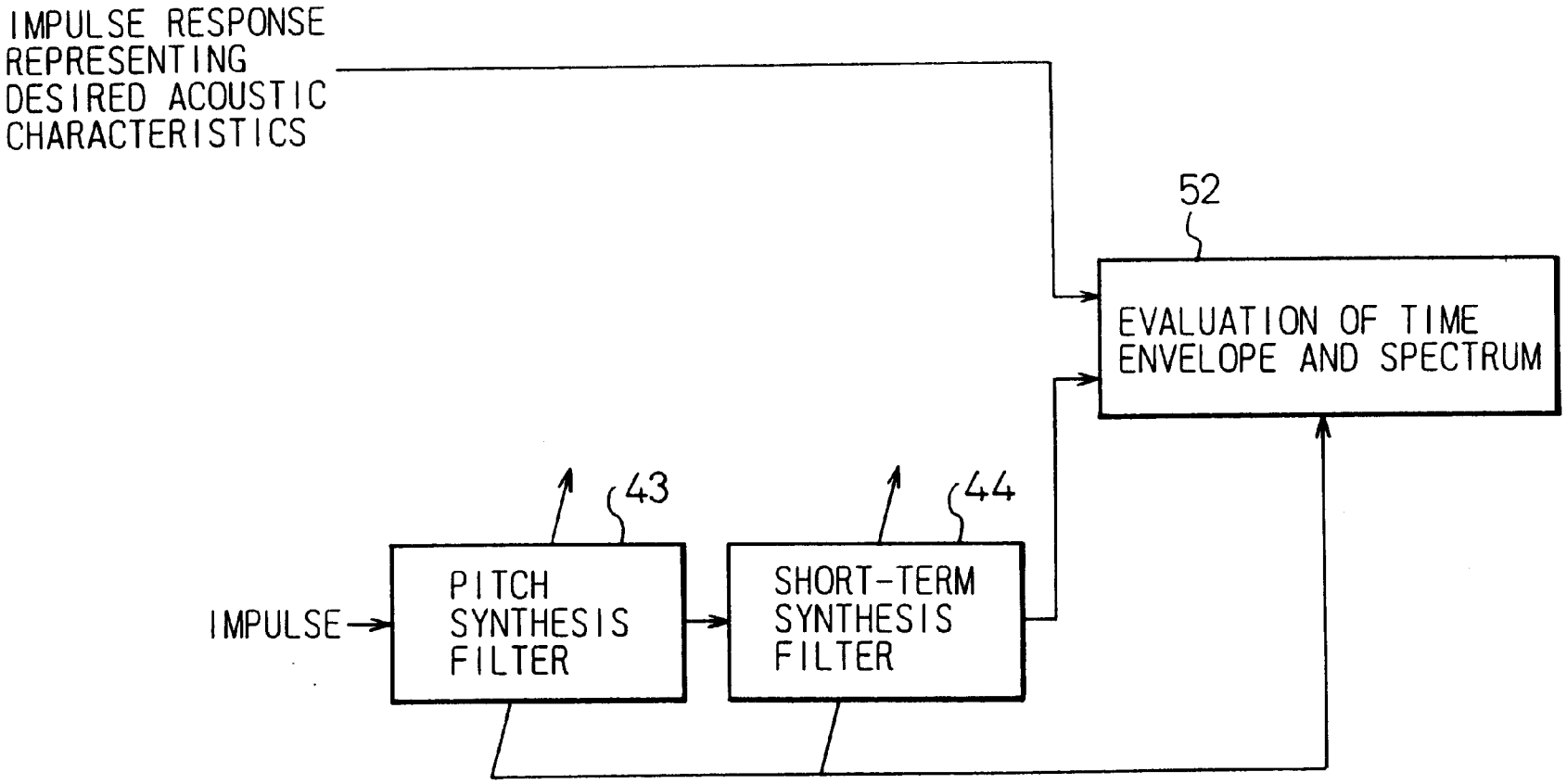
FIG. 15 is a drawing which shows an example of compensation processing for a linear predictive filter.

FIG. 15 shows an example of compensation processing on the linear predictive coefficients obtained as described above. In the evaluation processing 52 of time-domain envelope and spectrum of FIG. 15, a comparison is performed between the series linking of the first obtained short-term synthesis filter 44 and the pitch synthesis filter 43 and the impulse response having the desired acoustic characteristics, the filter coefficients being compensated based on this, so that the time-domain envelope and spectrum of the linear synthesis filter impulse response are the same as or close to the original impulse response.

Figure 16:
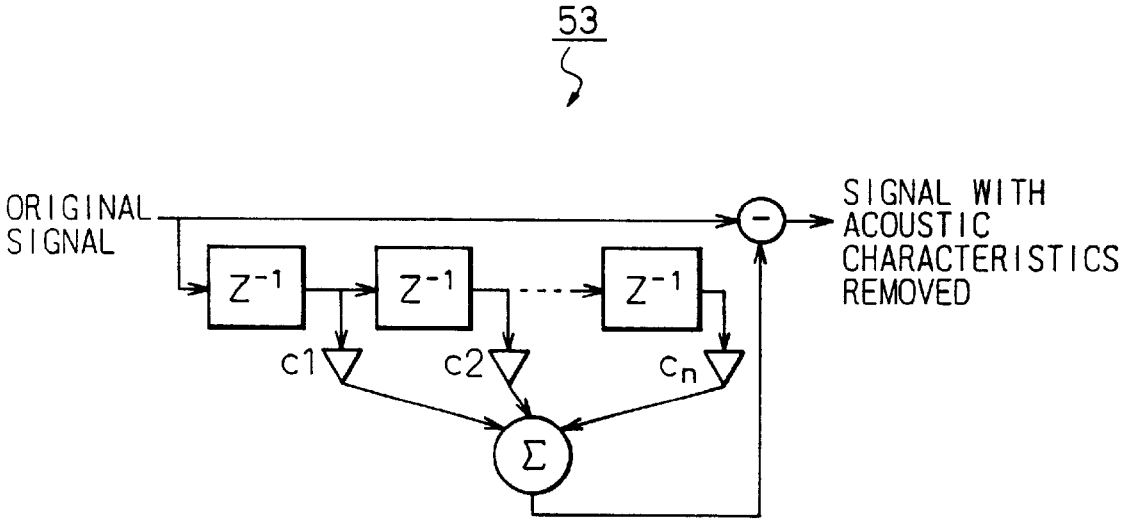
FIG. 16 is a drawing which shows an example of an FIR filter as in implementation of the inverse of transfer characteristics, using linear predictive coefficients.

FIG. 16 shows an example of the configuration of a filter which represents the inverse characteristics $Hl^{-1}$ and $Hr^{-1}$ of the transfer characteristics of the headphone, according to the present invention. The filter 53 in FIG. 16 has the same configuration as the short-term prediction filter 47 which is shown in FIG. 13, this performing linear predictive analysis in determining the auto-correlation coefficients of the impulse response of the headphone, the thus-obtained linear predictive coefficients (c1, c2, . . . , cm) being used to configure an FIR-type linear predictive filter. By doing this, it is possible to eliminate the frequency characteristics of the headphone using a filter having a number of taps less than 1/10 of that of the impulse response of the inverse characteristic of the past, shown in FIG. 3. Furthermore, by assuming symmetry between the characteristics of the two ears of the listener, there is no need to consider the time difference and level difference therebetween.

Figure 17:
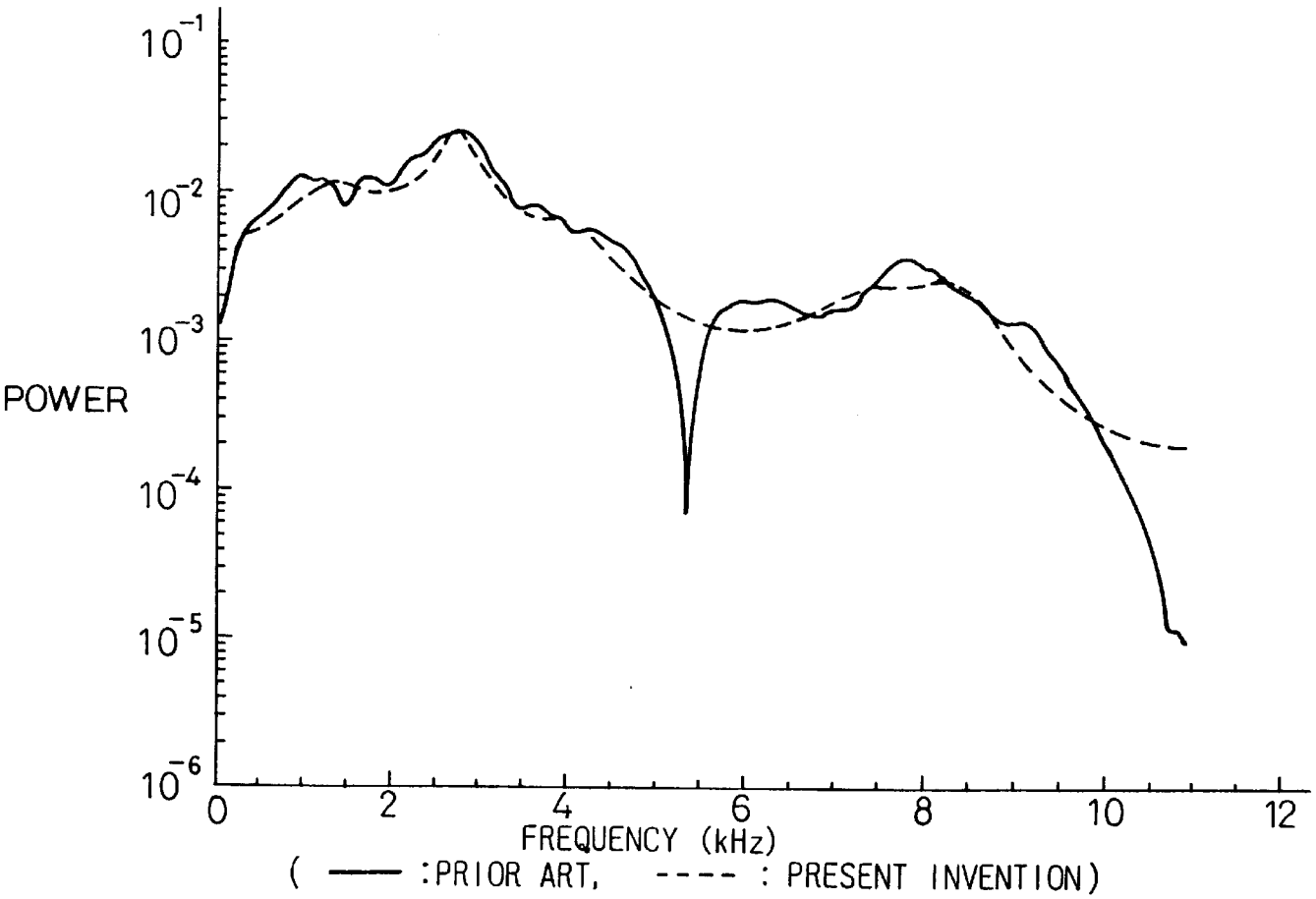
FIG. 17 is a drawing which shows an example of the frequency characteristics of an acoustic characteristics adding filter according to the present invention.

FIG. 17 shows an example of the frequency characteristics of acoustic characteristics adding filter according to the present invention, in comparison with the prior art. In FIG. 17, the solid line represents the frequency characteristics of a prior art acoustic characteristics adding filter made up of 256 taps as shown in FIG. 3, while the broken line represents the frequency characteristics of an acoustic characteristics adding filter (using only a short-term synthesis filter) having 10 taps, according to the present invention. It can be seen that according to the present invention, it is possible to obtain a spectral approximation with a number of taps greatly reduced from the number in the past.

Figure 18A:
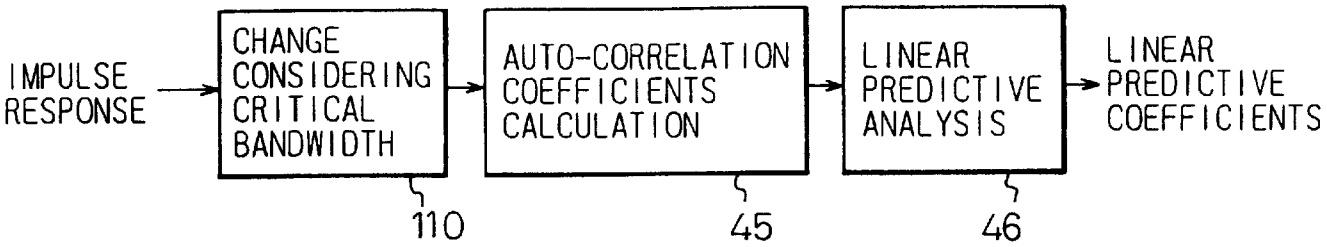
FIG. 18A is a drawing which shows the basic principle of determining the linear predictive coefficients for adding acoustic characteristics according to the present invention (part 1)
Figure 18B:
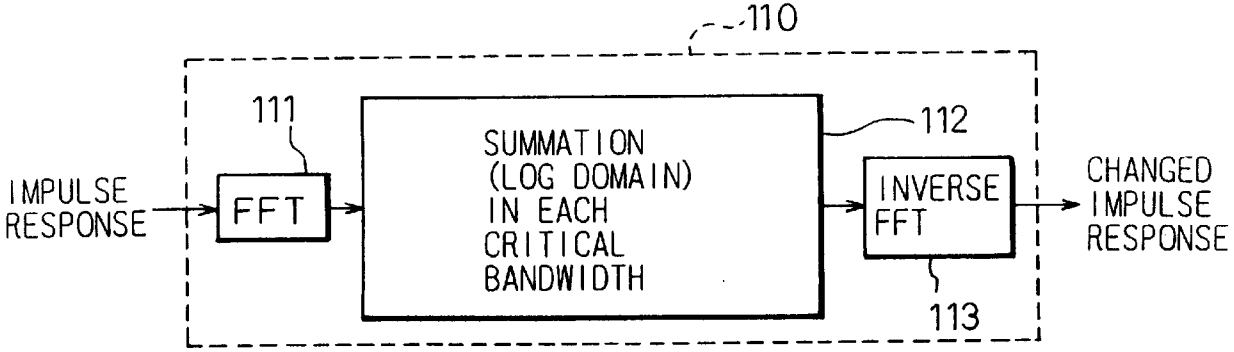
FIG. 18B is a drawing which shows the basic principle of determining the linear predictive coefficients for adding acoustic characteristics according to the present invention (part 2)
Figure 18C:
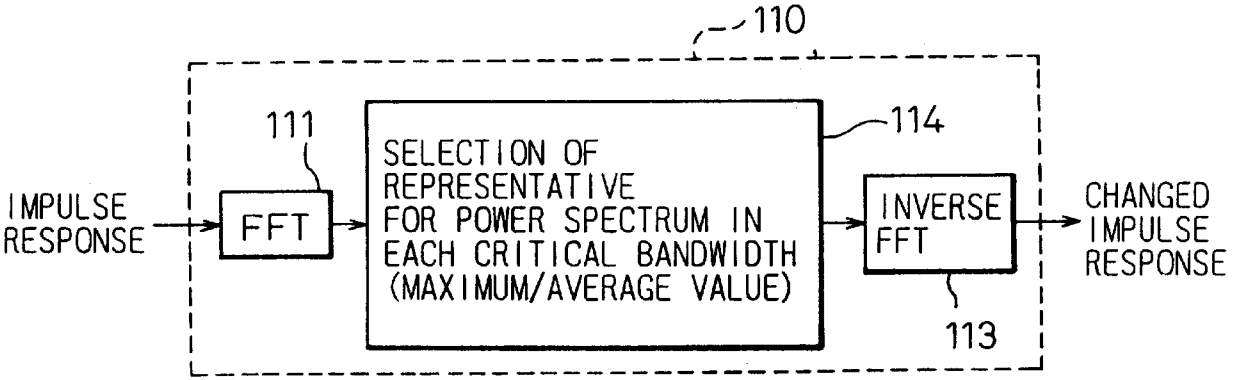
FIG. 18C is a drawing which shows the basic principle of determining the linear predictive coefficients for adding acoustic characteristics according to the present invention (part 3)

FIGS. 18A through 18C show the conceptual configuration for determining the linear predictive coefficients in a further improvement of the above-noted present invention. FIG. 18A shows the most basic processing block diagram. The impulse response is first input to a critical bandwidth pre-processor which considers the critical bandwidth according to the present invention. The auto-correlation calculation section 45 and linear predictive analysis section 46 of this example are the same as, for example, that shown in FIG. 13.

The "critical bandwidth" as defined by Fletcher is the bandwidth of a bandpass filter having a center frequency that varies continuously, such that when frequency analysis is performed using a bandpass filter having a center frequency closest to a signal sound, the influence of noise components in masking the signal sound is limited to frequency components within the passband of the filter. The above-noted bandpass filter is also known as an "auditory" filter, and a variety of measurements have verified that, between the center frequency and the bandwidth, the critical bandwidth is narrow when the center frequency of the filter is low and wide when the center frequency is high. For example, at a center frequency of below 500 kHz, the critical bandwidth is virtually constant at 100 Hz.

The relationship between the center frequency f and the critical bandwidth is represented by the Bark scale in the form of an equation. This Bark scale is given by the following equation.

$$\text{Bark}=13\arctan(0.76f)+3.5\arctan((f/5.5)^2)$$

In the above relationship, because 1.0 on the Bark scale corresponds to the above-noted critical bandwidth, combined with the above-noted definition of the critical bandwidth, a band-limited signal divided at the Bark scale point 1.0 represents a signal sound which can be perceived audibly.

Figure 19:
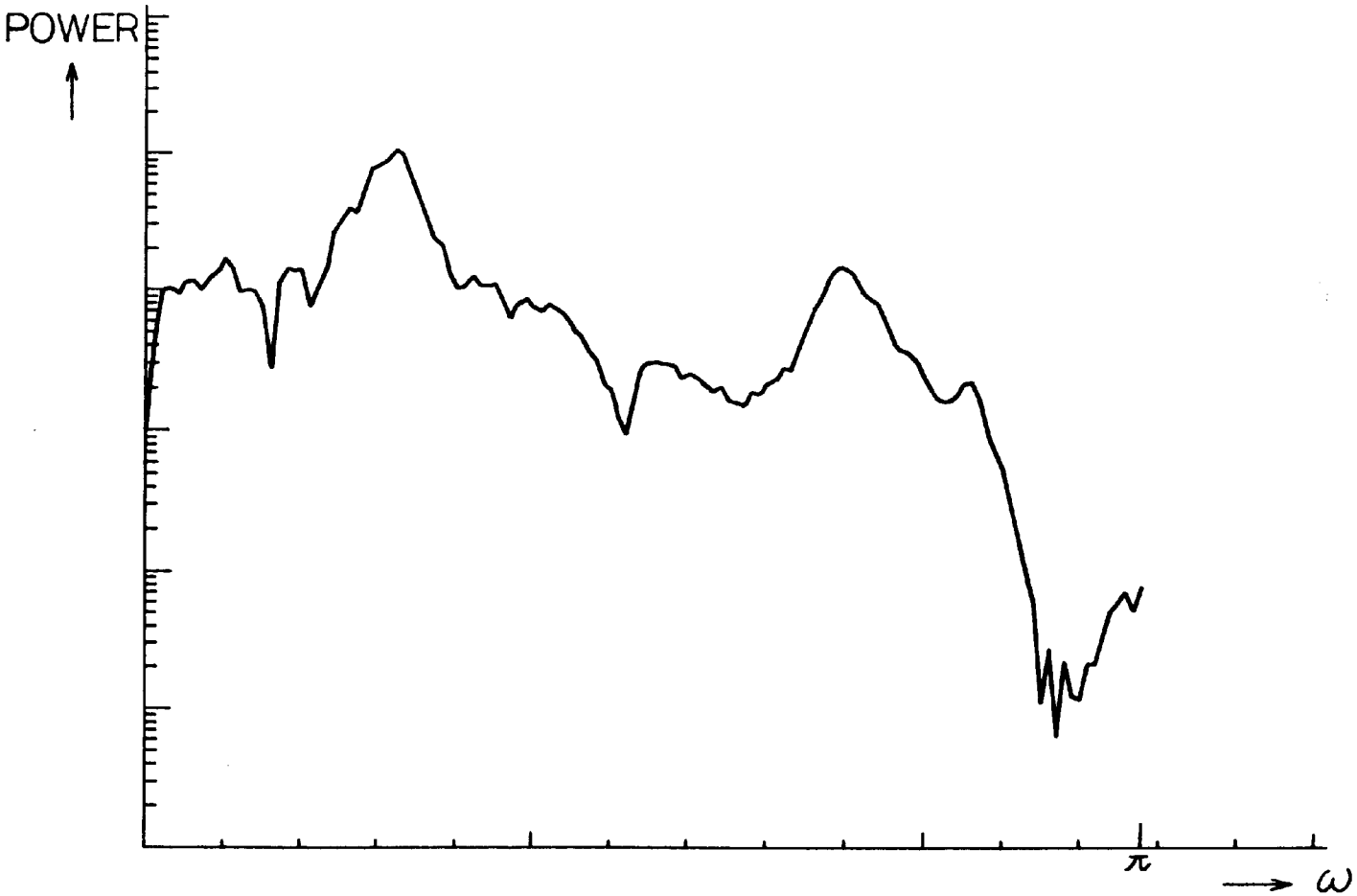
FIG. 19 is a drawing which shows an example of the power spectrum of the impulse response of an acoustic space path.

FIG. 18B and FIG. 18C show examples of the internal block diagram configuration of the critical bandwidth preprocessor 110 of FIG. 18A. An embodiment of the critical bandwidth processing of FIGS. 19 through 23 will now be described. In FIG. 18B and FIG. 18C, the impulse response signal has a fast Fourier transform applied to it by the FFT processor 111, thereby converting it from the time domain to the frequency domain. FIG. 19 shows an example of the power spectrum of an impulse response of an acoustic space path, as measured in an anechoic chamber, from a sound source localized at an angle of 45 degrees to the left-front of a listener to the left ear of the listener.

Figure 20:
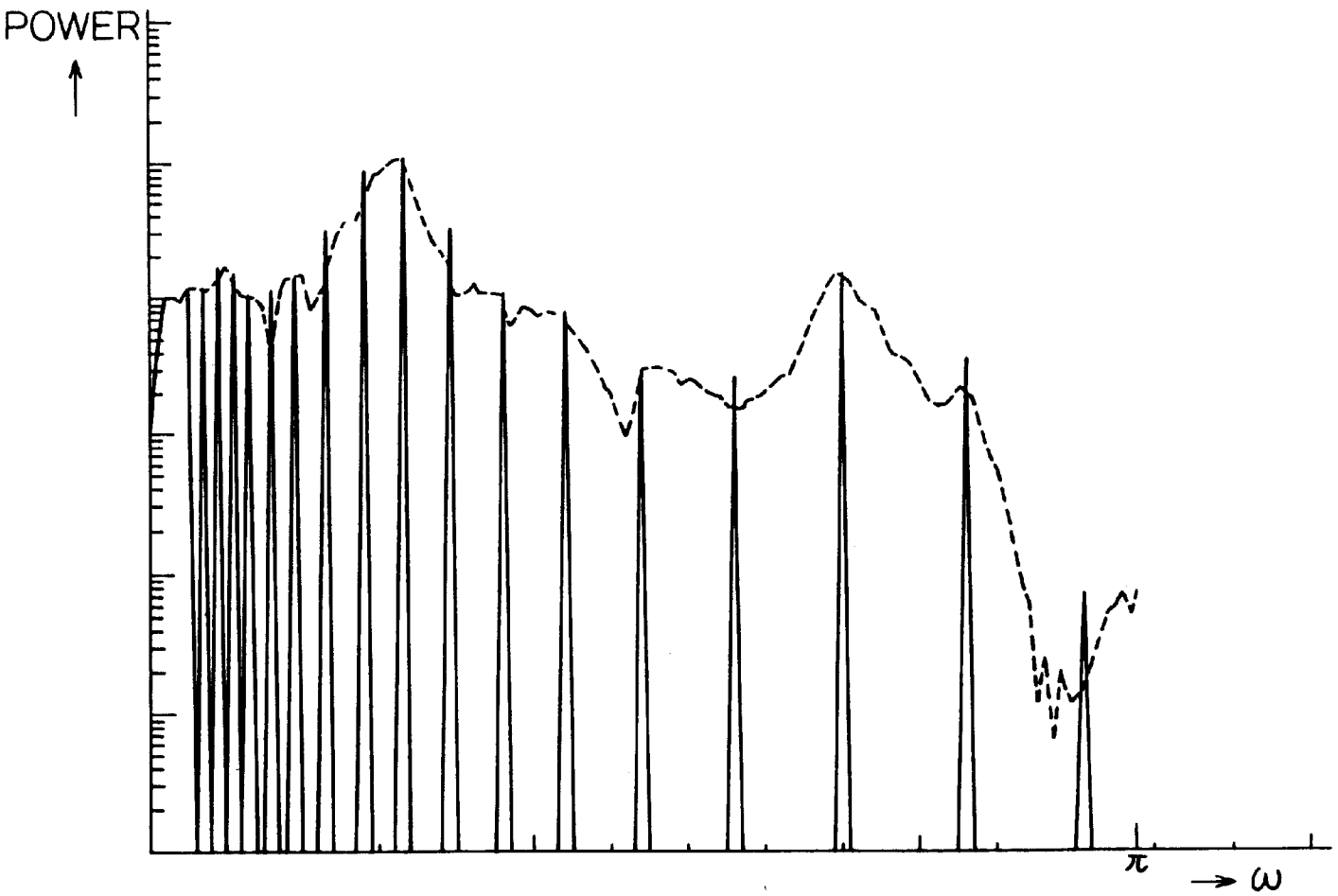
FIG. 20 is a drawing which shows an example in which the power spectrum which is shown in FIG. 19 is divided into critical bands, with the power spectrum thereof represented by the corresponding power spectrum maximum value.

The above-noted band-limited signal is divided into a plurality of bands having a Bark scale value of 1.0, by the following stages, the critical bandwidth processing sections 112 and 114. In the case of FIG. 18B, the power spectra within each critical bandwidth are summed, this summed value being used to represent the signal sound of the band-limited signal. In the case of FIG. 18C, the average value of the power spectra is used to represent the signal sound of the band-limited signal. FIG. 20 shows the example of dividing the power spectrum of FIG. 19 into critical bandwidths and determining the maximum value of the power spectrum of each band shown in FIG. 18C.

Figure 21:
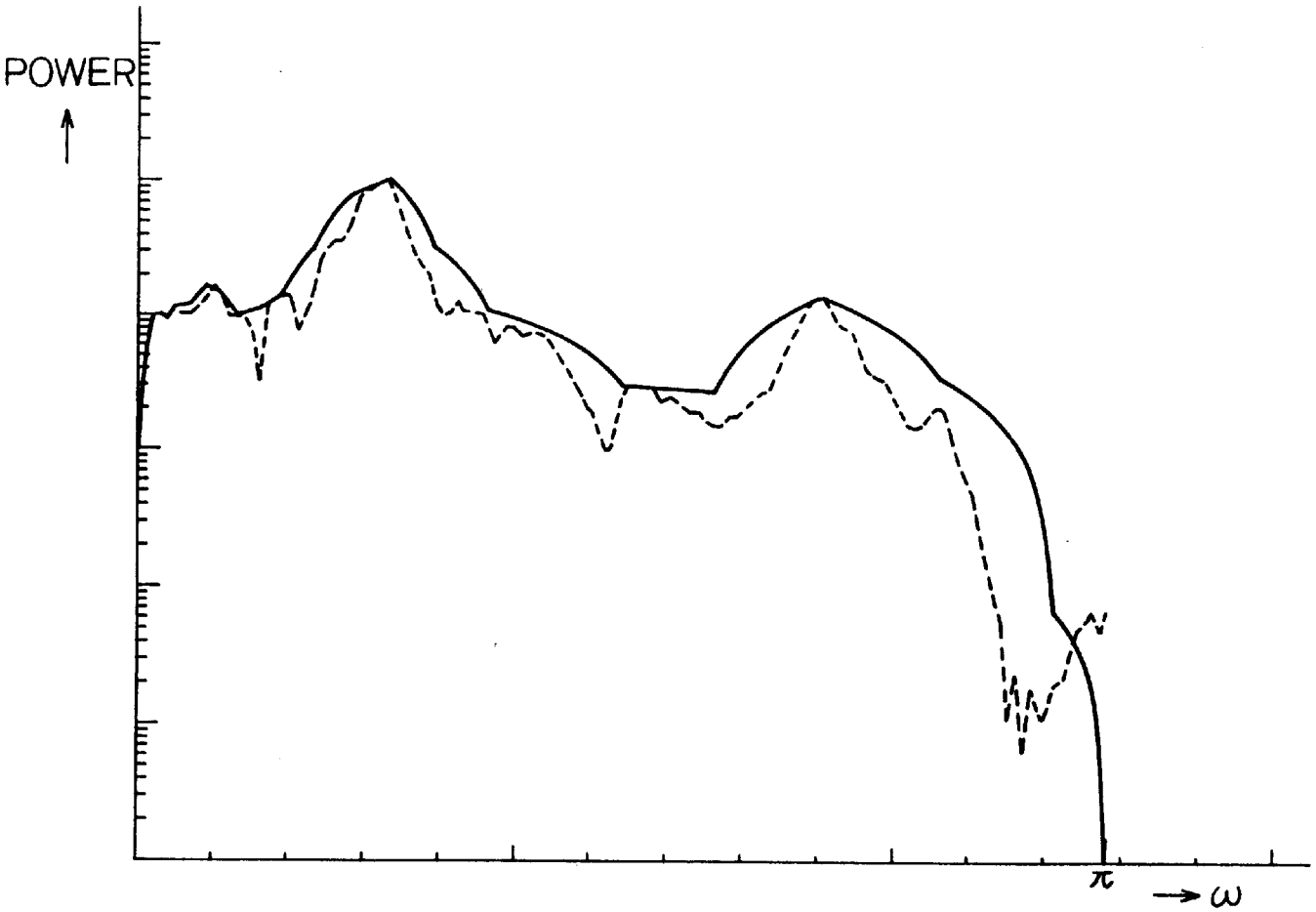
FIG. 21 is a drawing which shows an example in which a smooth power spectrum is obtained by performing output interpolation of the power spectrum which is shown in FIG. 20.

At the critical bandwidth processing sections 112 and 114, output interpolation processing is performed, which applies smoothing between the summed power spectrum values and maximum or averaged values determined for each of the above-noted critical bandwidths. This interpolation is performed by means of either linear interpolation or a high-order Taylor series. FIG. 21 shows an example of output interpolation of the power spectrum, whereby the power spectrum is smoothed.

Finally, a power spectrum which is smooth as described above is subjected to an inverse Fourier transform by the Inverse FFT processor 113, thereby restoring the frequency-domain signal to the time domain. In doing this, the phase spectrum used is the original impulse response phase spectrum without any change. The above-noted reproduced impulse response signal is further processed as described previously.

In this manner, according to the present invention, the characteristic part of a signal sound is extracted using critical bandwidths, without causing a changed in the auditory perception, these being smoothed by means of interpolation, after which the result is reproduced as an approximation of the impulse response. By doing this, in the case of approximating frequency characteristics using a particular low-order linear prediction such as in the present invention, it is possible to achieve a great improvement in accuracy of approximation, in comparison with the case of a direct frequency characteristics approximation from an original complex impulse response.

Figure 22:
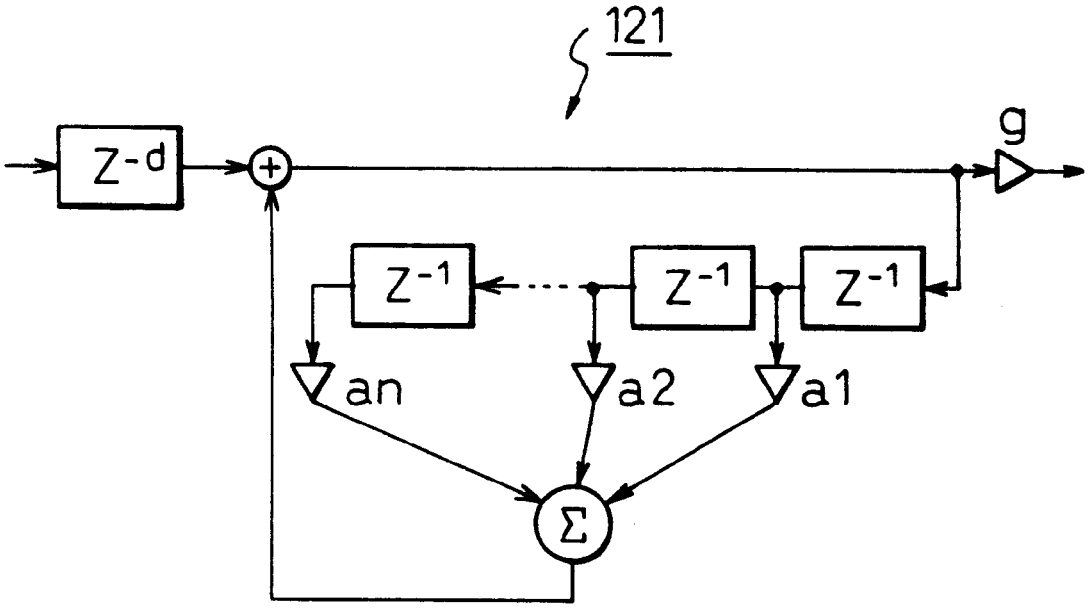
FIG. 22 is a drawing which shows an example of the configuration of a synthesis filter which uses linear predictive coefficients.
Figure 23:
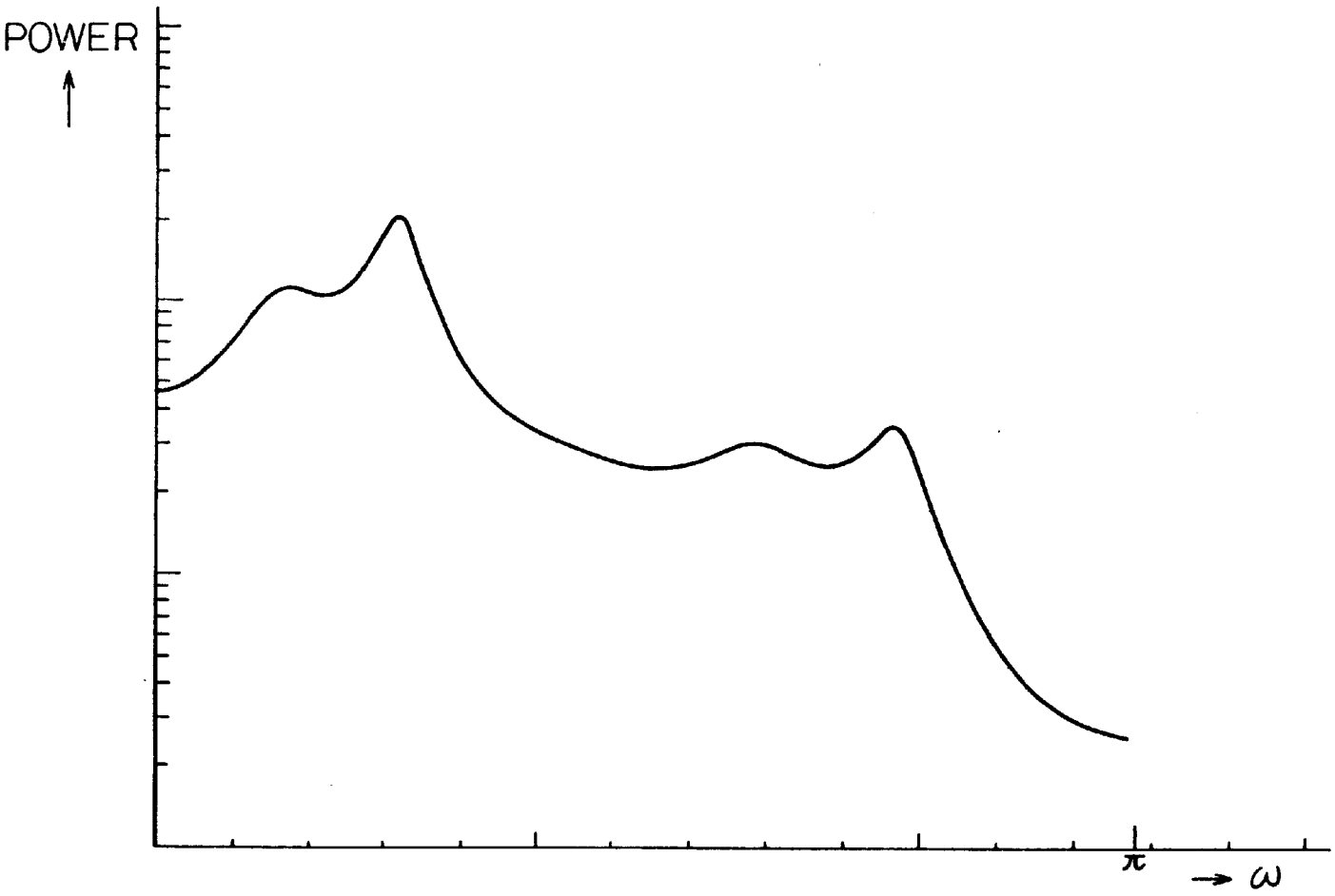
FIG. 23 is a drawing which shows an example of the power spectrum of a 10th order synthesis filter which uses linear predictive coefficients according to the present invention.

FIG. 22 shows an example of the circuit configuration of a synthesis filter (IIR) 121 which uses the linear predictive coefficients (an, . . . , a2, a1) which are obtained from the processing shown in FIG. 18A. FIG. 23 shows an example of a power spectrum determined from the impulse response after approximation using a 10th order synthesis filter which uses the linear predictive coefficients of FIG. 22. From this, it can be seen that there is an improvement in the accuracy of approximation in the peak part of the power spectrum.

Figure 24:
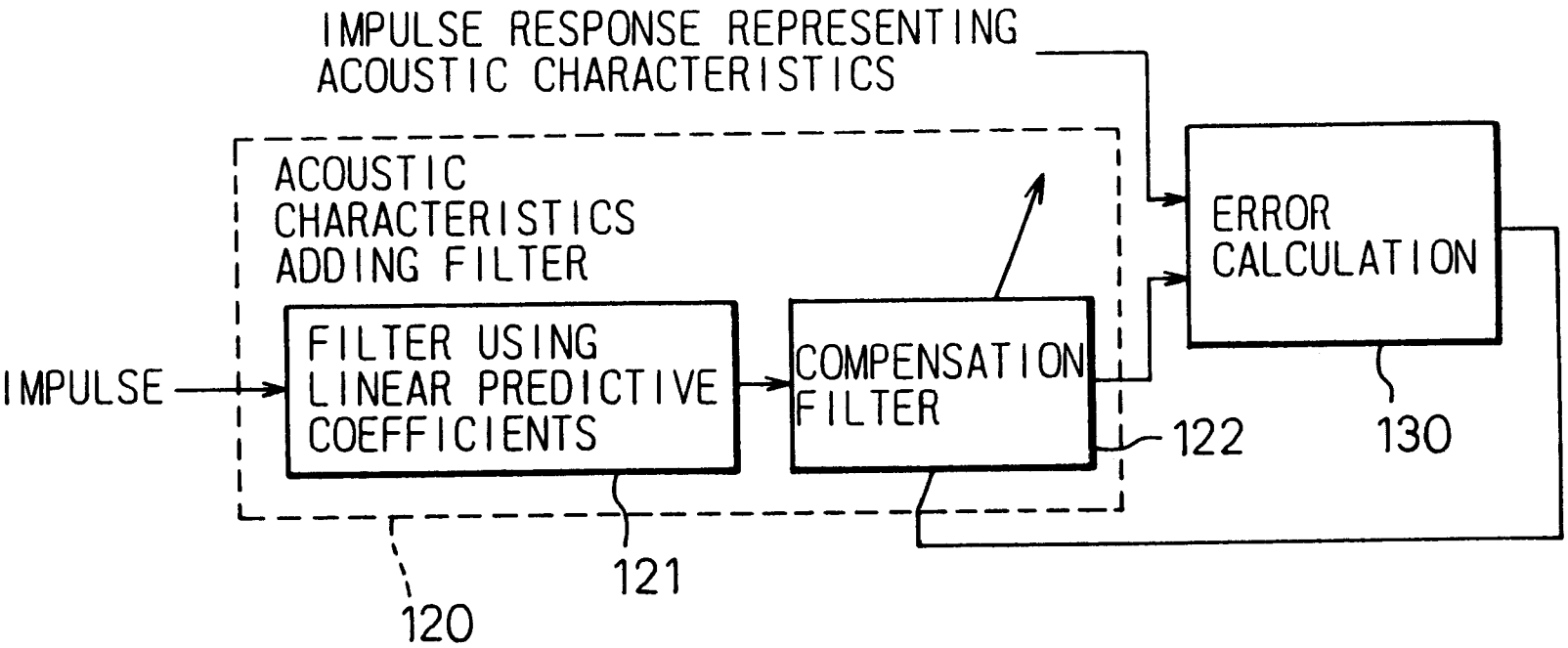
FIG. 24 is a drawing which shows an example of the configuration of compensation processing of a synthesis filter which uses linear predictive coefficients according to the present invention.
Figure 25:
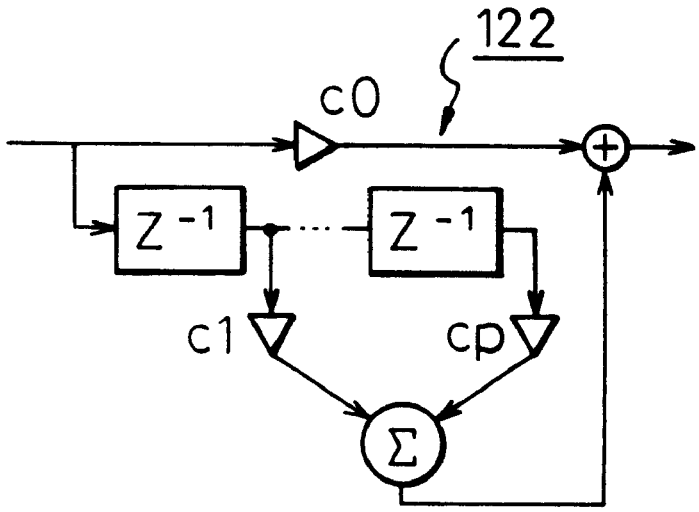
FIG. 25 is a drawing which shows an example of a compensation filter.
Figure 26:
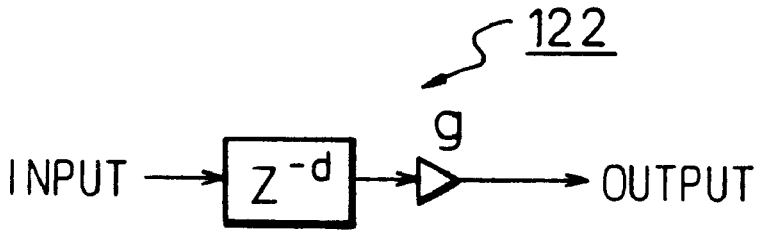
FIG. 26 is a drawing which shows an example of a delay/amplification circuit.

FIG. 24 shows an example of the processing configuration for compensation of the synthesis filter 121 which uses the linear predictive coefficients shown in FIG. 22. In FIG. 24, in addition to synthesis filter 121 using the above-noted linear predictive coefficients, a compensation filter 122 is connected in series therewith to form the acoustic characteristics adding filter 120. FIG. 25 and FIG. 26 show, respectively, examples of each of these filters. FIG. 25 shows the example of a compensation filter (FIR) for the purpose of approximating the valley part of the frequency band, and FIG. 26 shows the example of a delay/amplification circuit for the purpose of compensating for the difference in delay times and level between the two ears.

In FIG. 24, an impulse response signal representing actual acoustic characteristics is applied to one input of the error calculator 130, the impulse signal being applied to the input of the above-noted acoustic characteristics adding filter 120. Because of the input of the above-noted impulse signal, the time-domain acoustic characteristics adding characteristic signal is output from the acoustic characteristics adding filter 120. This output signal is applied to the other input of the error calculator 130, and a comparison is made with this input and the above-noted impulse response signal which represents actual acoustic characteristics. The compensation filter 122 is then adjusted so as to minimize the error component. An example of using an n-th order FIR filter 122 is shown in FIG. 25, with compensation being performed of the time-domain impulse response waveform from the synthesis filter 121. In this case, the filter coefficients c0, c1, . . . , cp are determined as follows. If the synthesis filter impulse response is x and the original impulse response is y, the following equation obtains. In this equation, q≧p.

$$\begin{vmatrix} x(0) & 0 & \dots & 0 \\ x(1) & x0 & \dots & 0 \\ \vdots & \vdots & & \vdots \\ x(p) & x(p-1) & \dots & x(0) \\ \vdots & \vdots & & \vdots \\ x(q) & x(q-1) & \dots & x(q-p) \end{vmatrix} = \begin{vmatrix} c0 \\ c1 \\ \vdots \\ cp \end{vmatrix} = \begin{vmatrix} y(0) \\ y(1) \\ \\ y(p) \\ \\ y(q) \end{vmatrix}$$

If we let the matrix on the left side of the above equation (having elements x(0), . . . , x(q)) be X, let the vector of elements c0 through cp be C, and let the vector on the right side of the equation be Y, the filter coefficients c0, c1, . . . , cp can be determined.

$$Xc=Y$$

$$X^TXc=X^TY$$

$$c=(X^TX)^{-1}X^TY$$

There is also a method of determining them by the steepest descent method.

Figure 27:
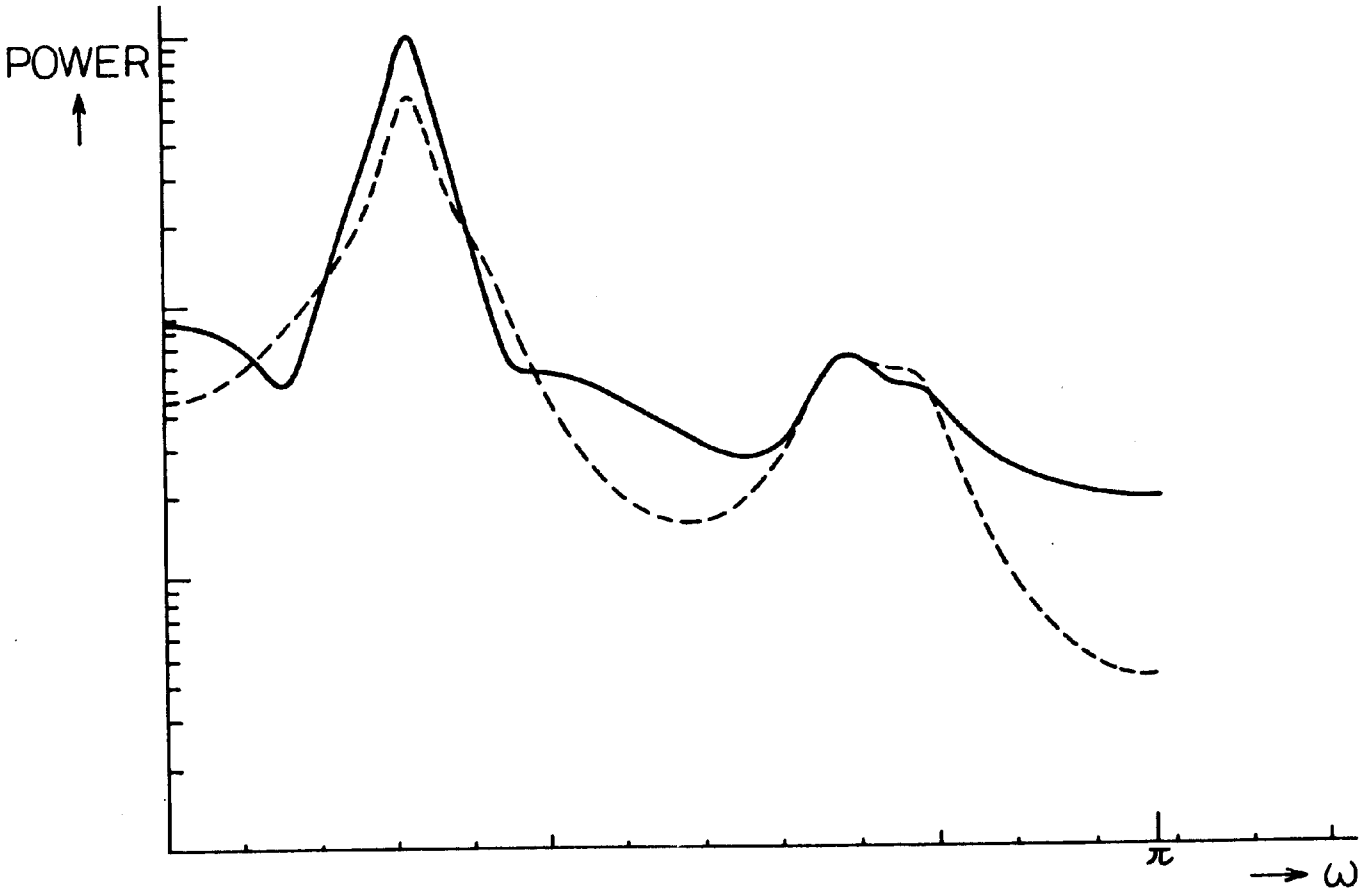
FIG. 27 is a drawing which shows an example of performing compensation of frequency characteristics by means of a compensation filter.

FIG. 27 shows an example of using the above-noted compensation filter 122 to change the frequency characteristics of the synthesis filter 121 which uses the linear predictive coefficients. The broken line in FIG. 27 represents an example of the frequency characteristics of the synthesis filter 121 before compensation, and the solid line in FIG. 27 represents an example of changing these frequency characteristics by using the compensation filter 122. It can be seen from this example that the compensation has the effect of making the valley parts of the frequency characteristics prominent.

Figure 28:
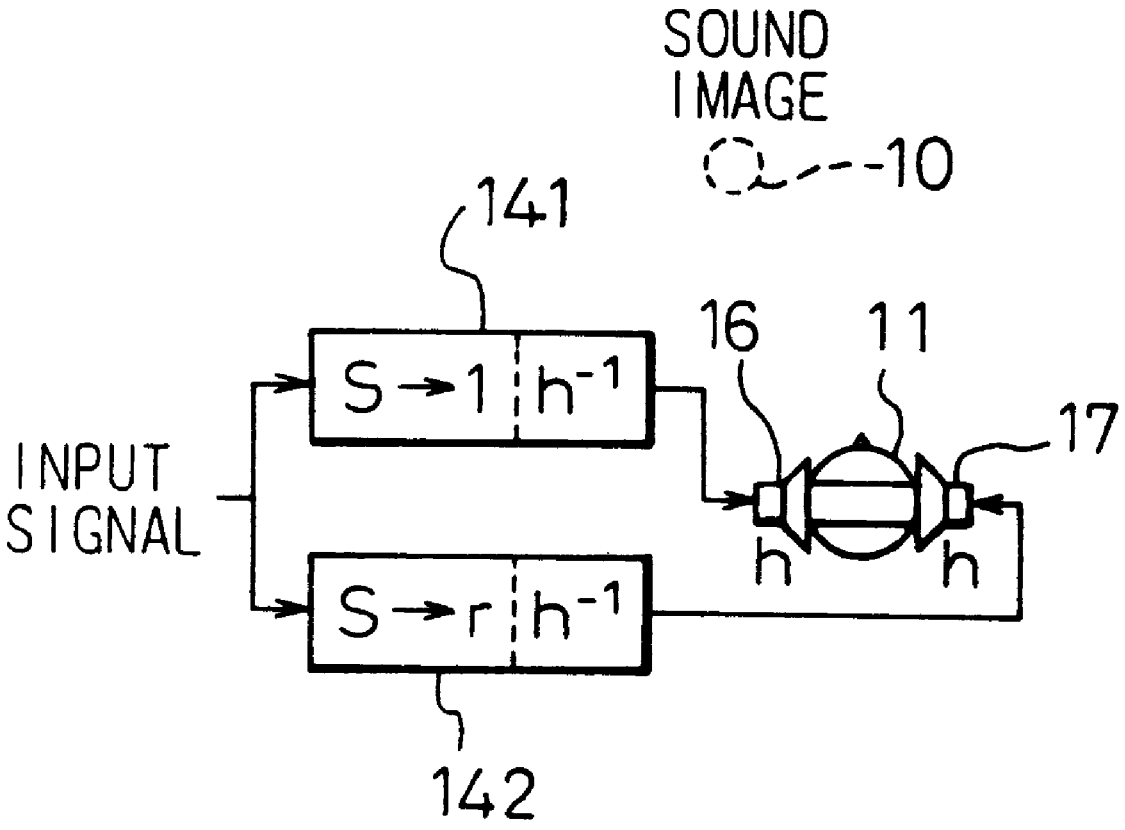
FIG. 28 is a drawing which shows an example of the linking of an acoustic characteristics adding filter and the inverse characteristics of a headphone according to the present invention.

FIG. 28 shows an example of the application of the above-described present invention. As described with reference to FIG. 7A and FIG. 7B, in the past the acoustic characteristics adding filters 35 and 37 and the inverse characteristics filters 36 and 38 for the headphone were each determined separately and then connected in series. In this case, if we hypothesize that, for example, the previous stage filter 35 (or 37) has 128 taps and the following stage filter 36 (or 38) has 128 taps, to guarantee signal convergence when these are connected in series, approximately double this number, 255 taps, were required.

In contrast to this, as shown in FIG. 28, a single filter 141 (or 142) is used, this being the combination of the acoustic characteristics adding filter and the headphone inverse characteristics filter. According to the present invention, as shown in FIG. 18A, pre-processing which considers the critical bandwidth is performed before performing linear predictive analysis of the acoustic characteristics. In this processing, as described above, extraction of characteristics of the signal sound are extracted and interpolation processing is performed, so that there is no auditorilly perceived change. As a result, it is possible to achieve an approximation of the frequency characteristics using linear predictive analysis with a lower order, and the filter circuit can be simplified in comparison to the prior art approach, in which two series connected stages were used.

Figure 29:
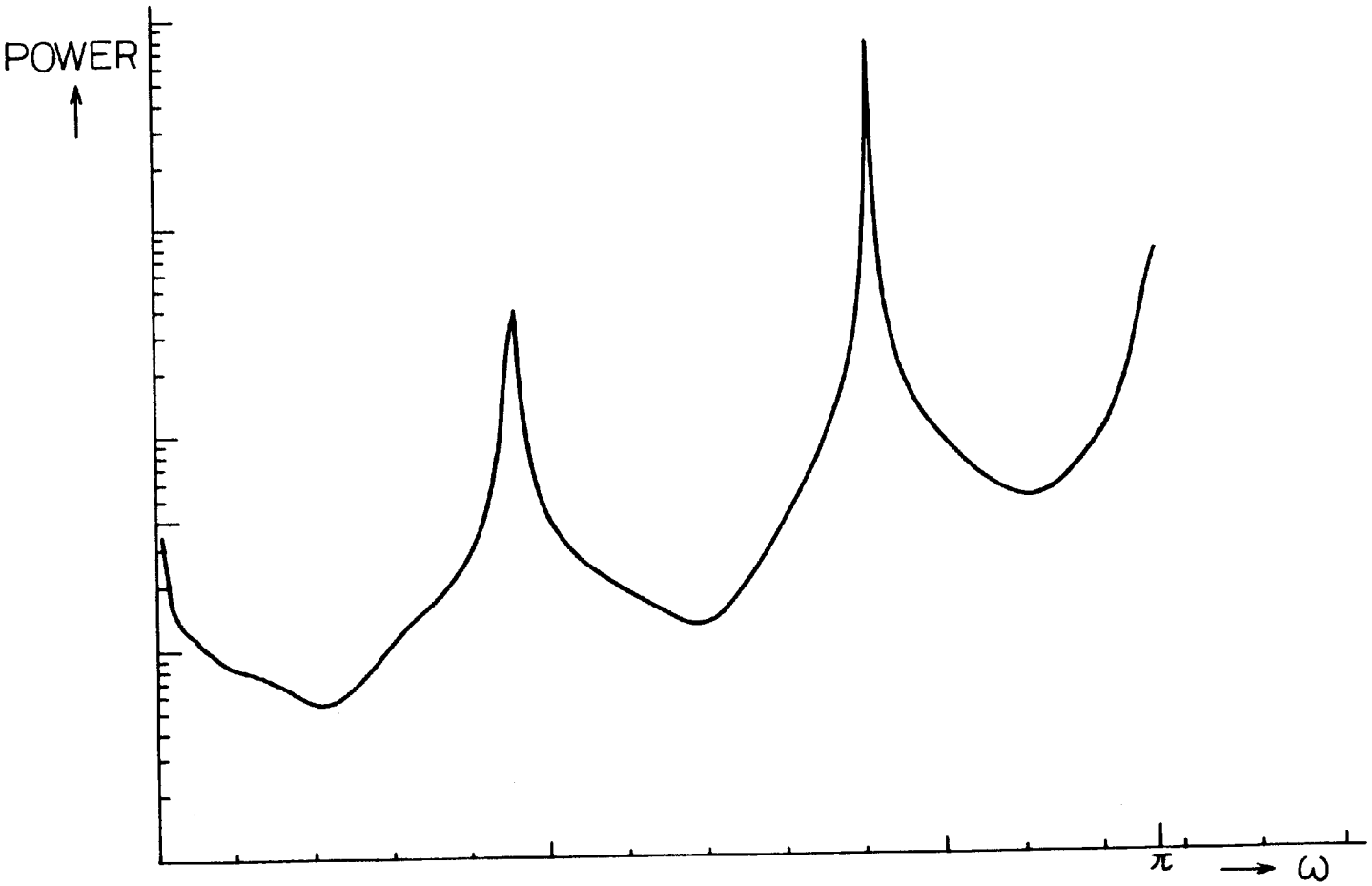
FIG. 29 is a drawing which shows an example of the inverse power spectrum characteristics of a headphone.
Figure 30:
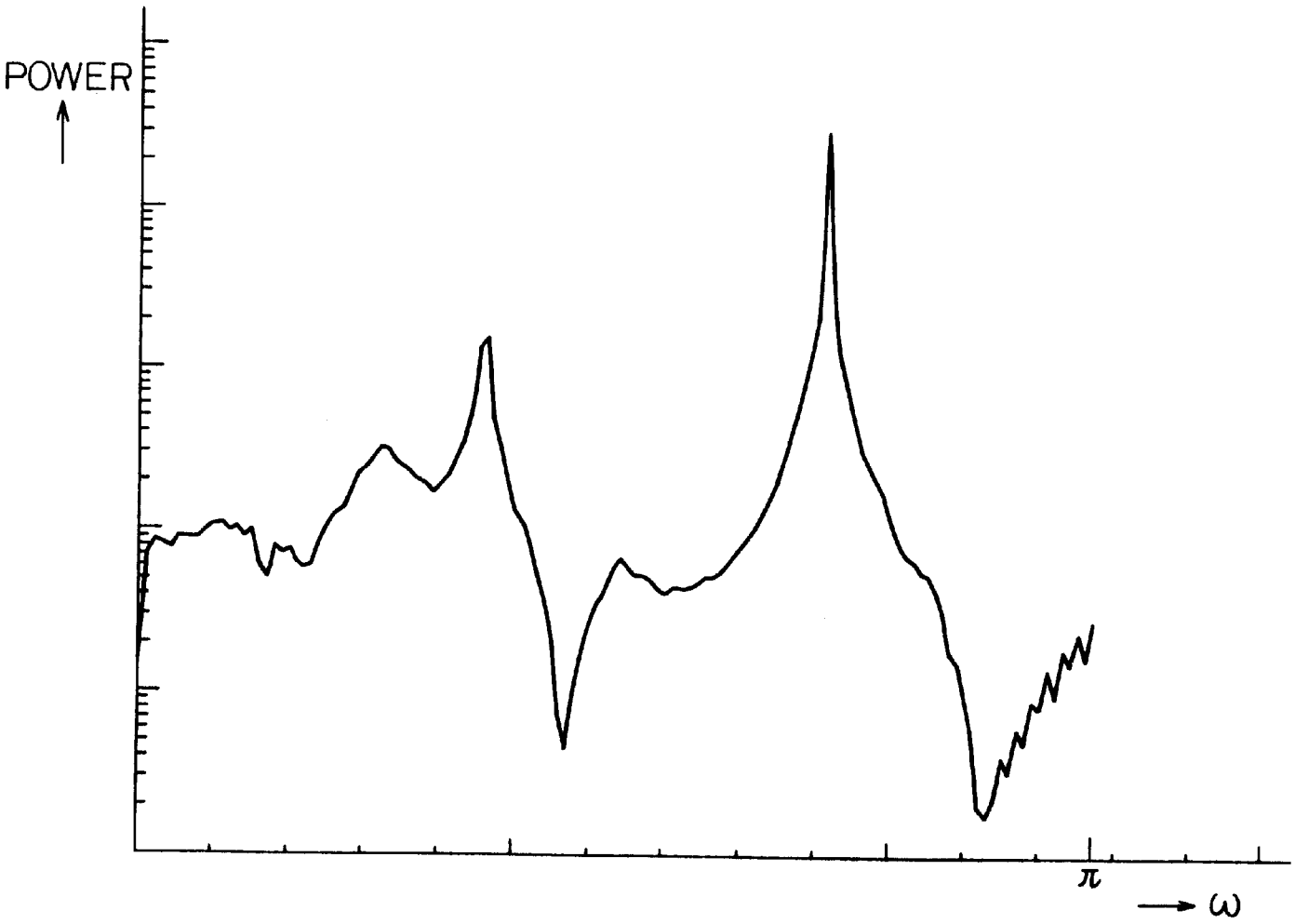
FIG. 30 is a drawing which shows an example of the power spectrum of the combination of an acoustic characteristics adding filter and inverse headphone characteristics.
Figure 31:
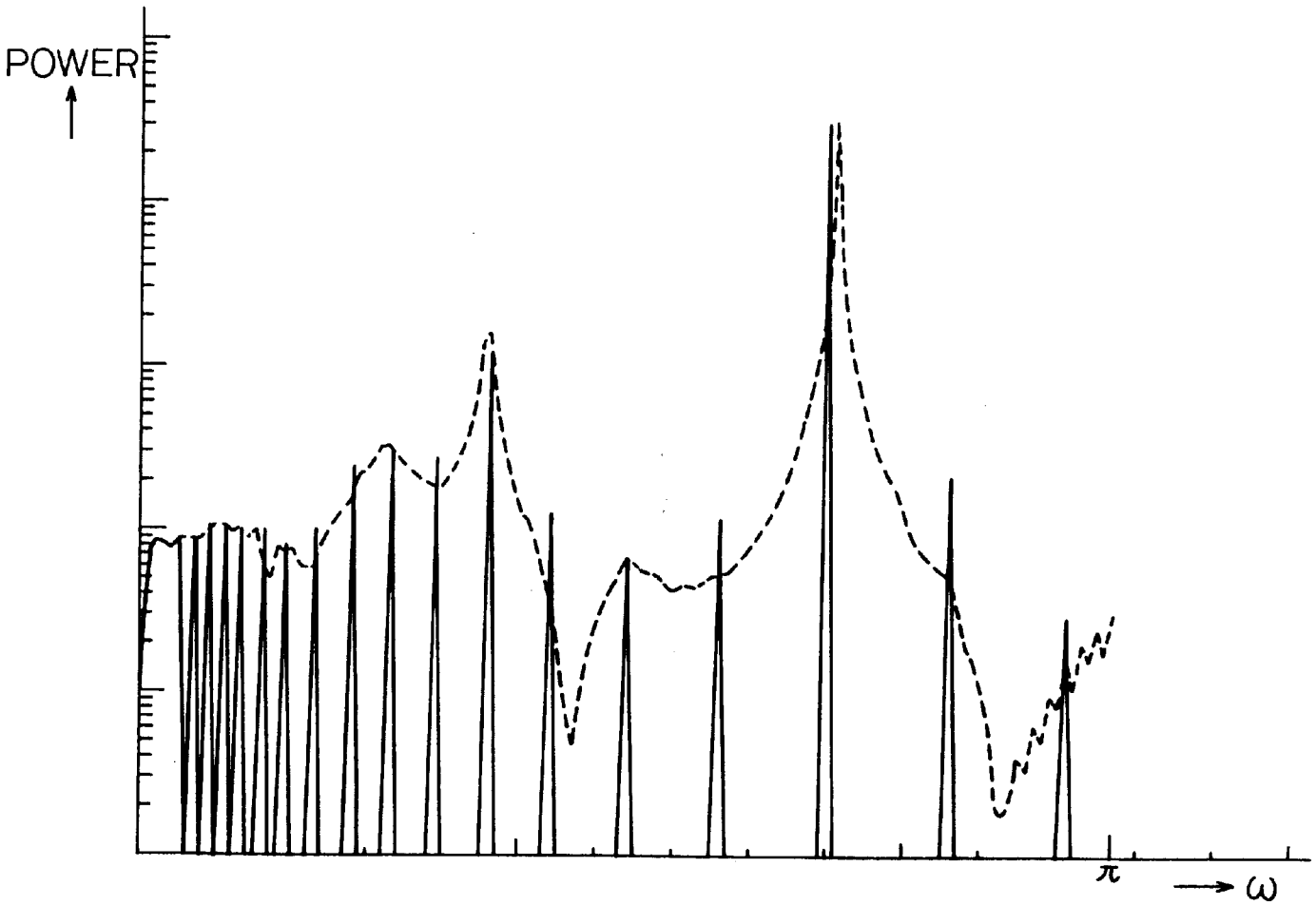
FIG. 31 is a drawing which shows an example of dividing the power spectrum which is shown in FIG. 30 into critical bandwidths and representing the power spectrum of each as the maximum value of the power spectrum thereof.
Figure 32:
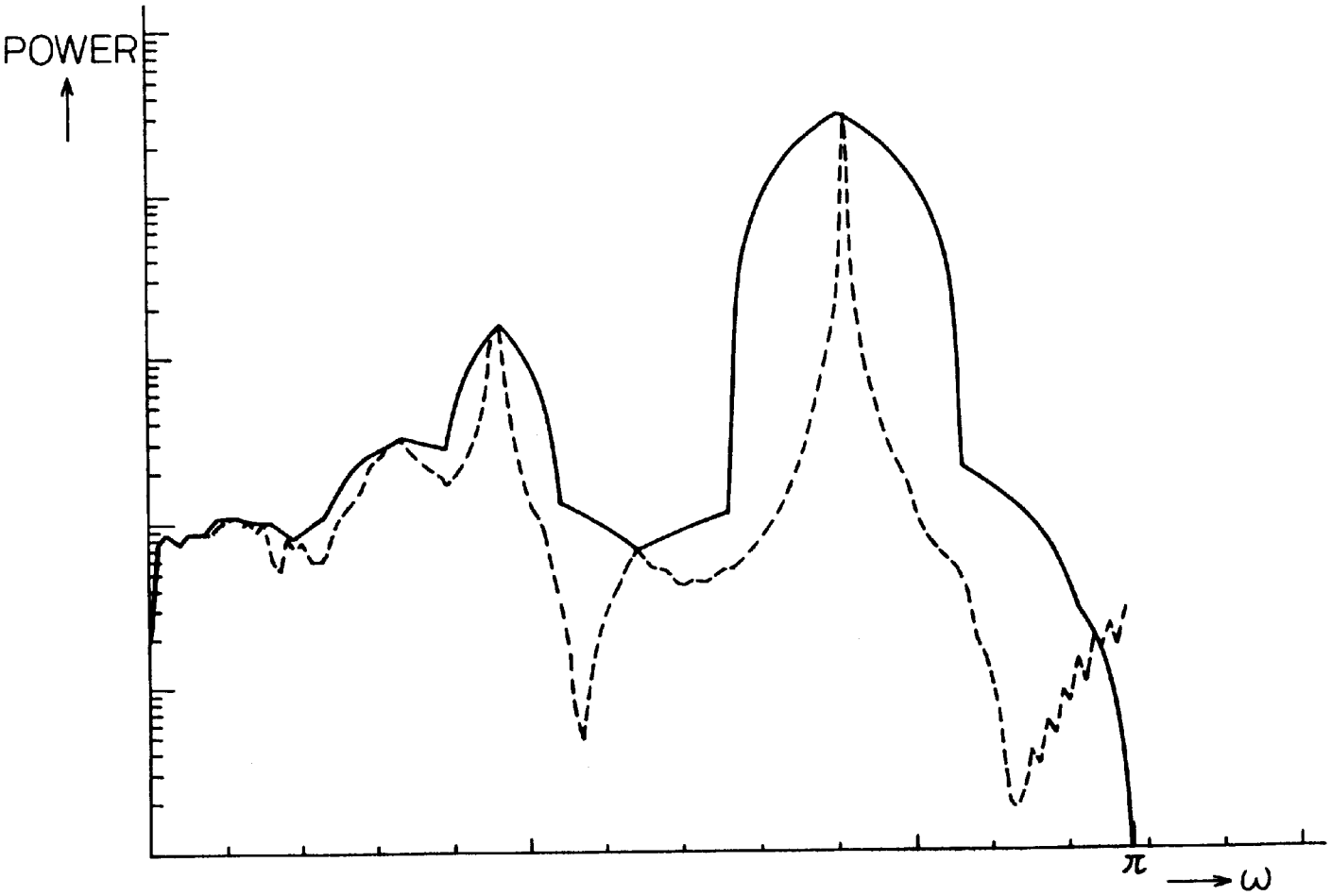
FIG. 32 is a drawing which shows an example of interpolation of the power spectrum of FIG. 31.

FIG. 29 shows an example of the inverse characteristics ($h^{-1}$) of the power spectrum of a headphone. FIG. 30 shows an example of the power spectrum of a combined filter comprising actual acoustic characteristics and the headphone inverse characteristics ($S \rightarrow 1*h^{-1}$). FIG. 31 shows the results of using the maximum value of each band is used to represent each band when division is done of the power spectrum of FIG. 30 into critical bandwidths. FIG. 32 shows an example of the base of performing interpolation processing on the representative values of the power spectrum shown in FIG. 31. It can be seen from a comparison of the power spectra of FIG. 30 and FIG. 32 that the latter is a more accurate approximation using linear predictive analysis with a lower order.

Figure 33:
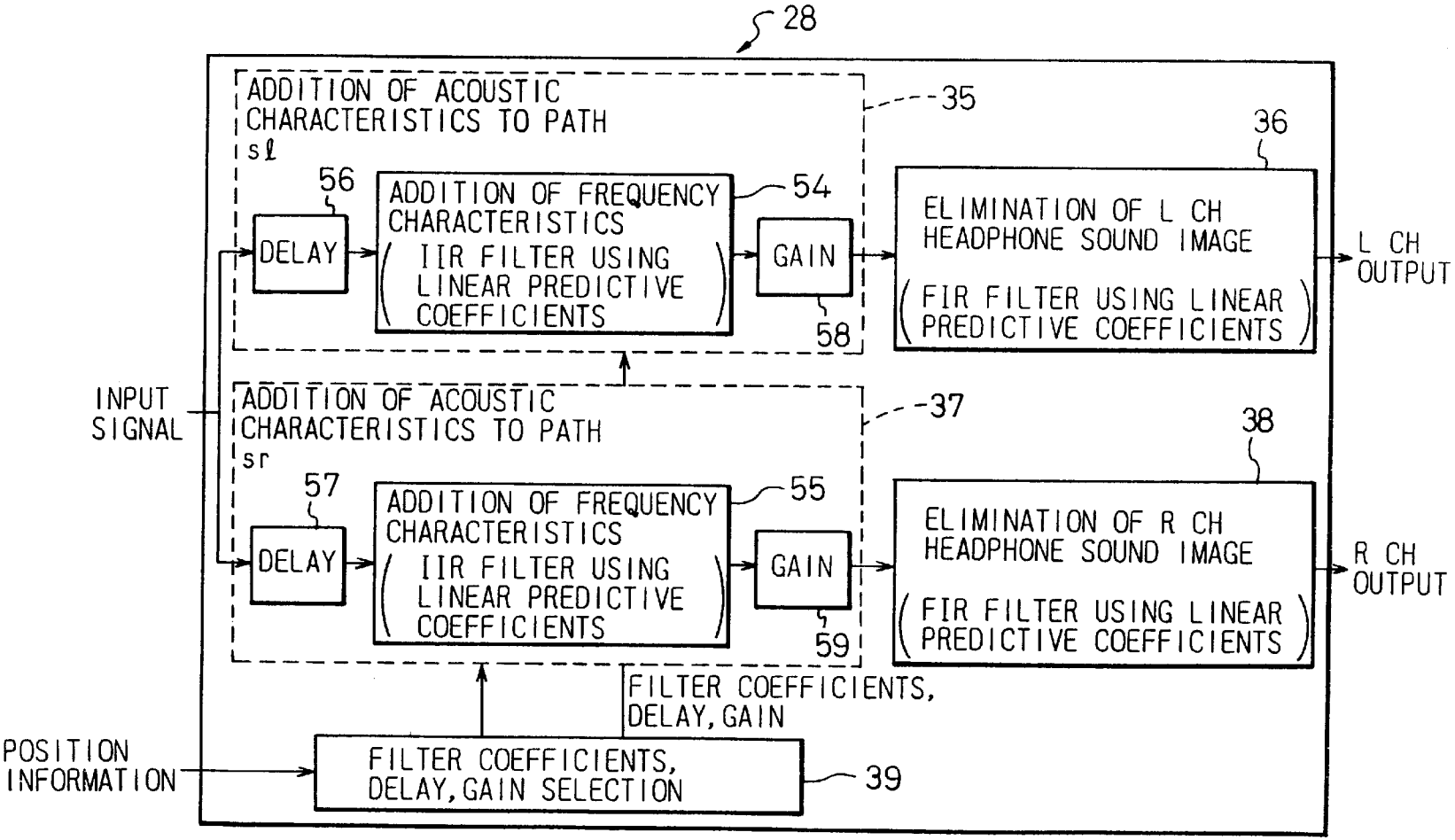
FIG. 33 is a drawing which shows an example of the basic configuration of an acoustic characteristics adding apparatus according to the present invention.

FIG. 33 shows the basic block diagram configuration for the purpose of localizing a sound image using an acoustic filter that employs linear predictive analysis according to the present invention.

FIG. 33 corresponds to the acoustic characteristics adder 28 of FIG. 4 and FIG. 5, the acoustic characteristics adding filters 35 and 37 thereof comprising the IIR filters 54 and 55, respectively, which add frequency characteristics using linear predictive coefficients according to the present invention, the delay sections 56 and 57, which serve as the input stages for the filters 35 and 37, respectively, and which provide, for example, pitch and time difference to reach the left and right ears, and amplifiers 58 and 59 which control the individual gains and serve as the output stages for the filters 35 and 37, respectively. The filters 36 and 38, which eliminate the acoustic characteristics of the headphone on the left and right channels are FIR filters using linear predictive coefficients according to the present invention.

Of the above-noted acoustic characteristics adding filters 35 and 37, the IIR filters 54 and 55 are the short-term synthesis filter 44 which was described in relationship to FIG. 12, and the delay sections 55 and 56 are the delay circuit ($Z^{-d}$) of FIG. 12. The filters 36 and 38 which eliminate the acoustic characteristics of the headphone are the FIR-type linear predictive filters 53 of FIG. 16. Therefore, the above-noted filters will not be explained again at this point. The filter coefficient selection means 39 performs selective setting of the filter coefficients, pitch/delay time, and gain as parameters of the above-noted filters.

Figure 34:
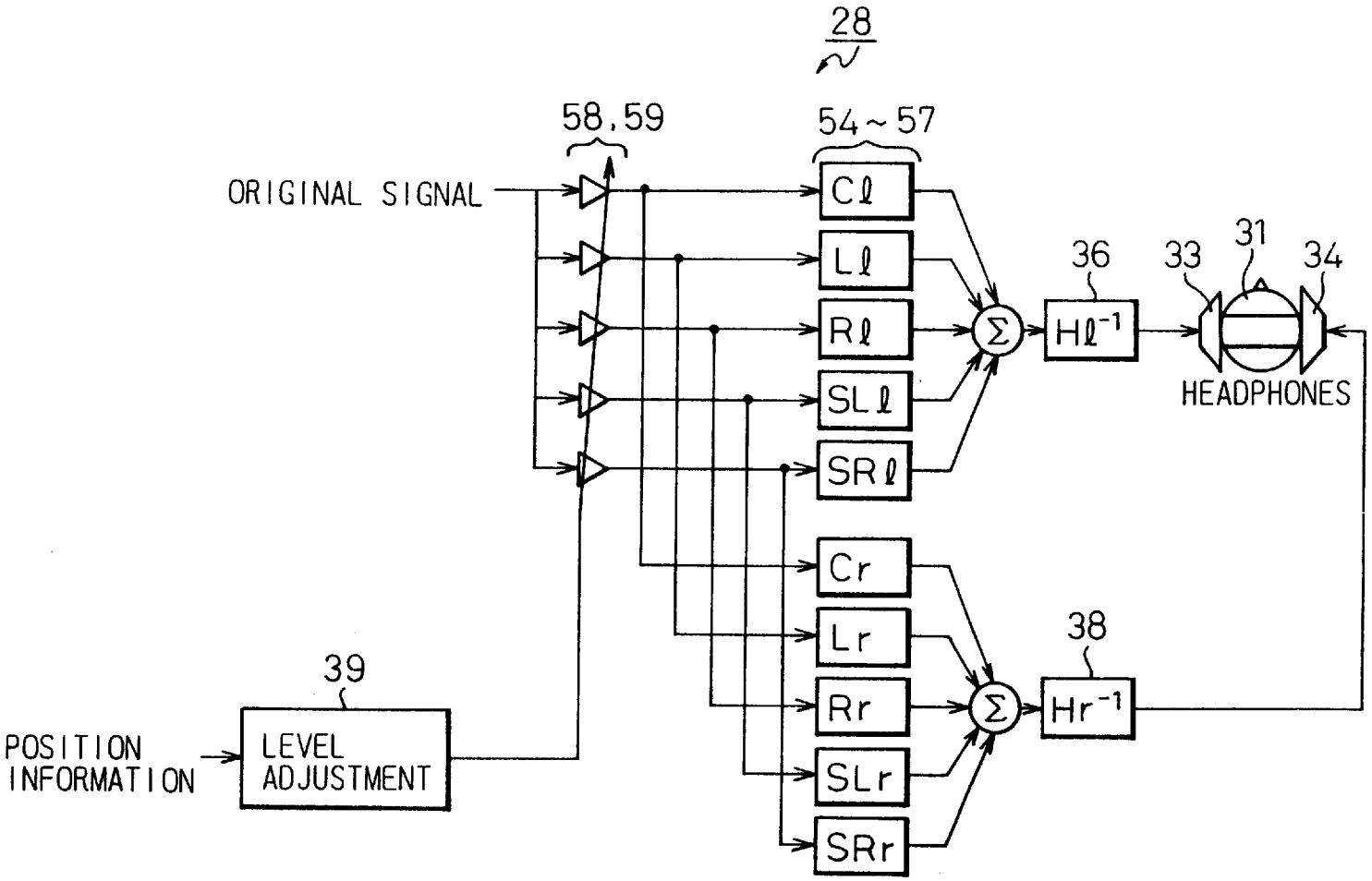
FIG. 34 is a drawing which shows an example of surround-type sound image localization using the acoustic characteristics adding apparatus of FIG. 33.

FIG. 34 shows an example of an implementation of sound image localization as illustrated in FIG. 10, using the acoustic characteristics adder 28 according to the present invention. Five virtual sound sources made of 10 filters (Cl to SRl and Cr to SRr) 54 to 57, corresponding to the five speakers shown in FIG. 10 (L, C, R, SR, and SL) are in the same kind of placement, and the acoustic characteristics of the earphones of headphone 33 and 34 are eliminated by the acoustic characteristics eliminating filters 36 and 38. Because, as seen from the listener, this environment is the same as in FIG. 10, as described with regard to FIG. 10, changing the gain of the amplifiers 58 and 59 by means of the level adjusting section 39, causes the amount of sound from each of the virtual sound sources (L, C, R, SR, and SL) to change, so that the sound image is localized so as to surround the listener.

Figure 35:
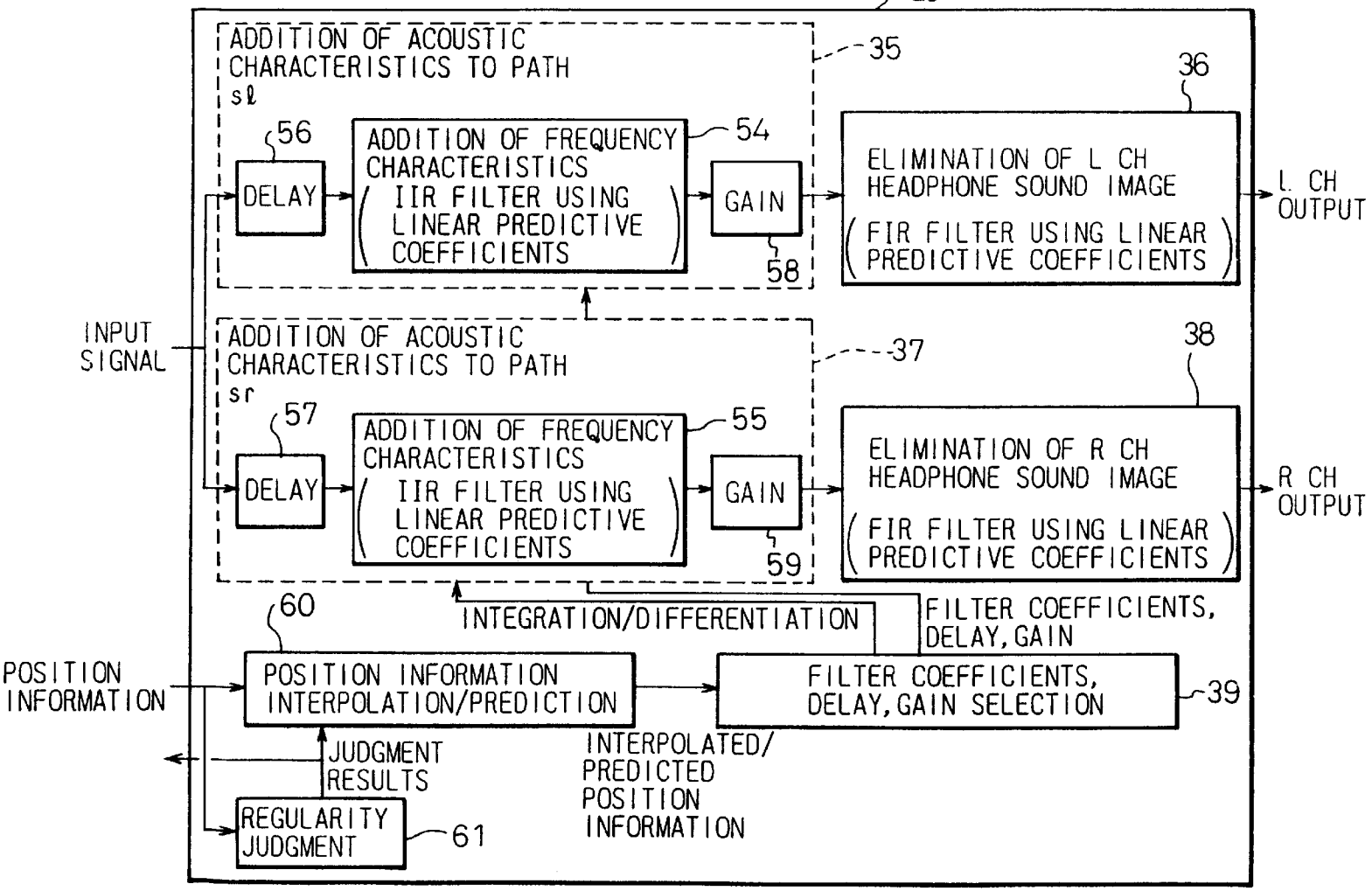
FIG. 35 is a drawing which shows an example of the configuration of an acoustic characteristics adding apparatus according to the present invention.

FIG. 35 shows an example of the configuration of an acoustic characteristics adder according to the present invention, this having the same type of configuration as described above with regard to FIG. 33, except for the addition of a position information interpolation/prediction section 60 and a regularity judgment section 61. FIGS. 36 through 40 illustrate the functioning of the position information interpolation/prediction section 60 and the regularity judgment section 61 shown in FIG. 35.

Figure 36:
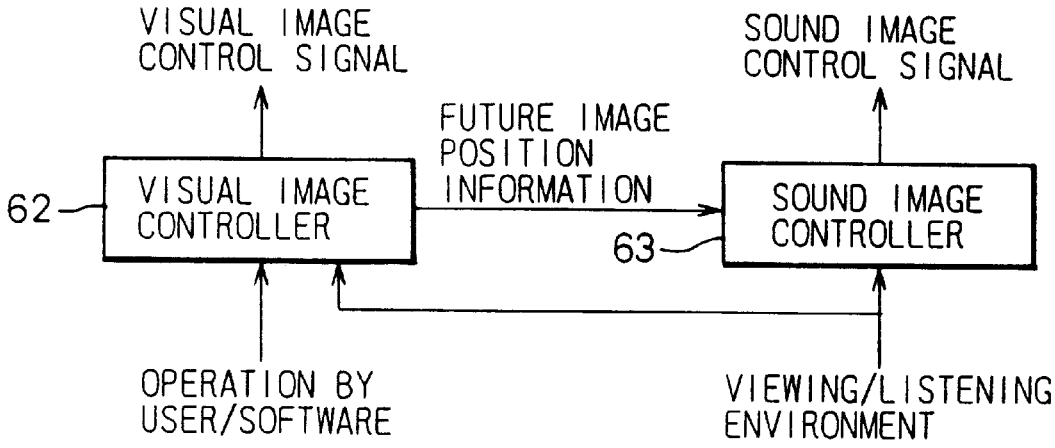
FIG. 36 is a drawing which illustrates the interpolation of position information (part 1)
Figure 37:
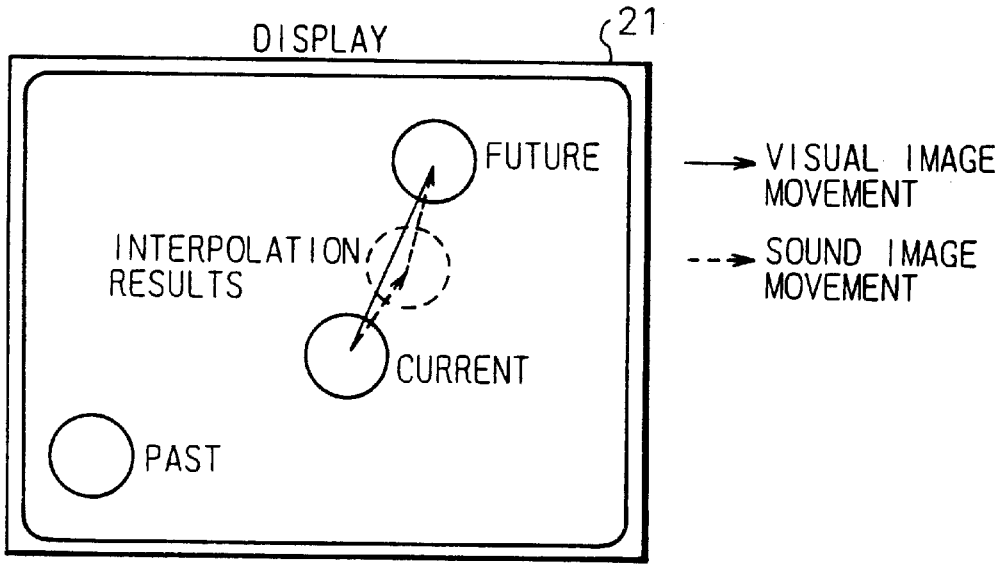
FIG. 37 is a drawing which illustrates the interpolation of position information (part 2)
Figure 38:
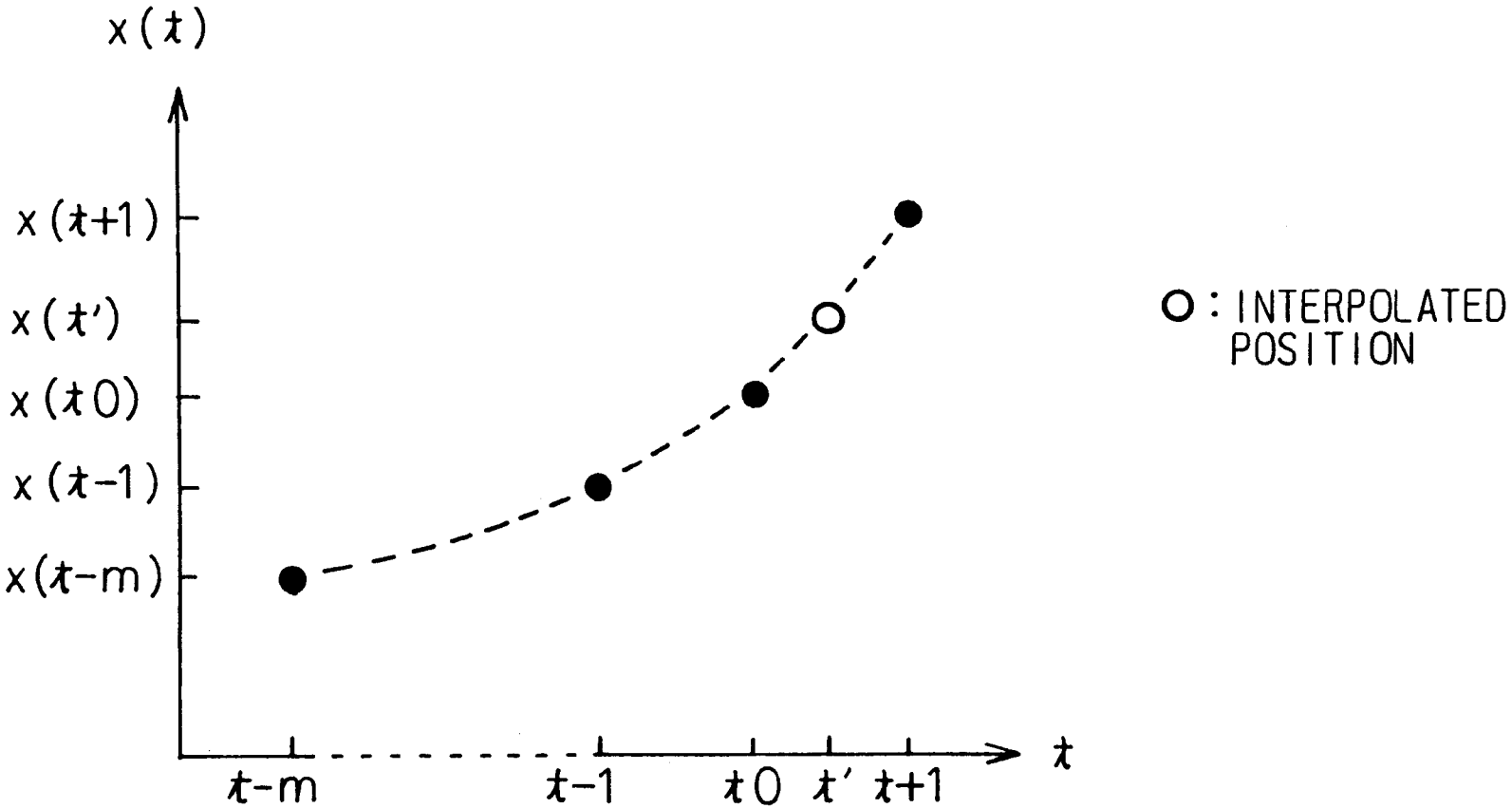
FIG. 38 is a drawing which illustrates the interpolation of position information (part 3)

FIGS. 36 through 38 are related to the interpolation of position information. As shown in FIG. 36, the future position information is pre-read to the sound image controller 63 (corresponding to the three-dimensional acoustic apparatus 27 in FIG. 4) from the visual image controller 62 (corresponding to the CG display apparatus 24 in FIG. 4) before performing visual image processing, which requires a long processing time. As shown in FIG. 37, the above-noted position information interpolation/prediction section 60, which is included in the sound image controller 63 of FIG. 36, performs interpolation of the sound image position information on the display 21 (refer to FIG. 4) using the future, current, and past positions of the visual image.

The method of performing x-axis value interpolation for a system of (x, y, z) orthogonal axes for the visual image is as follows. It is also possible to perform interpolation in the same way for y-axis and z-axis values.

In FIG. 38, t0 is the current time, t−1, . . . , t−m are past times, and t+1 is a future time. Using a Taylor series expansion, assume that at times t+1, . . . , t−m the value of x(t) is expressed as follows.

$$x(t)=a0+a1*t+a2*t^2+\ldots+an*t^n(n\leqq m+1) \tag{5.1}$$

Using the values of x(t+1), . . . , x(t−m), by determining the coefficients a0, . . . , an of the above equation, it is possible to obtain the x-axis value x(t') at a time t'(t0<t'<t+1).

$$\Delta=Ta \tag{5.2}$$

In Equation (5.2):

$$\Delta = [x \quad (t+1) \quad \ldots \quad x(t-m)]^T$$

$$T = \begin{bmatrix} 1 & (t+1) & \ldots & (t-1)^n \\ 1 & t0 & & t0^n \\ & & & \\ 1 & (t-m) & \ldots & (t-m)^n \end{bmatrix}$$

$$a = [a0, \ a1, \ \ldots, \ an]^T$$

The coefficients a0, . . . , an can be determined as follows from Equation (5.2).

$$a=(T^T T)^{31\ 1}(T^T \Delta) \tag{5.3}$$

In the same manner as shown above, it is possible to predict a future position by interpolating the x-axis values. For example, using the prediction coefficients b1, . . . , bn, the following equation is used to determine the prediction x'(t+1) value.

$$x'(t+1)=b1*x(t)+b2*x(t-1)+\ldots+bn*x(t-n+1) \tag{5.4}$$

The predictive coefficients b1, . . . , bn in the above equation are determined by performing linear predictive analysis by means of an auto-correlation of the current and past values x(t), . . . , x(t−1). It is also possible to determine this by trial-and-error, by using a method such as the steepest descent method.

Figure 39:
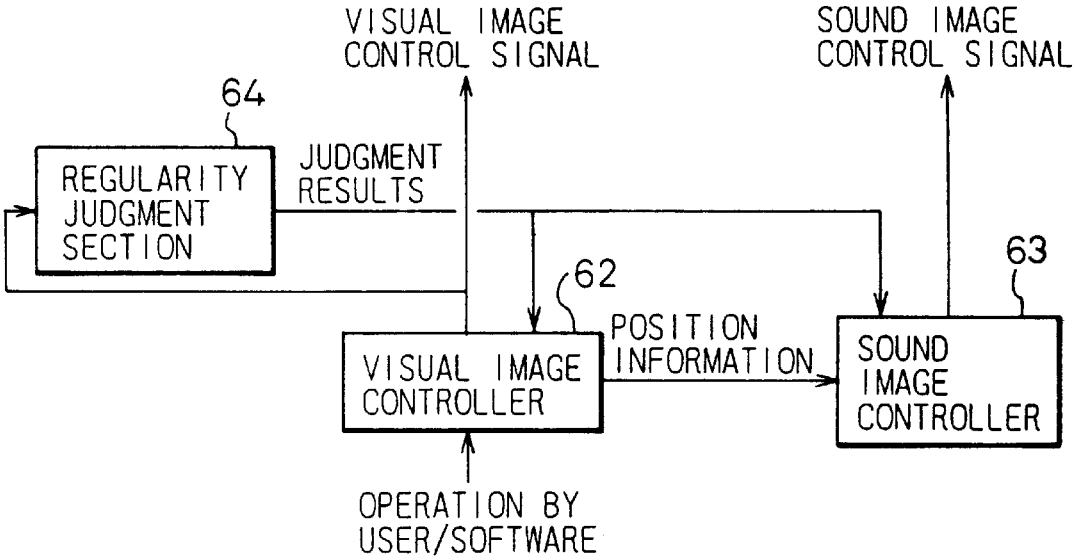
FIG. 39 is a drawing which illustrates the prediction of position information (part 1)
Figure 40:
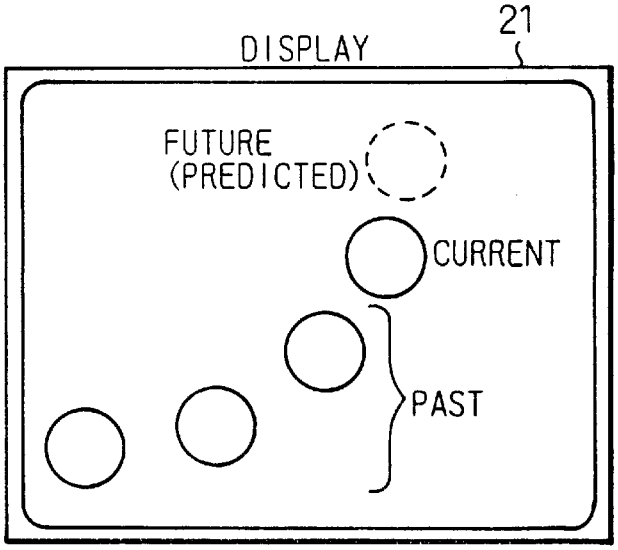
FIG. 40 is a drawing which illustrates the prediction of position information (part 2)

FIG. 39 and FIG. 40 show a method of predicting a future position by making a judgment as to whether or not regularity exists in the movement of a visual image.

For example, when the above-noted Equation (5.4) is used to determine the predictive coefficients b1, . . . , bn using linear predictive analysis, the regularity judgment section 64 of FIG. 39 which corresponds to the regularity judgment section 61 of FIG. 35 judges that regularity in the movement of the visual image if a set of stable predictive coefficients is obtained. In this same Equation (5.4), when using a prescribed adaptive algorithm to determine the predictive coefficients b1, . . . , bn, by trial-and-error, the movement of the visual image is judged have regularity if the coefficients converge to within a certain value. Only when such a judgment result occurs are the coefficients determined from Equation (5.4) used as the future position.

While the above description was that of the case in which interpolation and prediction is performed of a sound image position on a display in accordance with visual image position information given by a user or software, it is also possible to use the listener position information as the position information.

Figure 41:
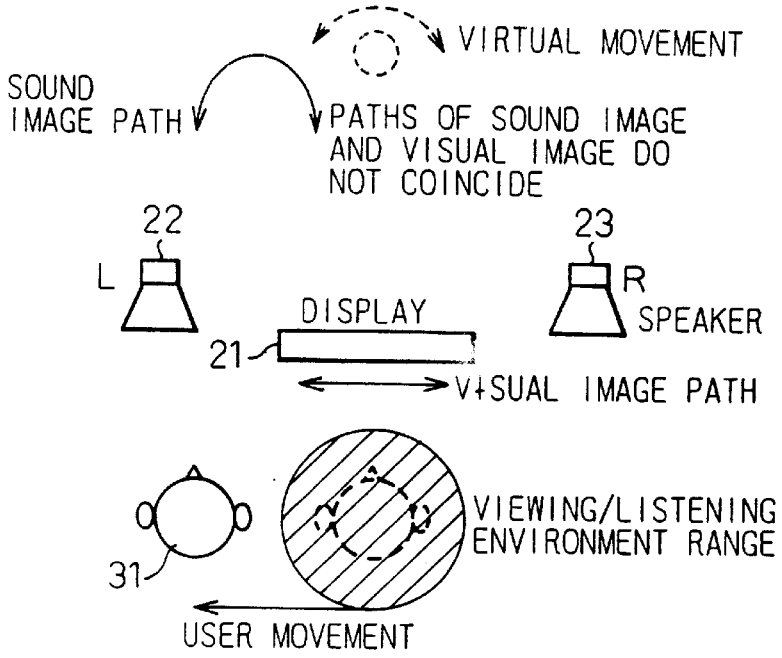
FIG. 41 is a drawing which illustrates localization of a sound image by using position information of the listener (part 1)
Figure 42:
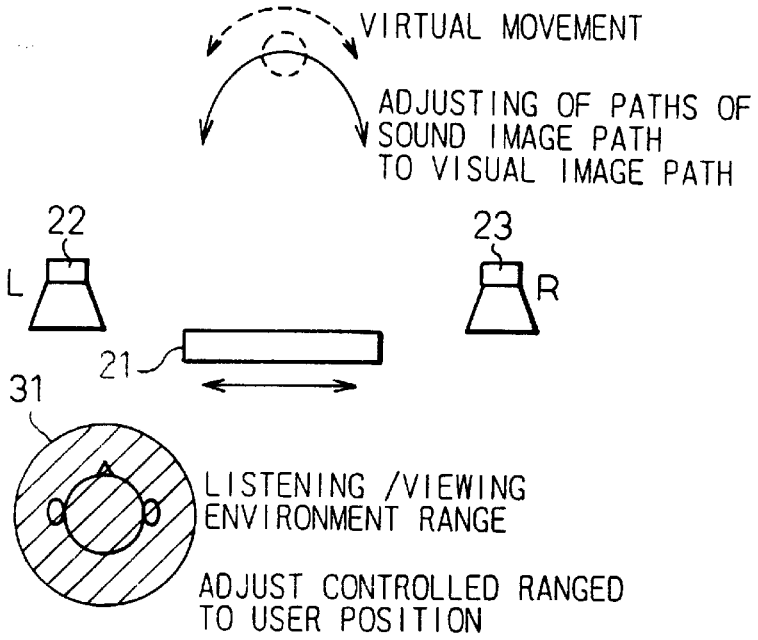
FIG. 42 is a drawing which illustrates localization of a sound image by using position information of the listener (part 2)

FIG. 41 and FIG. 42 show examples of optimal localization of a sound image in accordance with listener position information. FIG. 41 show an example in which in the system of FIG. 4, the listener 31 moves away from the proper listening/viewing environment, which is marked by hatching lines, so that as seen from the listener 31 the sound image position and visual image position do not match. In this case as well, according to the present invention, it is possible to perform continuous monitoring of the position of the listener 31 using a position sensor or the like, the listening/viewing environment thus being moved toward the listener 31 automatically as shown in FIG. 42, the result being that the sound image and visual image are matched to the listening/viewing environment. With regard to the movement of a sound image position, the method described above can be applied as is. That is, the right and left channel signals are controlled so as to move the range of the listening/viewing environment toward the user.

Figure 43A:
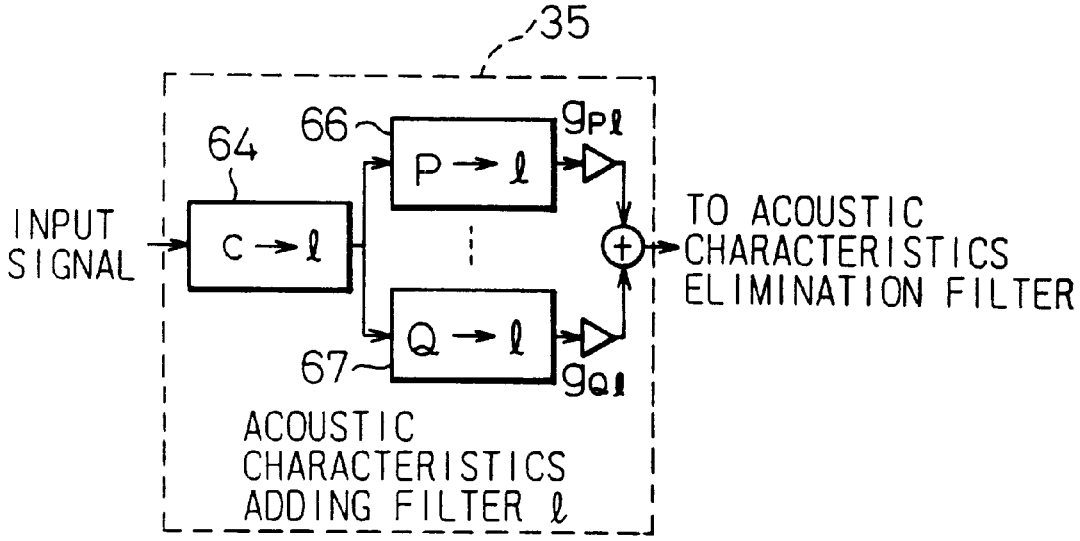
FIG. 43A is a drawing which shows the calculation processing configuration according to the present invention (part 1)
Figure 43B:
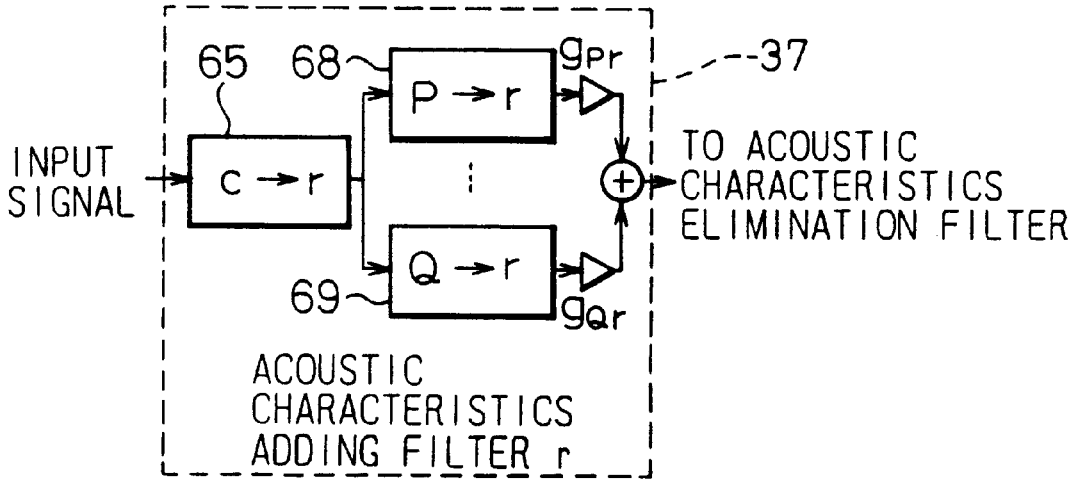
FIG. 43B is a drawing which shows the calculation processing configuration according to the present invention (part 2)

FIG. 43A and FIG. 43B show an embodiment of improved efficiency calculation according to the present invention. In FIG. 43A and FIG. 43B, by extracting the common acoustic characteristics in each of the acoustic characteristics adding filters 35 and 37 of FIG. 33 or FIG. 35, these are divided between the common calculation sections (C→l) 64 and (C→r) 65 and the individual calculation sections (P→l) through (Q→r) 66 through 69, thereby avoiding calculations that are duplications, the result being that it is possible to achieve an even greater improvement in calculation efficiency and speed in comparison with the prior art as described with regard to FIG. 8A and FIG. 8B. The common calculation sections 64 and 65 are connected in series with the individual calculation sections 66 through 69, respectively. Each of the individual calculation sections 66 through 69 has connected to it an amplifier $g_{pl}$ through $g_{Qr}$, for the purpose of controlling the difference in level between the two ears and the position of the sound image. In this case, the common acoustic characteristics are the acoustic characteristics from a virtual sound source (C), which is positioned between two or more real sound sources (P through Q), to a listener.

Figure 44A:
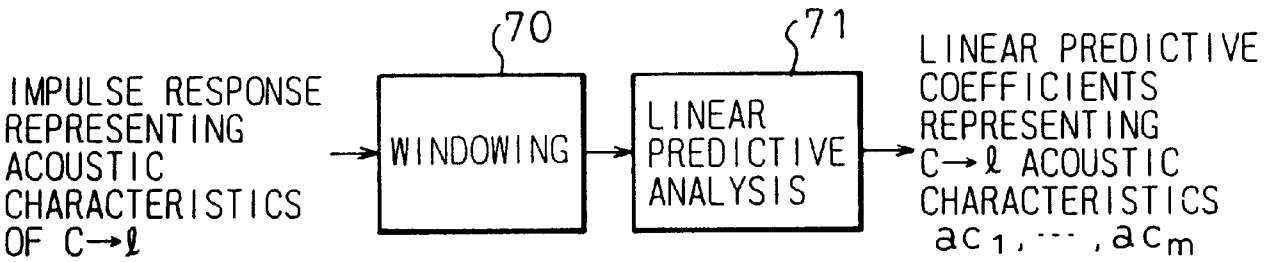
FIG. 44A is a drawing which shows the method of determining the common characteristics and the individual characteristics (part 1)

FIG. 44A shows the processing system for determining the common characteristics linear predictive coefficients using an impulse response which represents the acoustic characteristics from the above-noted virtual sound source C to the listener. Although this example happens to show the acoustic characteristics of C→l, the same would apply to the acoustic characteristics for C→r. To achieve even further commonality, with the virtual sound source positioned directly in front of the listener, it is possible to assume that the C→l and C→r acoustic characteristics are equal. In general, a Hamming window or the like is used for the windowing processing 70, with linear predictive analysis being performed by the Levinson-Durbin recursion method.

Figure 44B:
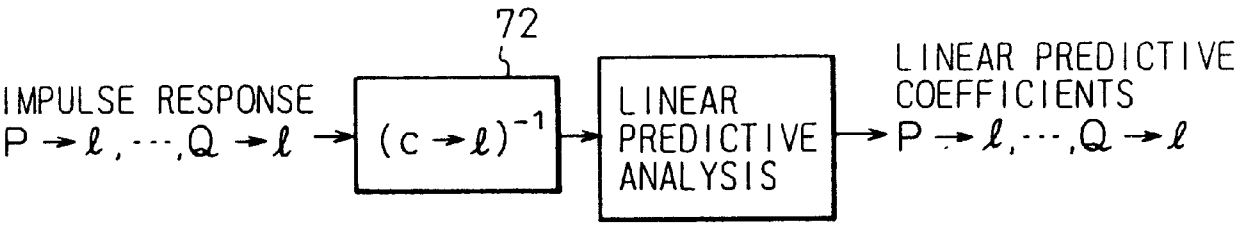
FIG. 44B is a drawing which shows the method of determining the common characteristics and the individual characteristics (part 2)
Figure 44C:
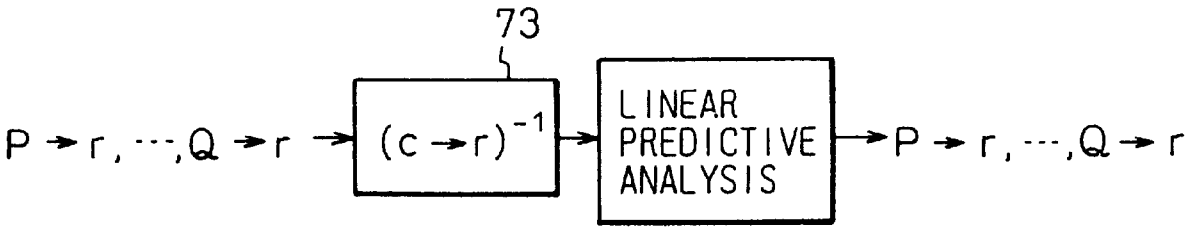
FIG. 44C is a drawing which shows the method of determining the common characteristics and the individual characteristics (part 3)

FIG. 44B and FIG. 44C show the processing system for determining the linear predictive coefficient which represent the individual acoustic characteristics from the real sound sources P through Q to the listener. Each of the acoustic characteristics is input to the filter $(C\rightarrow l)^{311}$ 72 or $(C\rightarrow r)^{311}$ 73 which eliminates the common acoustic characteristics of the impulse response, the corresponding outputs being subjected to linear predictive analysis, thereby determining the linear predictive coefficients which represent the individual parts of each of the acoustic characteristics. The above filters 72 and 73 have set into them linear predictive coefficients for the common characteristics, using a method similar to that described with regard to FIG. 13. As a result, the common characteristics parts are removed from each of the individual impulse responses beforehand, the linear predictive coefficients for the filter characteristics of each individual filter (P→l) through (Q→l) and (P→r) through (Q→r) being determined.

Figure 45:
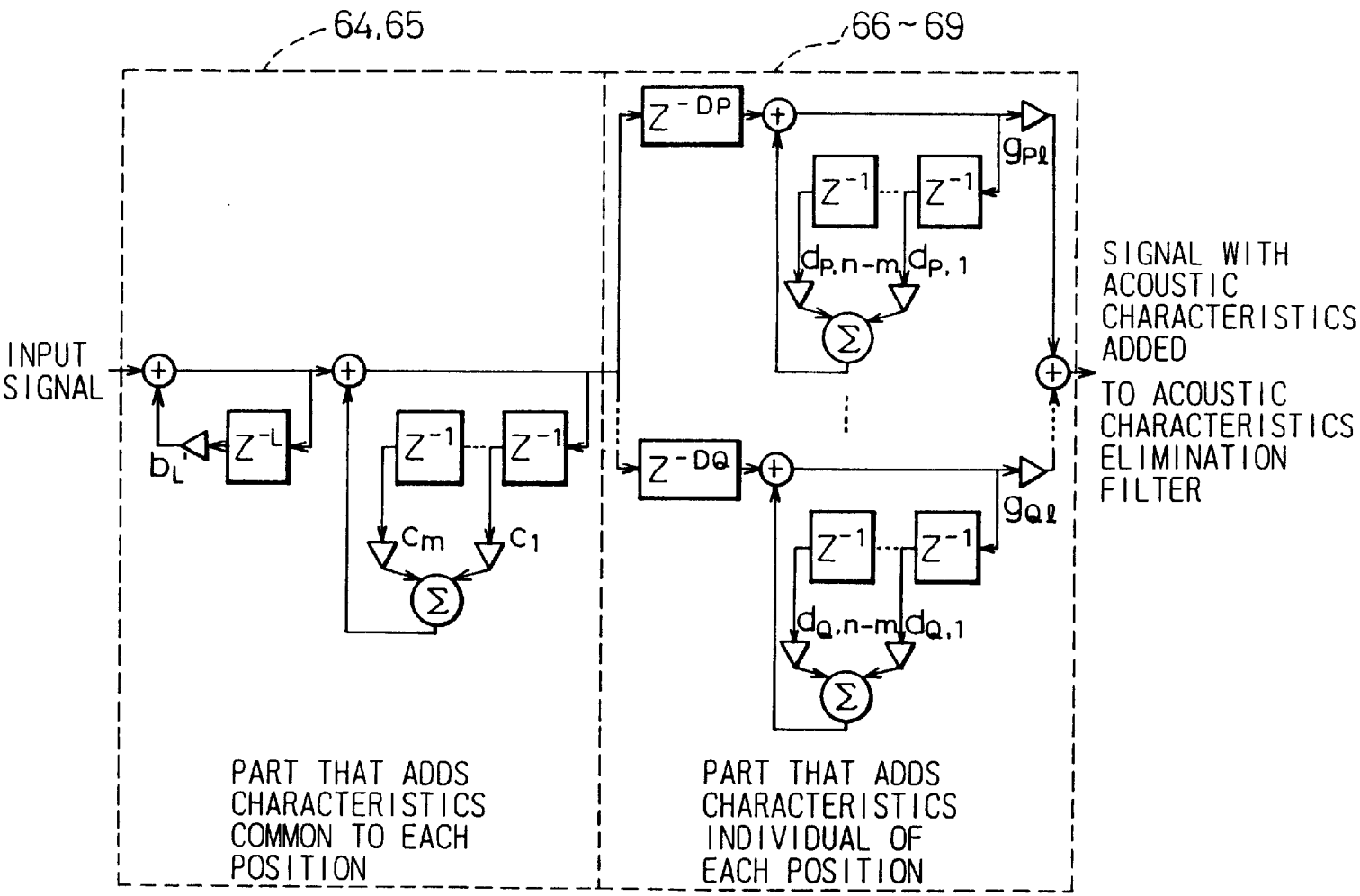
FIG. 45 is a drawing which shows an embodiment of an acoustic characteristics adding filter in which the common part and individual part are separated (part 1)
Figure 46:
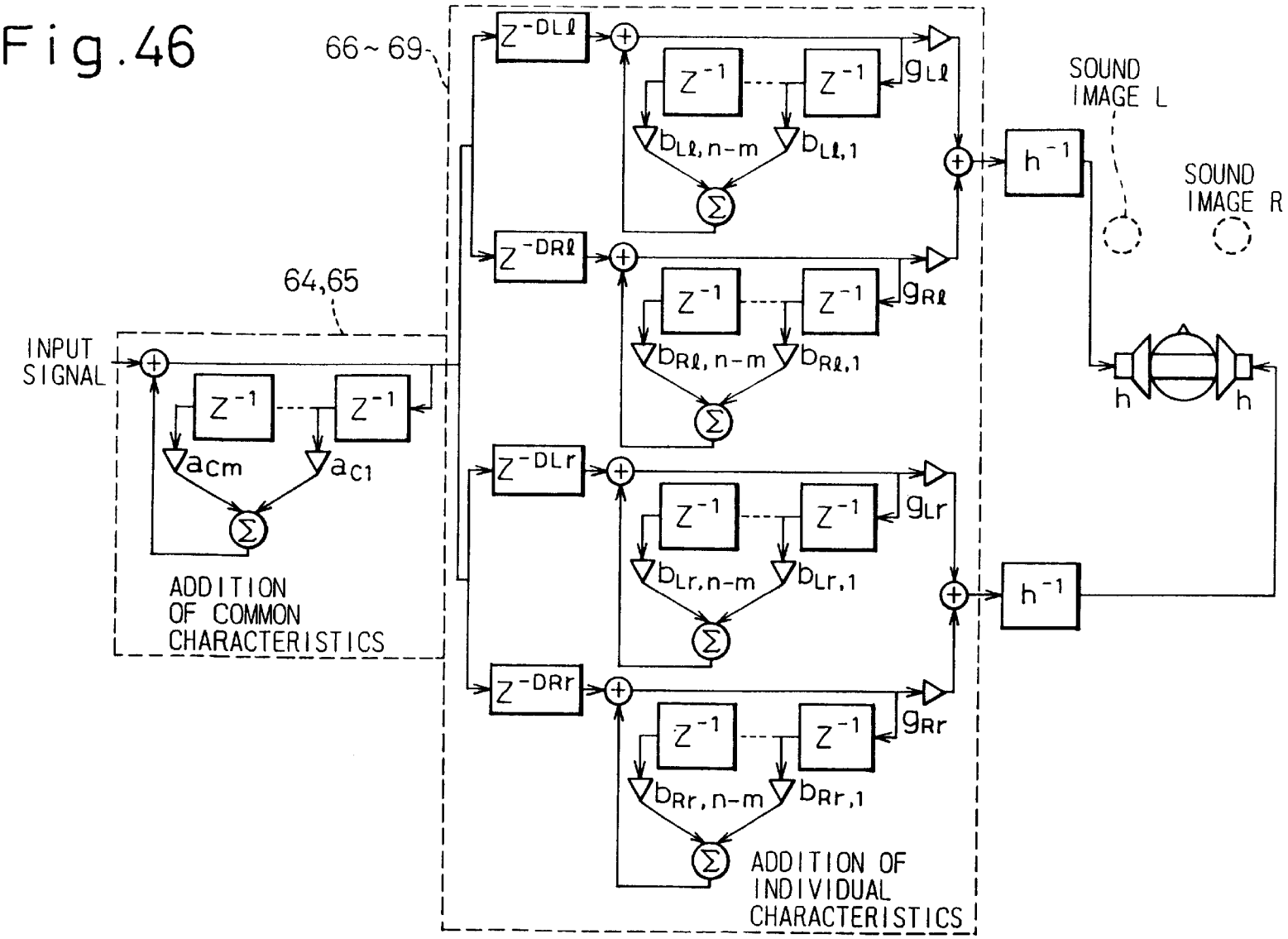
FIG. 46 is a drawing which shows an embodiment of an acoustic characteristics adding filter in which the common part and individual part are separated (part 2)

FIG. 45 and FIG. 46 show an embodiment in which the common and individual parts of the characteristics are separated, acoustic characteristics adding filters 35 and 37 being connected is series therebetween.

The common parts 64 and 65 of FIG. 45 are formed by the linear synthesis filter, described with relation to FIG. 12, which comprises a short-term synthesis filter and a pitch synthesis filter. Individual parts 66 through 69 are formed by, in addition to short-term synthesis filter which represent each of the individual frequency characteristics, delay devices $Z^{-DP}$ and $Z^{-DQ}$ which control the time difference between the two ears, and amplifiers $g_{Pl}$ through $g_{Ql}$ for the purpose of controlling the level difference and position of the sound image.

FIG. 46 shows and example of an acoustic characteristics adding filter between two sound sources L and R and a listener. In this drawing, to maintain consistency with the description below of FIGS. 47A through 49, there is no pitch synthesis filter used in the common parts 64 and 65.

Figure 47A:
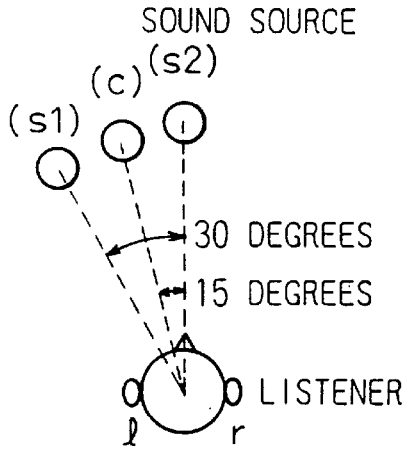
FIGS. 47A and 47B are drawings which show an original sound field and reproducing sound field using an embodiment of FIG. 46.
Figure 47B:
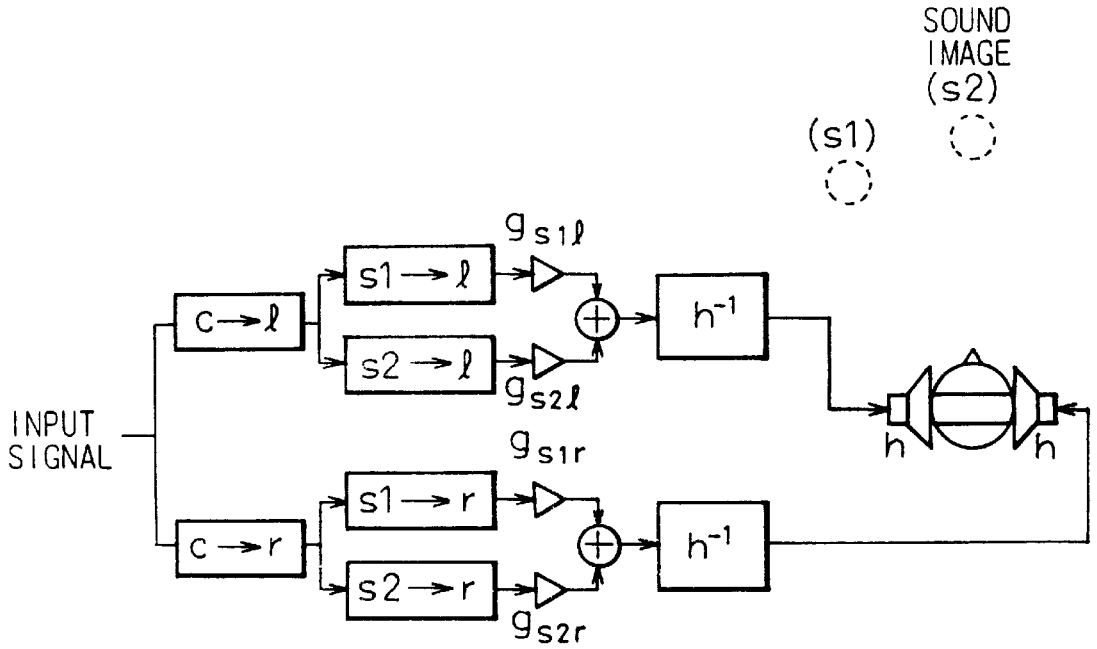
Figure 48:
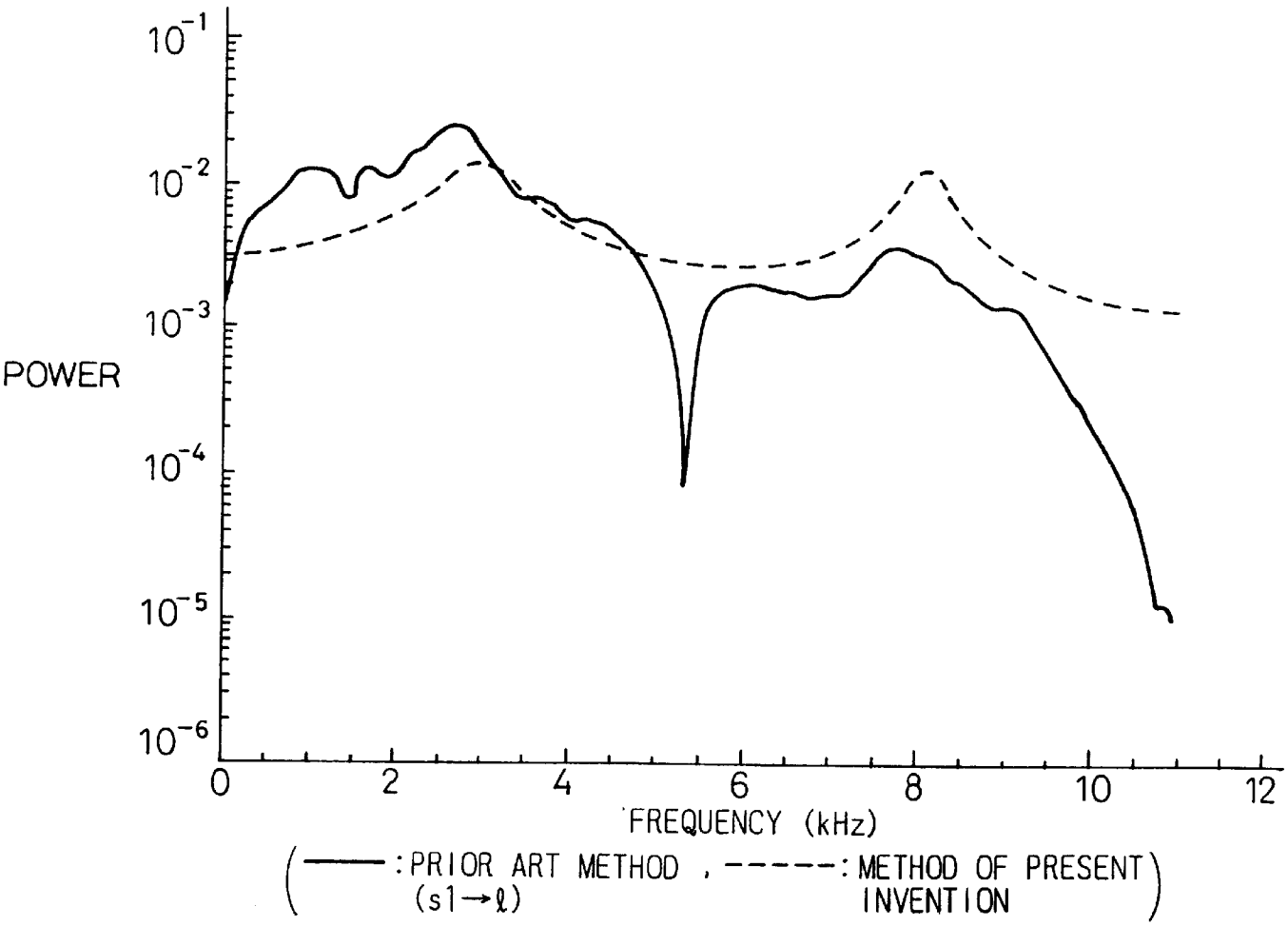
FIG. 48 is a drawing which shows the frequency characteristics of the common part C→l.
Figure 49:
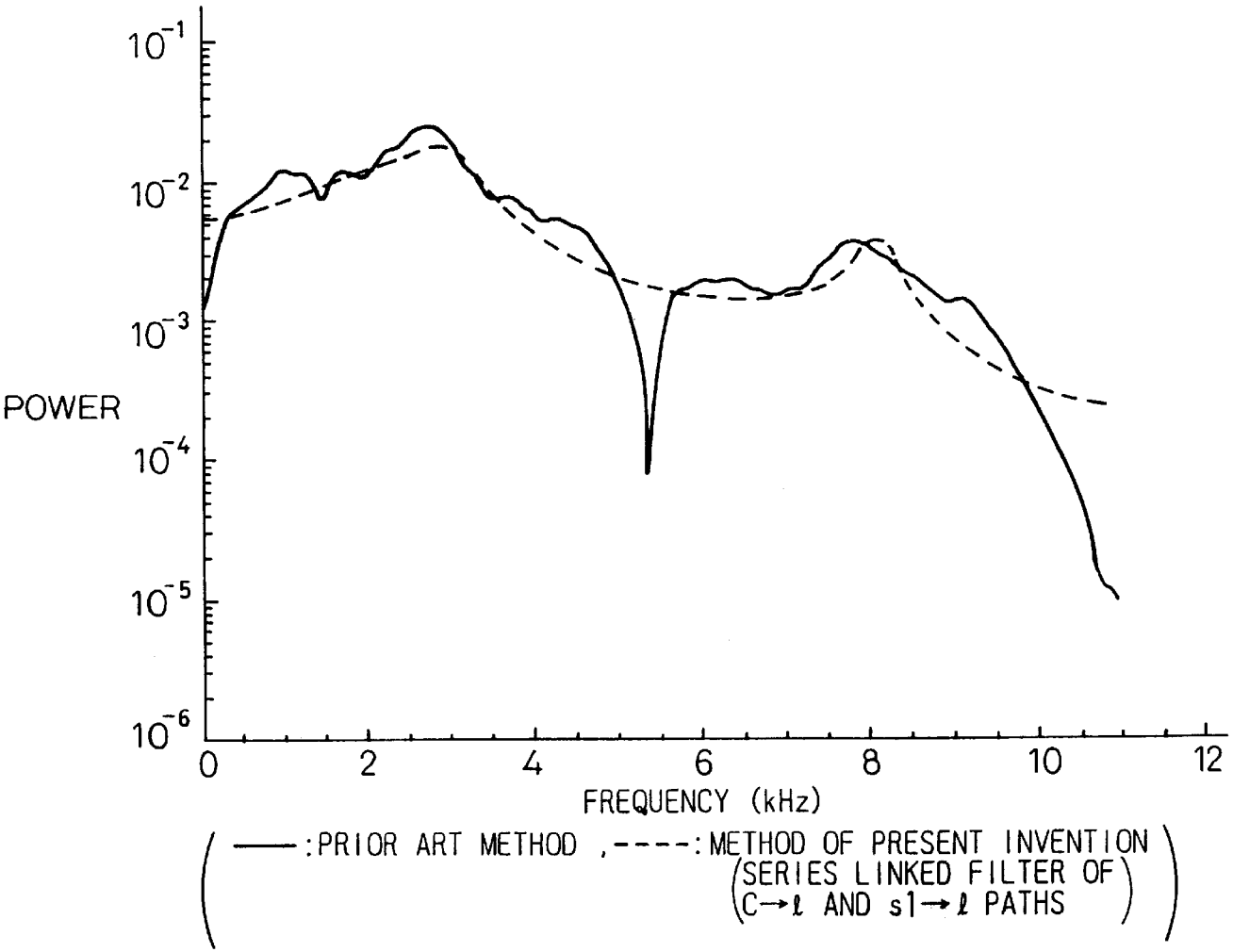
FIG. 49 is a drawing which shows the frequency characteristics obtained by series connection of the common part C→l with the individual part s1→l.

FIGS. 47A through 49 show an example of the frequency characteristics of the acoustic characteristics adding filter shown in FIG. 46. The two sound sources L and R in FIG. 46 correspond, respectively, to the sound sources S1 and S2 shown in FIGS. 47A and 47B, these being disposed with an angle of 30 degrees between them, as seen from the listener. FIG. 47B is a block diagram representation of the acoustic characteristics adding filter of FIG. 46, and FIGS. 48 and 49 show the measurement system.

The broken line of FIG. 48 indicates the frequency characteristics of the common part (C→l) in FIG. 47B, and the broken line in FIG. 49 indicates the frequency characteristics when the common part and individual part are connected in series. The solid lines here indicate the case of 256 taps for a prior art filter, the broken lines indicating the number taps for a short-term synthesis filter according to the present invention, this being 6 taps for C→l and 4 taps for s1→l, for a total of 10 taps. As noted above, because a pitch synthesis filter is not used, the more individual parts there are, the greater is the effect of reducing the amount of calculation.

Figure 50:
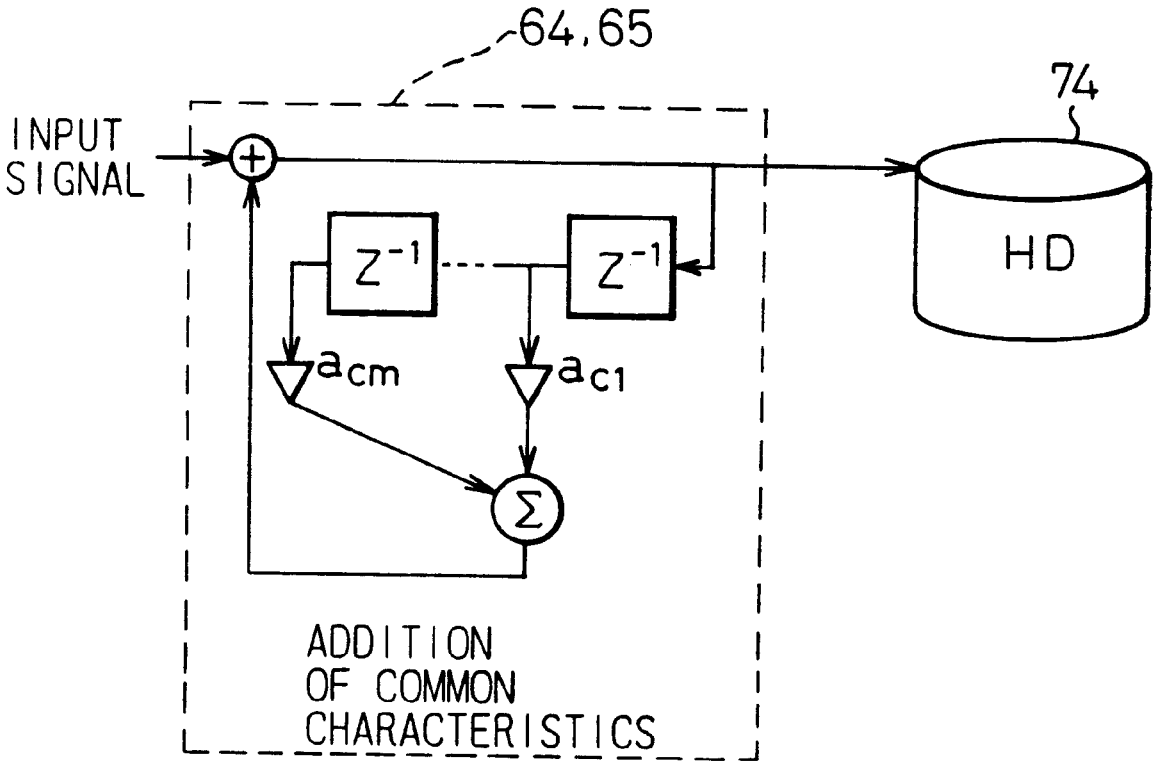
FIG. 50 is a drawing which shows an example of common characteristics storage.

FIG. 50 shows the example of using a hard disk or the like as a storage medium 74 for use with sound signal data to which the common characteristics of common parts 64 and 65 have already been added.

Figure 51:
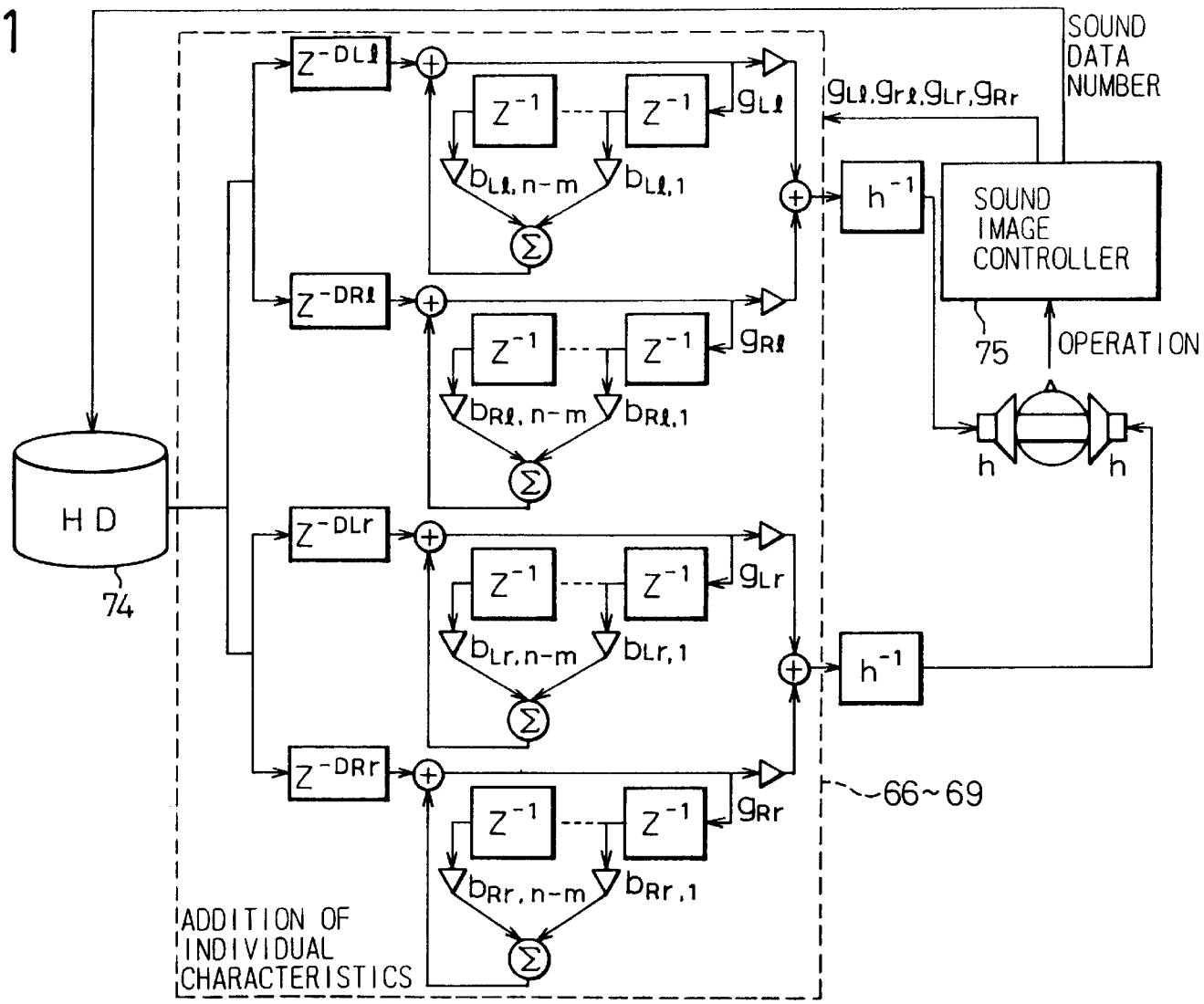
FIG. 51 is a drawing which shows an embodiment of using common characteristics.

FIG. 51 shows the example of reading a signal from the storage medium 74, to which the common characteristics have already been added, rather than performing calculations of the common characteristics, and providing this to the individual parts 66 through 69. In the example of FIG. 51, the listener performs the required operation of the acoustic control apparatus 75, thereby enabling readout of the signal from the storage medium which has already be subjected to common characteristics calculations. The thus readout signal is then subjected to calculations which add to it the individual characteristics and adjust the output gain thereof, to achieve the desired position for the sound image. In accordance with the present invention, it is not necessary to perform real-time calculation of the common characteristics. The signal stored in the storage medium 74 can include, in addition to the above-noted common characteristics, the processing for the inverse of the acoustic characteristics of the headphone, this processing being fixed.

Figure 52:
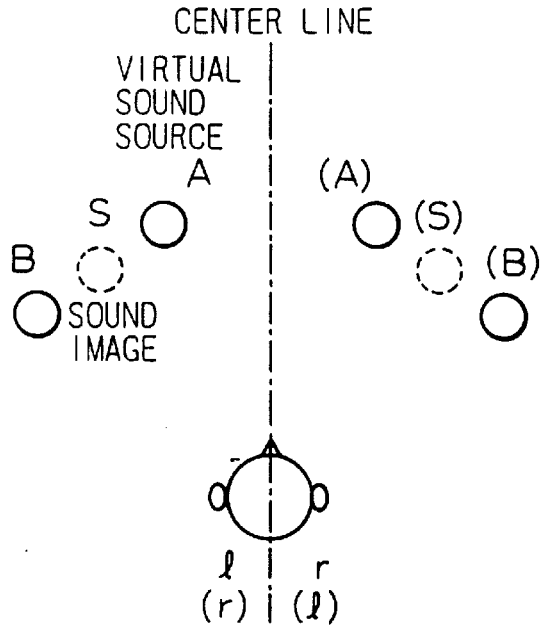
FIG. 52 is a drawing which shows an example of processing with left-to-right symmetry.
Figure 53:
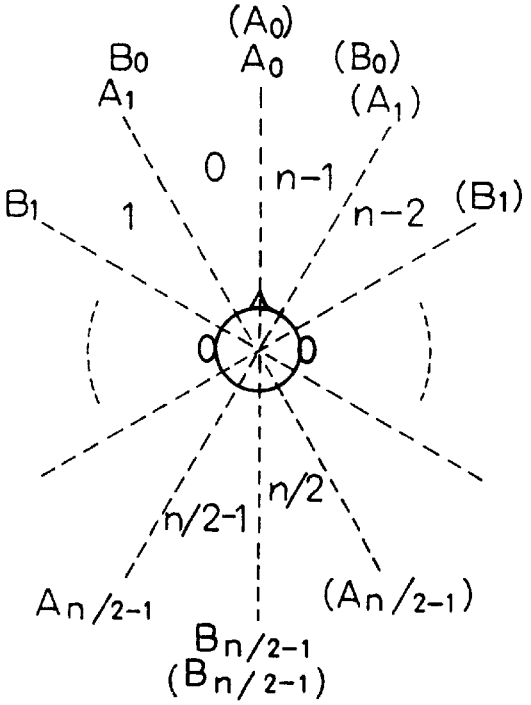
FIG. 53 is a drawing which shows an example of the position of a virtual sound source.

In FIG. 52, two virtual sound sources A and B are used, the levels $g_{Al}$, $g_{Ar}$, $g_{Bl}$, and $g_{Br}$ between them being used to localize the sound image S. Here the processing is performed with left-to-right symmetry with respect to the center line of the listener. That is, the virtual sound sources A and B to the left of the listener and the virtual sound sources A and B to the right of the listener are said to form the same type of acoustic environment with respect to the listener. As shown in FIG. 53, the area surrounding the listener is divided into n equal parts, with virtual sound sources A and B placed on each of the borders therebetween, the acoustic characteristics of the propagation path from each of the virtual sound sources to the ears of the listener being left-to-right symmetrical as shown in FIG. 54. By doing this, it is sufficient to have only 0, . . . , n/2−1 coefficients in reality.

The position of the sound image with respect to the listener is expressed as the angle θ as measured in, for example, the counterclockwise direction from the direct front direction. Next, the Equation (6) given below is used to determine in what region of the n equal-sized regions the sound image is localized, from the angle θ.

$$\text{Region number}=\text{Integer part of } (\theta/(2\pi/n)) \tag{6}$$

In determining the levels $g_{Al}$, $g_{Ar}$, $g_{Bl}$, and $g_{Br}$ of the virtual sound sources, because of the condition of left-to-right symmetry, the angle θ is converted as shown by Equation (7).

$$\theta=\theta(0\leqq\theta\leqq\pi)$$

or $$2\pi-\theta(\pi\leqq\theta\leqq 2\pi) \tag{7}$$

Figure 55:
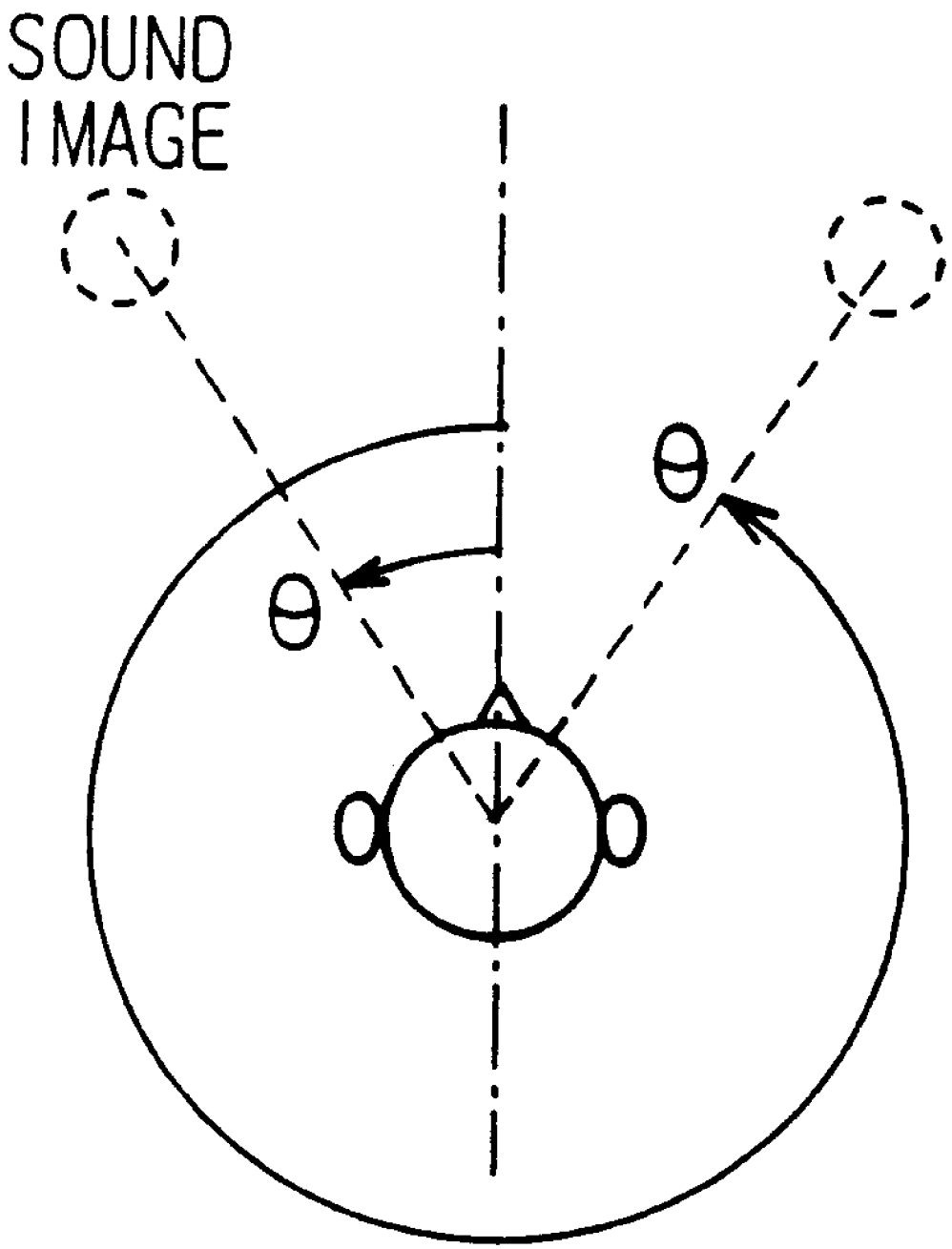
FIG. 55 is a drawing which illustrates the angle θ which represents a sound image.

In this manner, by assuming left-to-right symmetry, it is possible to share the delay, gain, and such coefficients which represent acoustic characteristics on both the left and right. If the value of θ determined in FIG. 55 satisfies the condition $\pi\leqq\theta\leqq 2\pi$, the left and right channel output signals can be exchanged when outputting to the earphones of headphone. By doing this, it is possible to localize a sound image on the right side of the listener which was calculated as being on the left side of the listener.

Figure 56:
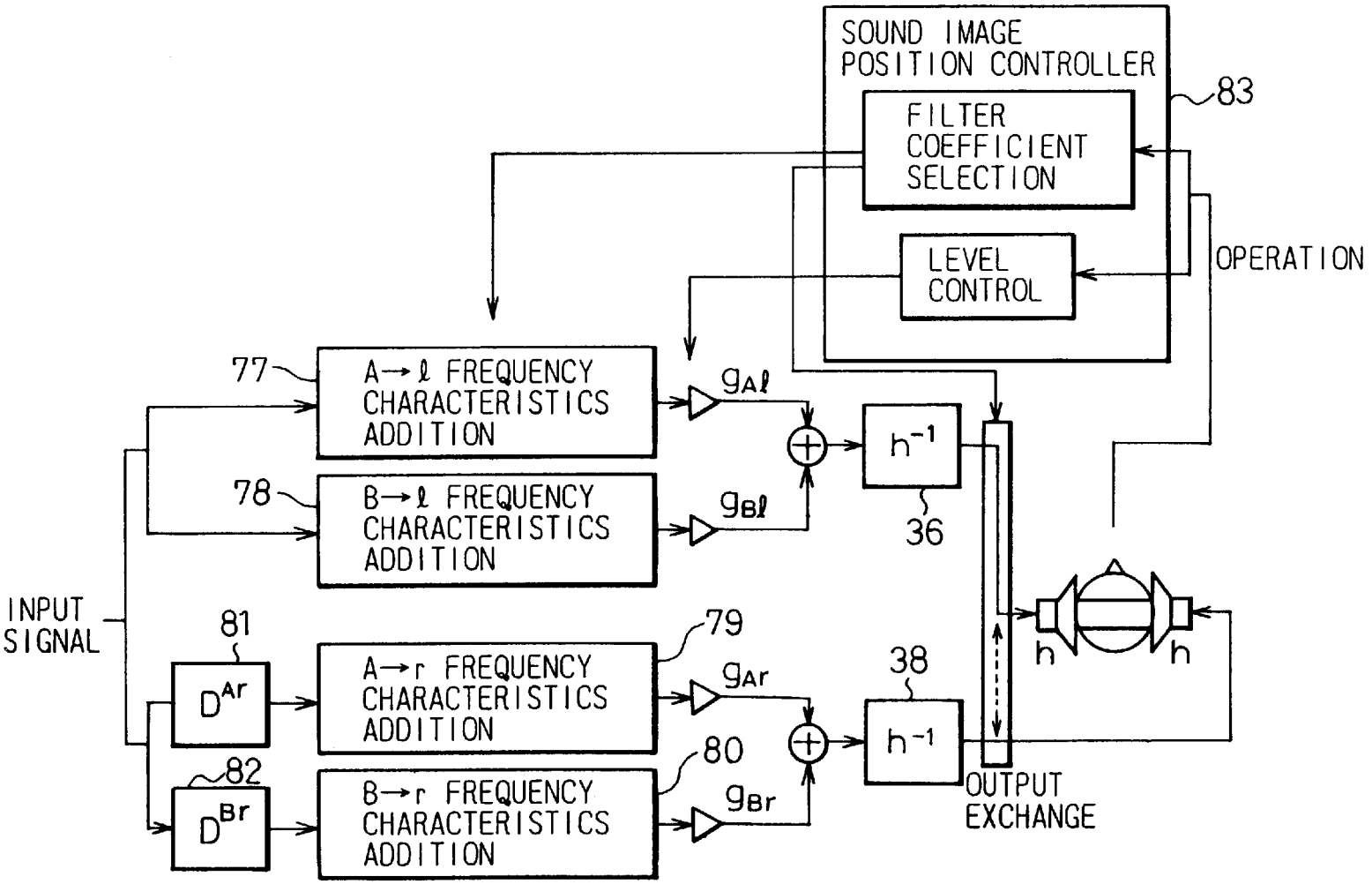
FIG. 56 is a drawing which shows an example of left-to-right symmetrical acoustic characteristics adding filters.

FIG. 56 shows an example of an acoustic characteristics adding filter for the purpose of processing a system such as described above, in which there is left-to-right symmetry. A feature of this acoustic characteristics adding filter is that, by performing the delay processing for the propagation paths A→r and B→r with reference to the delays of A→l and B→l, it is possible to eliminate the delay processing for A→l and B→l. Therefore, it is possible to halve the delay processing to represent the time difference between the two ears.

Figure 57A:
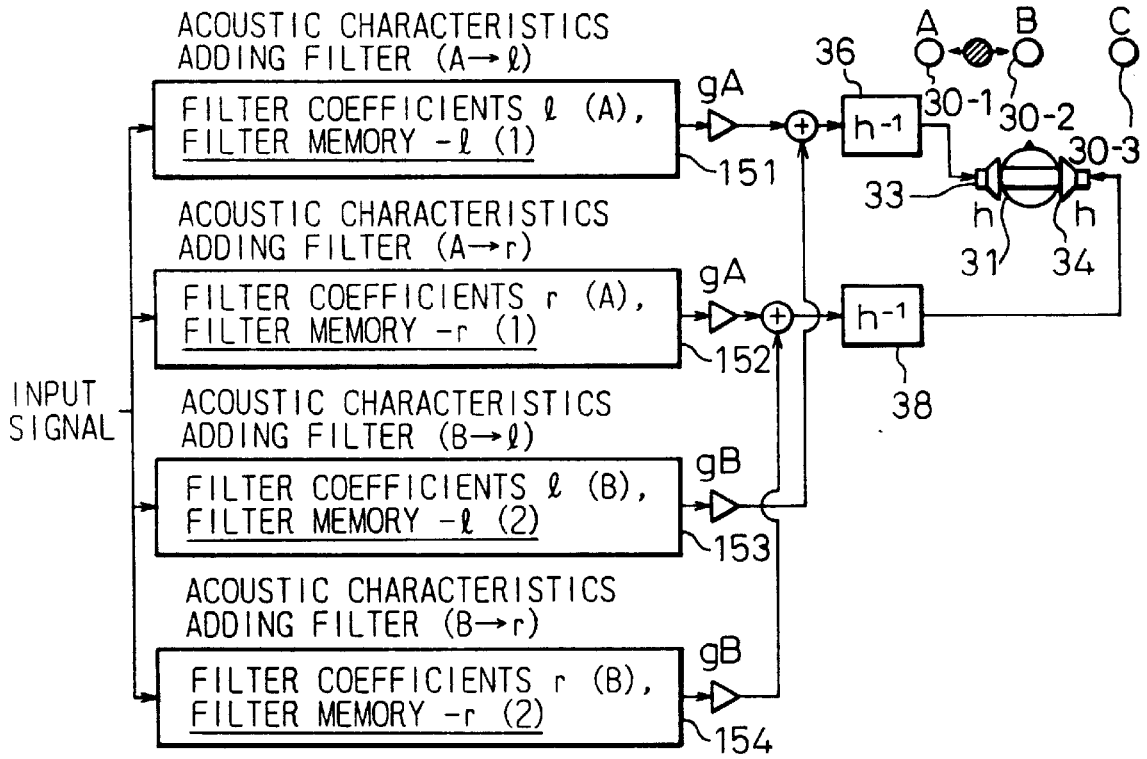
FIG. 57A is a drawing which shows the basic configuration for the purpose of sound image localization in a virtual acoustic space according to the present invention (part 1)
Figure 57B:
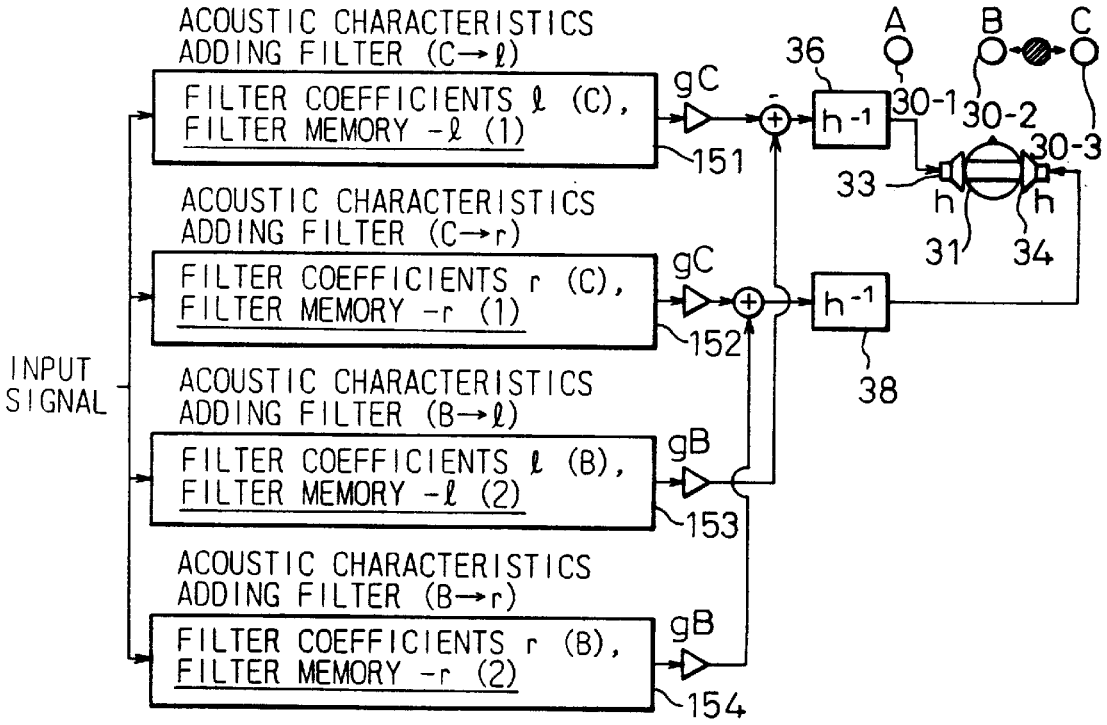
FIG. 57B is a drawing which shows the basic configuration for the purpose of sound image localization in a virtual acoustic space according to the present invention (part 2)

FIG. 57A and FIG. 57B show the conceptual configuration for the processing of a sound image, using output interpolation between a plurality of virtual sound sources.

In FIG. 57A, in order to add the transfer characteristics of each of the acoustic space paths from the virtual sound sources at two locations (A, B) 30-1 and 30-2 to the left and right ears of the listener 31, four acoustic characteristics calculation filters 151 through 154 are provided. These are followed by amplifiers for the adjustment of the gain of each, so that it is possible to either localize a sound image between the above-noted virtual sound sources 30-1 and 30-2 or move the sound image thereamong.

As shown in FIG. 57B, when localizing a sound image between the virtual sound sources (B, C) 30-2 and 30-3 or moving the sound image thereamong, of the four acoustic characteristics calculation filters 151 through 154, the two acoustic characteristics calculation filters 151 and 152 are allocated to the virtual sound source 30-1. In this case, the acoustic characteristics calculation filters 153 and 154 of the virtual sound source 30-2 remain unchanged and are used as is. Similar to the case of FIG. 57A, amplifiers after these filters are provided to adjust each of the gains, enabling positioning of a sound image between virtual sound sources 30-2 and 30-3 or smooth movement of the sound image thereamong.

That is, in accordance with the above-described constitution, (1) it is only necessary to provide two acoustic characteristics calculation filters for the virtual sound sources, and the same is true for subsequent stages of amplifiers and output adder circuits, (2) the acoustic characteristics calculation filter of a virtual sound source (A in the above example) which moves outside the sound-generation area because of movement of the sound image is used as the acoustic characteristics calculation filter for a virtual sound source (C in the above example) which newly moves into the sound-generation area, and (3) a virtual sound source (B in the above example) which belongs to all of the sound-generation areas continues to use the acoustic characteristics calculation filter as is.

Because of the above-noted (1) the amount of hardware, in terms of, for example, memory capacity, that is required for movement of a sound image is minimized, thereby providing not only a simplification of the processing control, but also an increase in speed. By virtue of the above-noted (2) and (3), when switching between sound-generation areas, only the virtual sound source (B) of (3) generates sound, the other virtual sound sources (A and C) having amplifier gains of zero. Therefore, no click noise is generated from the above-noted switch of sound-generation areas.

Figure 58:
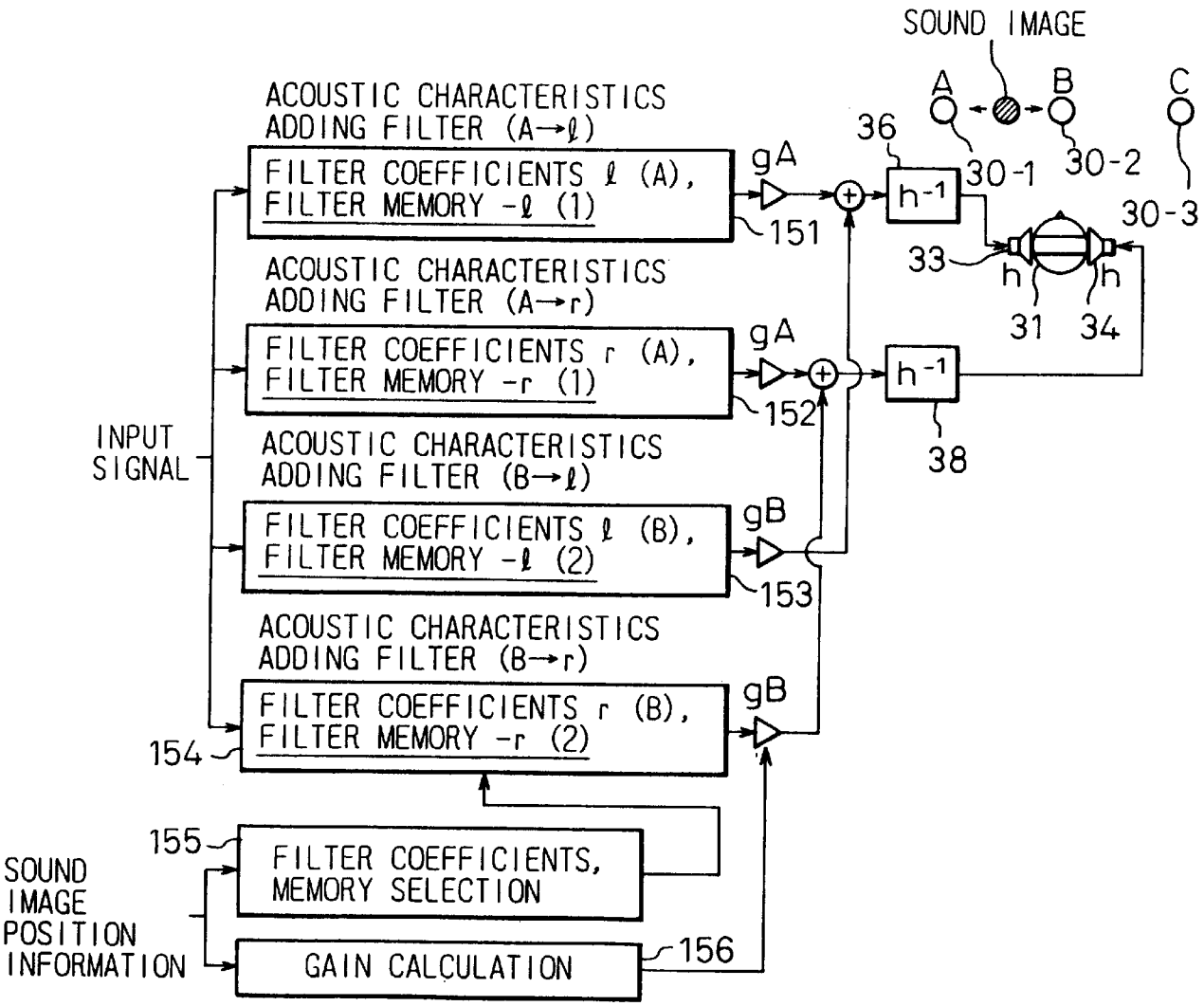
FIG. 58 is a drawing which shows a specific example of FIG. 57A.
Figure 59:
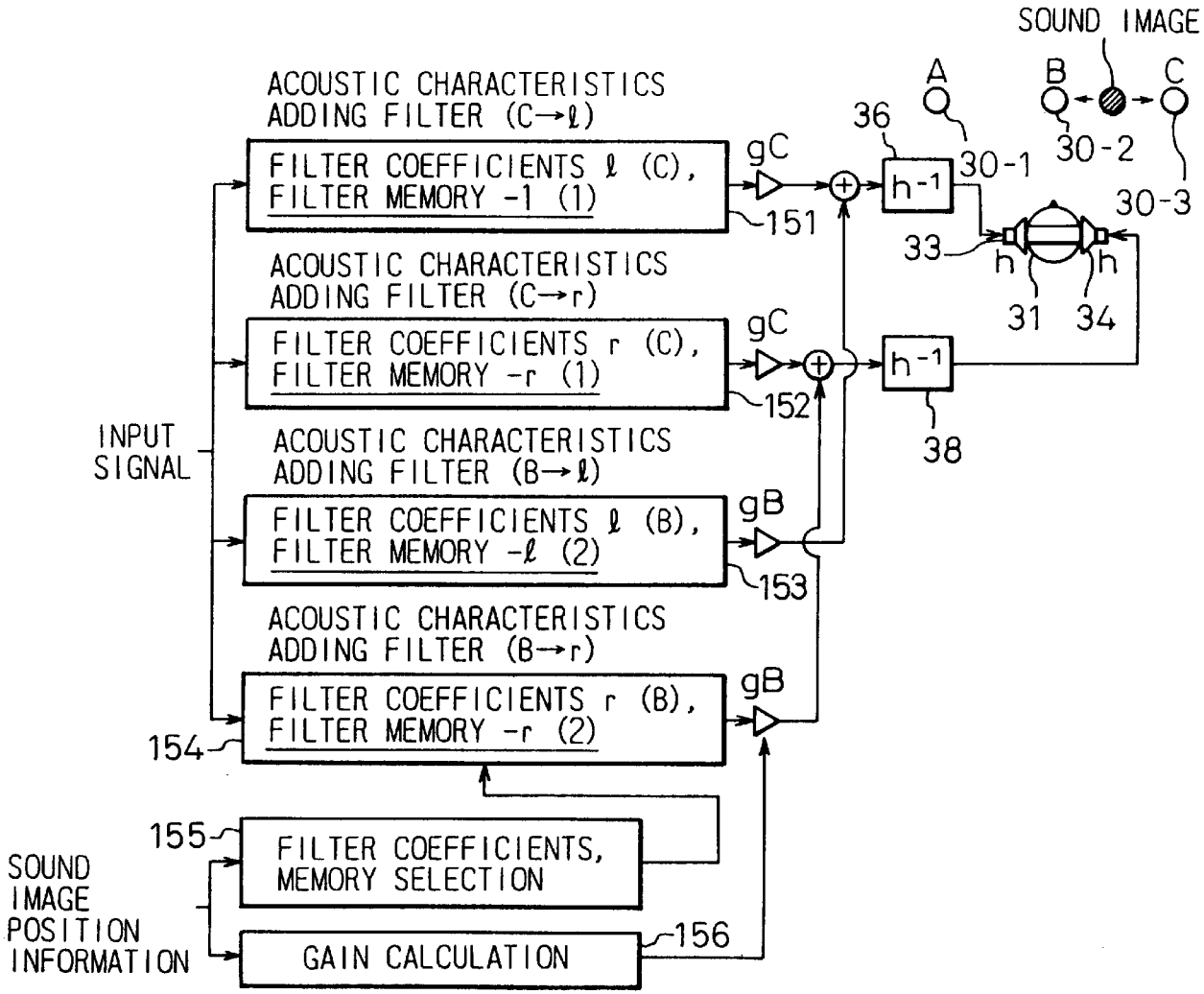
FIG. 59 is a drawing which shows a specific example of FIG. 57B.

FIG. 58 and FIG. 59 each show a specific embodiment of FIG. 57A and FIG. 57B. In both cases, new position information is given, from which a filter controller 155 performs setting of filter coefficients and selection of memory, a gain controller 156 being provided to perform calculation of the gain with respect to the amplifier for each sound image position.

As described above, according to the present invention, because a sound image is localized by using a plurality of virtual sound sources, even when the number or position of the sound images change, it is not necessary to change the acoustic characteristics from each virtual sound source to the listener, thereby eliminating the need to use a linear synthesis filter. Additionally, it is possible to add the desired acoustic characteristics to the original signal with a filter having a small number of taps. It is further possible, by considering the critical bandwidth, to smooth the original impulse response so that there is no audible change, thereby enabling an even further improvement in the accuracy of approximation when approximating frequency characteristics using linear predictive coefficients of low order. In doing this, by compensating for the waveform of the impulse response in the time domain, it is possible to facilitate control of the time and level difference and the like between the two ears of the listener.

Furthermore, according to the present invention, by configuring filters which divide the acoustic characteristics to be added to the input signal into the characteristics which are common to each of the sound image positions and the characteristics which are position specific, it is only necessary to perform one calculation for the common part of the characteristics, thereby enabling a reduction in the overall amount of calculation processing performed. In this case, the larger the number of common characteristics, the greater is the effect of reducing the amount of calculation processing.

In addition, by storing the results of processing for the above common characteristics onto hard disk or other form of storage medium, by merely reading the stored signal from the storage medium it is possible to input this signal to the filter to add the individual characteristics for each position, which processing must be done in real time. For this reason, in addition to a reduction in the amount of calculation performed, the amount of storage capacity is reduced compared to the case in which all information is stored in the storage medium. Furthermore, along with the output signals of the filters to add the common characteristics for each position, it is possible to store output signals obtained by input to acoustic characteristics elimination filters. In this case, it is not necessary to perform the acoustic characteristics elimination filter processing in real time. In this manner, it is possible by using a storage medium to move a sound image with a small amount of processing.

Yet further, according to the present invention, by performing interpolation between positions of a visual image which exhibit discontinuous movement, it is possible to move a sound image continuously by moving the sound image in concert with the interpolated movement of the visual image. It is possible to input the user viewing/listening environment to an visual image controller and sound image controller, this information being used to control the visual image and sound image, thereby presenting a matching set of visual image and sound image movements.

According to the present invention, by performing localization processing of a virtual sound source only when required to localize a sound image as desired, in addition to reducing the amount of required processing and memory capacity, click noise when switching between virtual sound sources is prevented.

In this manner, according to the present invention, the number of filter taps can be reduced without changing the overall acoustic characteristics, making it easy to implement control of a three-dimension sound image using digital signal processor or the like.

What is claimed is:

1. A three-dimensional acoustic apparatus which adds desired acoustic characteristics to an original signal, comprising a linear synthesis filter having filter coefficients that are linear predictive coefficients which are obtained by a linear predictive analysis of an impulse response which represents said acoustic characteristics, wherein said desired acoustic characteristics are added to said original signal by passing through said linear synthesis filter, and further wherein a power spectrum of said impulse response which represents said acoustic characteristics is divided into a plurality of critical bandwidths, said linear predictive analysis being performed based on an impulse signal determined from a power spectrum signal which is represented by a sound signal within each said critical bandwidth, thereby determining said linear synthesis filter coefficients.

2. A three-dimensional acoustic apparatus according to claim 1, wherein said spectrum signal which represents a sound signal within each said critical bandwidth is the accumulated sum of the power spectrum within each critical bandwidth.

3. A three-dimensional acoustic apparatus according to claim 1, wherein said spectrum signal which represents a sound signal within each said critical bandwidth is the maximum value of the power spectrum within each critical bandwidth.

4. A three-dimensional acoustic apparatus according to claim 1, wherein said spectrum signal which represents a sound signal within each said critical bandwidth is the average value of the power spectrum within each critical bandwidth.

5. A three-dimensional acoustic apparatus according to claim 1, wherein output interpolation is performed on the power spectrum signal, which represents the sound signal in each said critical bandwidth, said linear predictive analysis being performed based on an impulse signal determined from said output-interpolated signal, thereby determining said linear synthesis filter coefficients.

6. A three-dimensional acoustic apparatus according to claim 5, wherein said output interpolation is performed as a first-order linear interpolation.

7. A three-dimensional acoustic apparatus according to claim 5, wherein said output interpolation is performed as a high-order Taylor series interpolation.

8. A three-dimensional acoustic apparatus according to claim 1, wherein an impulse response, which is represented by the series connection of a transfer characteristics in the original sound field and the inverse of the acoustic characteristics in the reproduction field, is used as an impulse response which represents said acoustic characteristics, a single linear synthesis filter, based on said linked impulse response, adding said acoustic characteristics in said original sound field and eliminating said acoustic characteristics in said reproduction field.

9. A three-dimensional acoustic apparatus according to claim 1, further comprising a compensation filter which minimizes an error between said impulse response of said linear synthesis filter, using said linear predictive coefficients, and said impulse response which represents said acoustic characteristics.

* * * * *